US010859337B1

(12) United States Patent
Bernal

(10) Patent No.: US 10,859,337 B1
(45) Date of Patent: Dec. 8, 2020

(54) TOY PROJECTILE SYSTEM

(71) Applicant: HASBRO, INC., Pawtucket, RI (US)

(72) Inventor: Dennis Bernal, Milford, MA (US)

(73) Assignee: HASBRO, INC., Pawtucket, RI (US)

( * ) Notice: Subject to any disclaimer, the term of this patent is extended or adjusted under 35 U.S.C. 154(b) by 0 days.

(21) Appl. No.: 16/828,830

(22) Filed: Mar. 24, 2020

Related U.S. Application Data

(60) Provisional application No. 62/901,777, filed on Sep. 17, 2019, provisional application No. 62/865,702, filed on Jun. 24, 2019, provisional application No. 62/824,003, filed on Mar. 26, 2019, provisional application No. 62/824,000, filed on Mar. 26, 2019.

(51) Int. Cl.

| | |
|---|---|
| ***F41B 4/00*** | (2006.01) |
| ***F41B 7/08*** | (2006.01) |
| *F41B 11/54* | (2013.01) |
| *F41B 11/89* | (2013.01) |
| *F41B 11/723* | (2013.01) |

(52) U.S. Cl.
CPC ..... *F41B 4/00* (2013.01); *F41B 7/08* (2013.01); *F41B 11/54* (2013.01); *F41B 11/723* (2013.01); *F41B 11/89* (2013.01)

(58) Field of Classification Search
CPC ..... F41B 4/00; F41B 7/08
See application file for complete search history.

(56) References Cited

U.S. PATENT DOCUMENTS

| | | | | |
|---|---|---|---|---|
| 1,441,975 A | | 1/1923 | Edelin | |
| 1,488,995 A | | 4/1924 | McCollom | |
| 2,499,029 A | * | 2/1950 | McElroy | F42B 6/003 473/585 |
| 2,737,942 A | | 3/1956 | Horowitz et al. | |
| 2,828,965 A | * | 4/1958 | Schwitzki | F42B 6/04 473/586 |
| 3,054,536 A | | 9/1962 | Sagarin | |
| 3,059,928 A | * | 10/1962 | Flanagan | F42B 6/003 273/408 |
| 3,420,133 A | | 1/1969 | Proll | |
| 3,990,426 A | | 11/1976 | Stokes | |
| 4,170,215 A | | 10/1979 | Kettlestrings | |
| 4,212,285 A | | 7/1980 | Cagan et al. | |
| 4,248,202 A | | 2/1981 | Jaworski et al. | |
| 4,659,320 A | | 4/1987 | Rich et al. | |
| 4,841,945 A | | 6/1989 | Braden | |
| 4,890,404 A | | 1/1990 | Ferri | |
| 5,156,137 A | | 10/1992 | Clayton | |
| 5,165,383 A | | 11/1992 | Ebert et al. | |
| 5,186,156 A | | 2/1993 | Clayton | |

(Continued)

OTHER PUBLICATIONS

European Patent Application No. 20165549.5, Extended European Search Report, dated Aug. 25, 2020.

(Continued)

*Primary Examiner* — John A Ricci

(74) *Attorney, Agent, or Firm* — Marshall, Gerstein & Borun LLP

(57) ABSTRACT

In accordance with embodiments a toy projectile system can have a toy projectile and a toy projectile launcher having an improvised projectile checking and locking feature to confirm presence of a proper projectile of the system through detection of the nub and prevent launch of a projectile not designed for use with the system.

28 Claims, 49 Drawing Sheets

(56) References Cited

U.S. PATENT DOCUMENTS

| | | | | |
|---|---|---|---|---|
| 5,205,271 | A | 4/1993 | Casas Salva | |
| 5,471,967 | A | 12/1995 | Matsuzaki et al. | |
| 5,529,050 | A | 6/1996 | D'Andrade | |
| 5,575,270 | A | 11/1996 | Casas-Salva | |
| 6,488,019 | B2 | 12/2002 | Kotsiopoulos | |
| 6,523,535 | B2 * | 2/2003 | Rehkemper | F41B 4/00 124/78 |
| 6,595,880 | B2 * | 7/2003 | Becker | F42B 6/04 124/44.5 |
| 7,051,727 | B2 | 5/2006 | Wu | |
| 7,228,802 | B2 * | 6/2007 | Montefusco | F42B 8/16 102/501 |
| 7,849,627 | B2 | 12/2010 | Wygant | |
| 8,082,909 | B2 | 12/2011 | Sopinsky et al. | |
| 8,127,753 | B1 | 3/2012 | Brooks et al. | |
| 8,397,705 | B2 | 3/2013 | DeHaan et al. | |
| 8,567,378 | B2 | 10/2013 | Nugent | |
| 8,695,579 | B2 | 4/2014 | Huebl | |
| 8,875,688 | B2 | 11/2014 | Nugent | |
| 8,955,503 | B2 * | 2/2015 | Corsiglia | F42B 6/00 124/78 |
| 8,967,130 | B2 | 3/2015 | Victor et al. | |
| 9,027,541 | B2 | 5/2015 | Huebl | |
| 9,097,484 | B2 | 8/2015 | Poirier | |
| 9,194,646 | B2 | 11/2015 | Victor et al. | |
| 9,389,042 | B1 | 7/2016 | Clayton | |
| 9,459,081 | B2 * | 10/2016 | Chia | F42B 6/08 |
| 9,500,432 | B2 | 11/2016 | Chia | |
| 9,958,230 | B1 | 5/2018 | Nugent et al. | |
| 10,408,583 | B2 * | 9/2019 | Isenmann | F42B 12/745 |
| 10,408,584 | B2 * | 9/2019 | Isenmann | F42B 6/08 |
| 10,551,156 | B2 * | 2/2020 | Chia | F42B 6/08 |
| 2002/0166551 | A1 | 11/2002 | Lee | |
| 2006/0046877 | A1 * | 3/2006 | Gajda, Jr. | F42B 6/10 473/572 |
| 2009/0050127 | A1 | 2/2009 | Wygant | |
| 2009/0095272 | A1 | 4/2009 | Zimmerman | |
| 2010/0206281 | A1 | 8/2010 | Kanitz et al. | |
| 2011/0174768 | A1 * | 7/2011 | Yarro | B65D 81/365 215/382 |
| 2013/0112184 | A1 | 5/2013 | Corsiglia et al. | |
| 2013/0239938 | A1 | 9/2013 | Nugent | |
| 2013/0312722 | A1 | 11/2013 | Price | |
| 2014/0352677 | A1 | 12/2014 | Chia | |
| 2015/0308782 | A1 * | 10/2015 | Chia | F41B 11/641 124/78 |
| 2018/0051966 | A1 | 2/2018 | Isenmann | |
| 2018/0292189 | A1 * | 10/2018 | Isenmann | F42B 6/08 |

OTHER PUBLICATIONS

Extended European Search Report, European Patent Application No. 20165546.1, dated Aug. 21, 2020.

International Application No. PCT/US2020/024401, International Search Report and Written Opinion, dated Jul. 27, 2020.

International Application No. PCT/US2020/024415, International Search Report and Written Opinion, dated Jul. 21, 2020.

International Application No. PCT/US2020/024422, International Search Report and Written Opinion, dated Jul. 27, 2020.

* cited by examiner

Time Step 0

Time Step 1

Time Step 1

Time Step 2

Time Step 2

Time Step 3

Locked

Time Step 0

Time Step 1

Time Step 2

Pre-Time Step 0′

Time Step 0

Time Step 1

Time Step 2

Time Step 2

Time Step A

Time Step A

TOY PROJECTILE SYSTEM

CROSS-REFERENCE TO RELATED APPLICATIONS

This application claims the benefit of priority of U.S. Provisional Application No. 62/824,003 filed Mar. 26, 2019, U.S. Provisional Patent Application Nos. 62/824,000 filed on Mar. 26, 2019, U.S. Provisional Application No. 62/865,702 filed Jun. 24, 2019, and U.S. Provisional Application No. 62/901,777 filed Sep. 17, 2019, the respective disclosures of which are incorporated herein by reference in their entireties.

BACKGROUND

Field of the Disclosure

The disclosure relates generally to a toy projectile system, and, more particularly, to a toy projectile system that includes toy projectiles and a toy projectile apparatus that has multiple improvised projectile (IP) detection features to prevent the insertion or loading of inappropriate objects and to prevent operation of the launch apparatus unless the toy projectile of the system is inserted at the improvised projectile checking housing assembly.

Brief Description of Related Technology

Toys and other devices that discharge objects have been designed in the past with various housing and internal elements. These devices are designed to discharge specifically design projectiles to eliminate or greatly reduce bodily injury and property damage. To insure that users not succeed in inserting objects that are dangerous and/or destructive better safety features are needed.

Various launching devices are known and are disclosed in several existing patents to prevent inappropriate object use and for safety features disabling such launching apparatus from operation where an improvised projectile may have been inserted therein. U.S. Pat. No. 4,212,285 to Cagan, et al. for "Dart gun and dart therefor" issued Jul. 15, 1980 discloses a one-piece dart shaft complementary to the dart barrel with a uniform non-circular cross section so that the propelling element makes a substantially air tight seal with the dart barrel, with a barrier for positively preventing physical contact between an air displacing piston and the dart. The piston provided with a central conical element facing the dart barrel where the rearward end of such an object will be engaged by the central conical element on the piston and deflected laterally, thereby wedging such an object within the dart gun so that it cannot be mechanically propelled by physical contact with the piston.

U.S. Pat. No. 5,156,137 to Clayton for "Projectile launcher" issued Oct. 20, 1992 concerns a projectile launching device where a spring, housed inside the barrel, rests against the release member of the lever assembly such that when a projectile is inserted into the barrel it compresses the spring against the release member and pivots the lever assembly to force the hook into the barrel and into engagement with the projectile tab as being locked together. U.S. Pat. No. 5,186,156 to Clayton for "Air operated toy gun" issued Feb. 16, 1993 discloses a movable air nozzle for successive engagement with a plurality of projectile launching barrels having rearward ends reduced diameter sections facilitate generally snug airtight fit to prevent the projectile shaft rearward end from exiting the rearward opening of the barrel, without a projectile receiving opening for allowing an appropriate size projectile at an opening for checking and preventing another projectile from the projectile receiving opening.

U.S. Pat. No. 5,165,383 to Ebert, et al. for "Gun with Pivoting Barrel, Projectile Loader, and Trigger Interlock," issued Nov. 24, 1992 purports to disclose as a safety feature a BB gun with a barrel that pivots from the front. When latched the barrel is aligned and may be fired, when unlatched the barrel pivots and cannot be fired. U.S. Pat. No. 5,205,271 to Casas-Salva for "Air Rifles of the Hinged Barrel Type," issued Apr. 27, 1993 purports to disclose an air rifle with a pivoting barrel for cocking a piston/spring and a spring biased catch for holding the barrel in alignment for firing. U.S. Pat. No. 5,529,050 to D'Andrade for "Safety Nozzle For Projectile Shooting Air Gun" issued Jun. 25, 1996 purports to disclose a safety mechanism having a nozzle, a spring biased valve element, and a hollow launch tube where the valve element is located in the path of airflow from an inlet to a hollow chamber inside the launch tube, where the projectile predetermined shape pushes against plural peripheral posts rearward which opens the air passageway around a cross-shaped valve element, thus problematic in that the nozzle and the valve element is that the air pressure generated by a launch spring must bear against and flow around the valve element before reaching the projectile to cause discharge. This airflow route causes a pressure drop, a loss of energy that is not desirable or efficient. U.S. Pat. No. 5,575,270 to Casas-Salva for "Air Guns," issued Nov. 19, 1996 purports to disclose another air gun having a pivoting barrel, two spaced apart arms on the stock, and a tongue on the barrel so that when the barrel is brought into alignment the tongue fits between the arms to ensure proper location.

U.S. Pat. No. 9,097,484 to Poirier for "Toy launch apparatus with safety latches" issued Aug. 4, 2015 provides improvements for predetermined projectiles with apparatus includes multiple safety features to prevent inappropriate objects inserted into the apparatus from enabling the apparatus to operate. Therein latches are mounted which lock a shuttle to a housing assembly with the shuttle out of engagement with an abutment surface unless a properly sized projectile is inserted. U.S. Pat. No. 9,500,432 to Chia for "Hinged arm safety mechanism for foam dart launcher" issued Nov. 22, 2016 discloses a launching section with a safety arm and movable trigger, such that a non-standard dart having a length less than a minimum threshold may not engage the safety arm such that the body of safety arm may inhibit launching.

These patents and devices are of some interest, however, the prior art neither discloses toy launcher apparatus and method with enhanced play value and locking features in checking for improvised projectile, nor projectile barrel assembly structure having a projectile receiving opening at the improvised projectile checking housing assembly for correspondingly structured and appropriately sized projectiles with a corresponding feature present at the projectile receiving opening of the improvised projectile checking housing assembly and preventing another projectile from the projectile receiving opening.

Various projectile toys exist on the market, such as darts, discs, arrows, and balls. Conventionally such projectile toys are foam structures made from extruded foamed materials, such as polyurethanes and polyethylenes. Such toy projectiles are be designed to be discharged with sufficient force for desired flight characteristics, while maintaining safe impact force when hitting a target to avoid injury to the users. The softness required for safety standards can run contrary to the needs for providing desired flight characteristics, such as distance, accuracy, and precision.

SUMMARY

In embodiments, a toy projectile system can include a toy projectile comprising a body having first and second ends and a nub extending outwardly from the second end, the nub being sized to interact with an improvised projectile checking housing assembly of a toy projectile launching apparatus; and the toy projectile launch apparatus with improvised projectile checking and locking features. The toy projectile launch apparatus can include a projectile retaining element; a projectile barrel assembly extending rearward the projectile retaining element with the improvised projectile checking housing assembly of the projectile barrel assembly movable between checking and non-checking positions, the projectile barrel assembly comprising a step structure having a projectile receiving opening at the improvised projectile checking housing assembly thereof for allowing the toy projectile the nub present at the projectile receiving opening and preventing another projectile from the projectile receiving opening; an elongated structure in the improvised projectile checking housing assembly to check the nub; an improvised projectile button positioned at the end of the elongated structure; and an improvised projectile checking spring mounted to the improvised projectile button with the end of the elongated structure, the improvised projectile button of the elongated structure movable between checking and non-checking positions and preventing movement thereof unless the toy projectile having the nub is present at the projectile receiving opening of the improvised projectile checking housing assembly.

In embodiments, a toy projectile system can include a toy projectile comprising a body having first and second ends and a nub extending outwardly from the second end, the nub being sized to interact with an improvised projectile checking housing assembly of a toy projectile launching apparatus; and the toy projectile launch apparatus with improvised projectile checking and locking features. The toy projectile launch apparatus can include a projectile retaining element having a front side and a backside on the toy launch apparatus for receiving projectiles therein at the backside of the projectile retaining element; a projectile propelling mechanism forward the projectile retaining element for propelling the received projectiles from the front side of the projectile retaining element; an improvised projectile checking lock gauge supported with the toy launch apparatus rearward the projectile retaining element where said gauge is disposed to translate alongside the projectiles received at the backside of the projectile retaining element for checking the outer diameter of received projectiles; and a catch at said gauge preventing advancing of the projectile forward in the projectile retaining element.

BRIEF DESCRIPTION OF THE DRAWING FIGURES

FIG. 1A is a perspective view of a toy launch apparatus embodiment and FIG. 1B illustrates the launch apparatus having a housing half removed to reveal internal structures, with FIGS. 10 and 1D showing the multiple improvised projectile checking and locking features embodied with a present preferred embodiment, and FIG. 1E also showing an alternate embodiment positioning a locking key atop moving with the improvised projectile checking housing assembly in accordance with the present inventions.

FIGS. 2A and 2B are exposed side elevational and perspective views of a toy projectile apparatus with multiple improvised projectile features about to be checked for the launch apparatus shown in FIGS. 1B-D.

FIGS. 2C through 2G provide views of dart projectile designs with rearward stepped fins and nub portions of acceptable projectiles for the launch apparatus using improvised projectile checking housing assembly for correspondingly structured and appropriately sized projectiles with a corresponding feature present at a projectile receiving opening with a corresponding step.

Figure 5A:
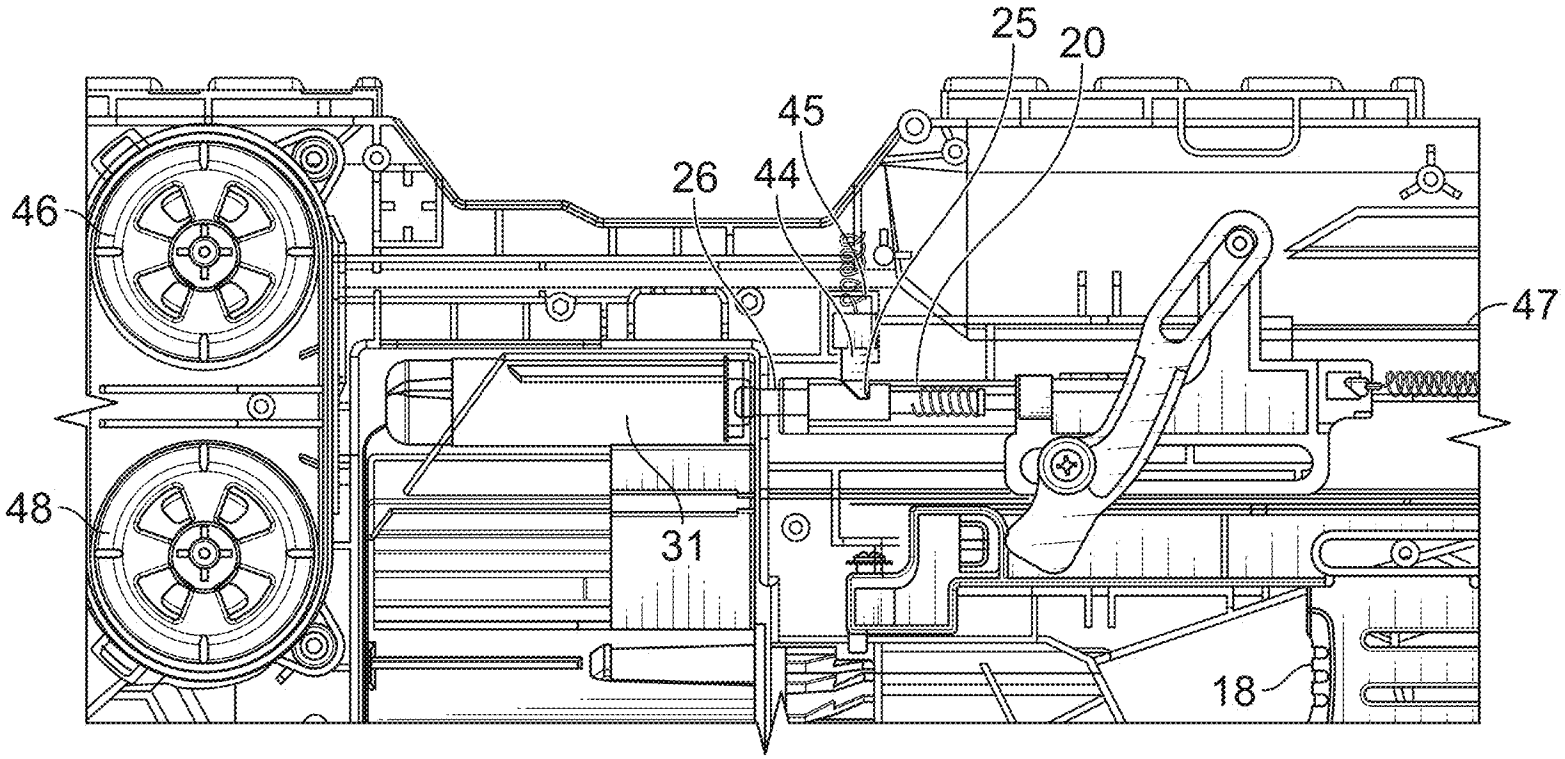
Figure 5B:
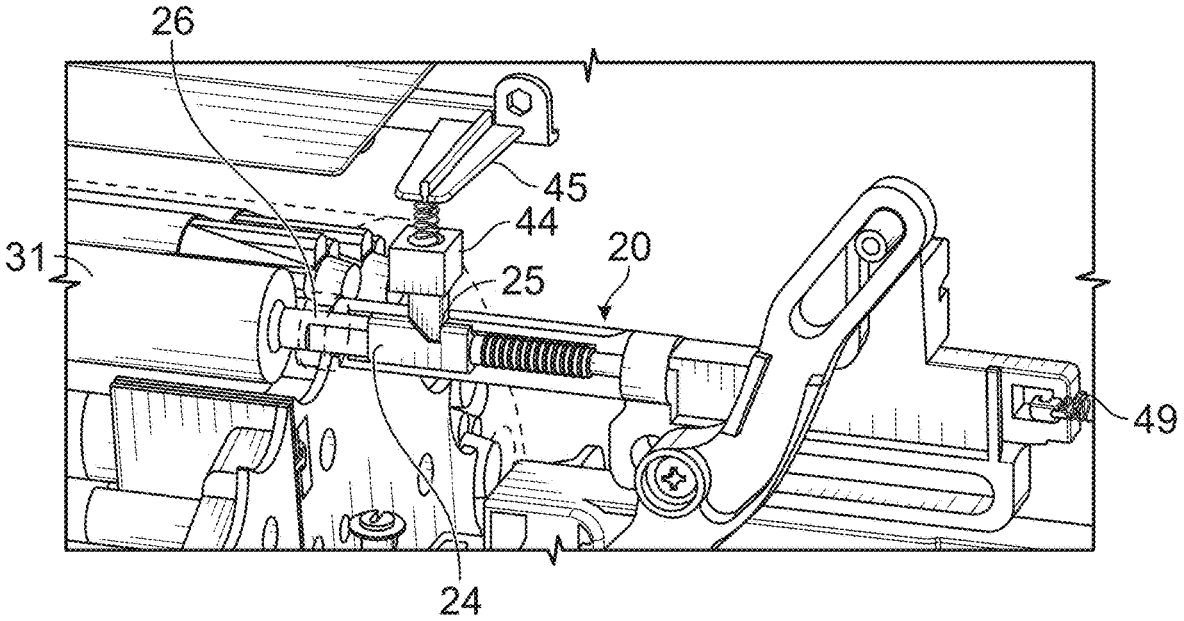

FIGS. 5A and 5B are exposed side elevational and perspective views of a toy projectile launch apparatus shown as preventing insertion, loading of inappropriate objects, preventing further movement of the improvised projectile checking housing without the appropriate size projectile is present at the projectile receiving opening of the improvised projectile checking housing assembly in accordance with the present inventions.

Figure 6:
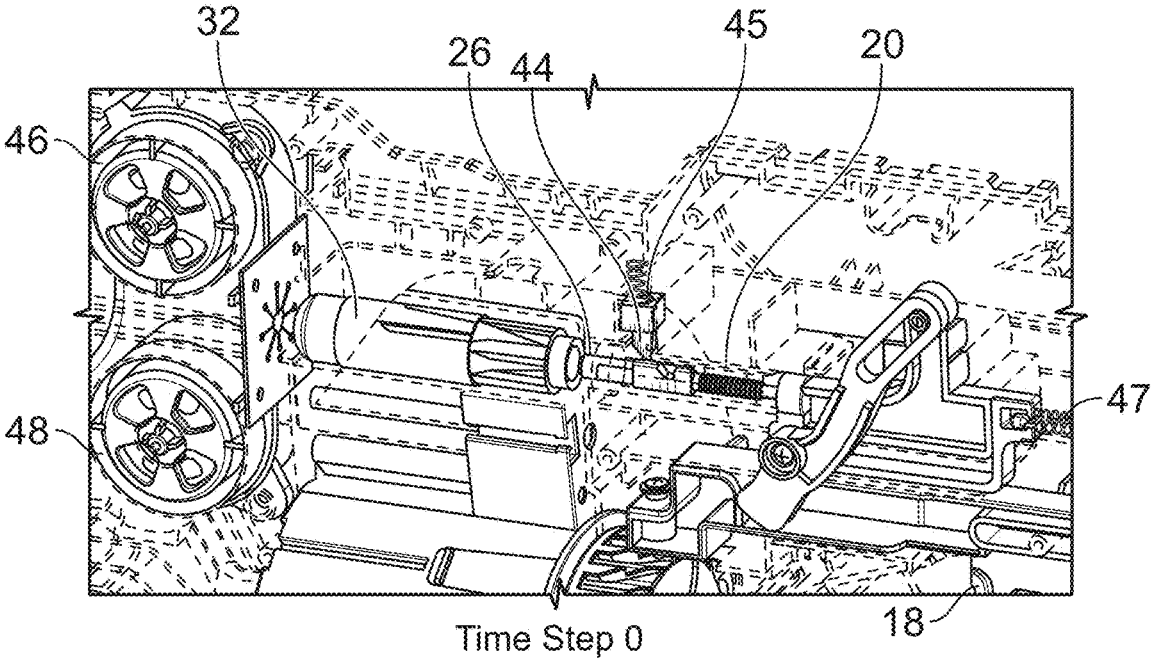

FIG. 6 is a perspective view of a toy projectile apparatus showing the IP locking key structure rearward from the projectile receiving opening to the improvised projectile checking housing assembly, with some internal elements removed for clarity.

FIGS. 7A through 7D are enlarged perspective views, partially in section, showing respectively the IP locking key engaged having the launch apparatus and trigger as preventing insertion, loading of inappropriate objects, preventing further movement of the improvised projectile checking housing, with first and second catch latch apertures opening to a catch latch recess of elongated structure in accordance with the present inventions.

Figure 8A:
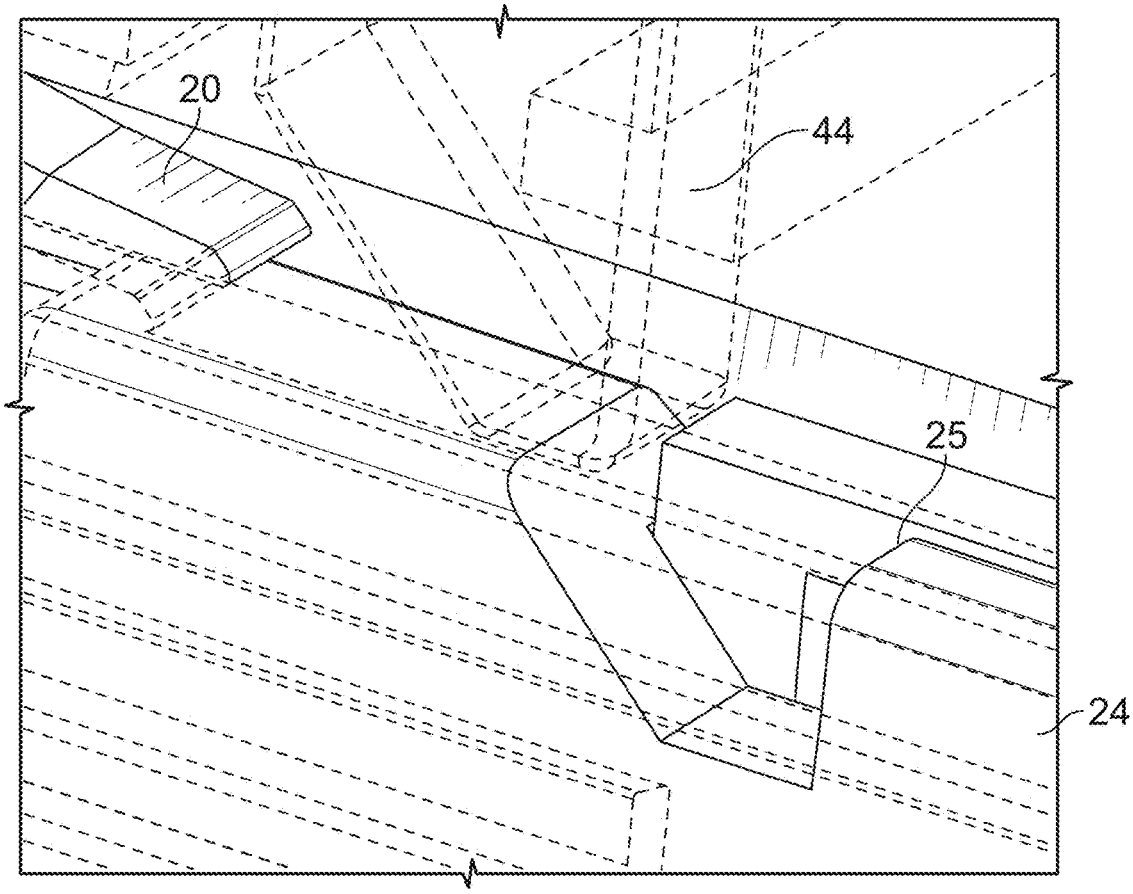
Figure 8B:
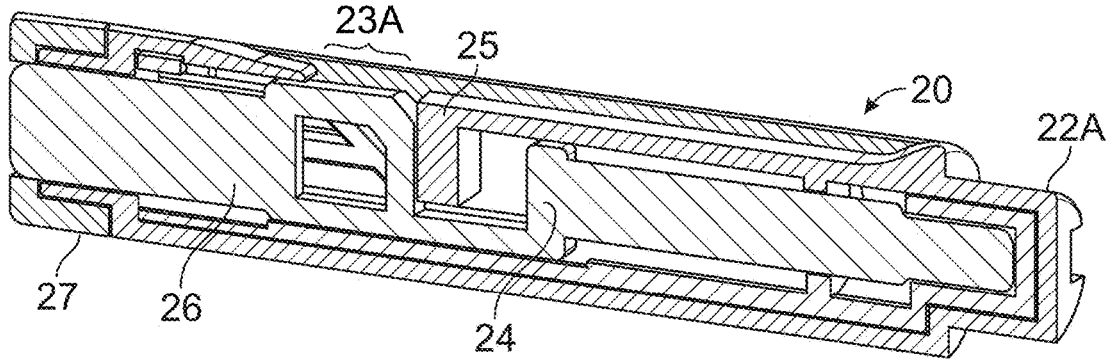

FIGS. 8A and 8B are enlarged perspective views, partially in section, showing the IP locking key with the lock closed and disengaged, having the first and second catch latch apertures closed off the catch latch recess of elongated structure in accordance with the present inventions.

Figure 9A:
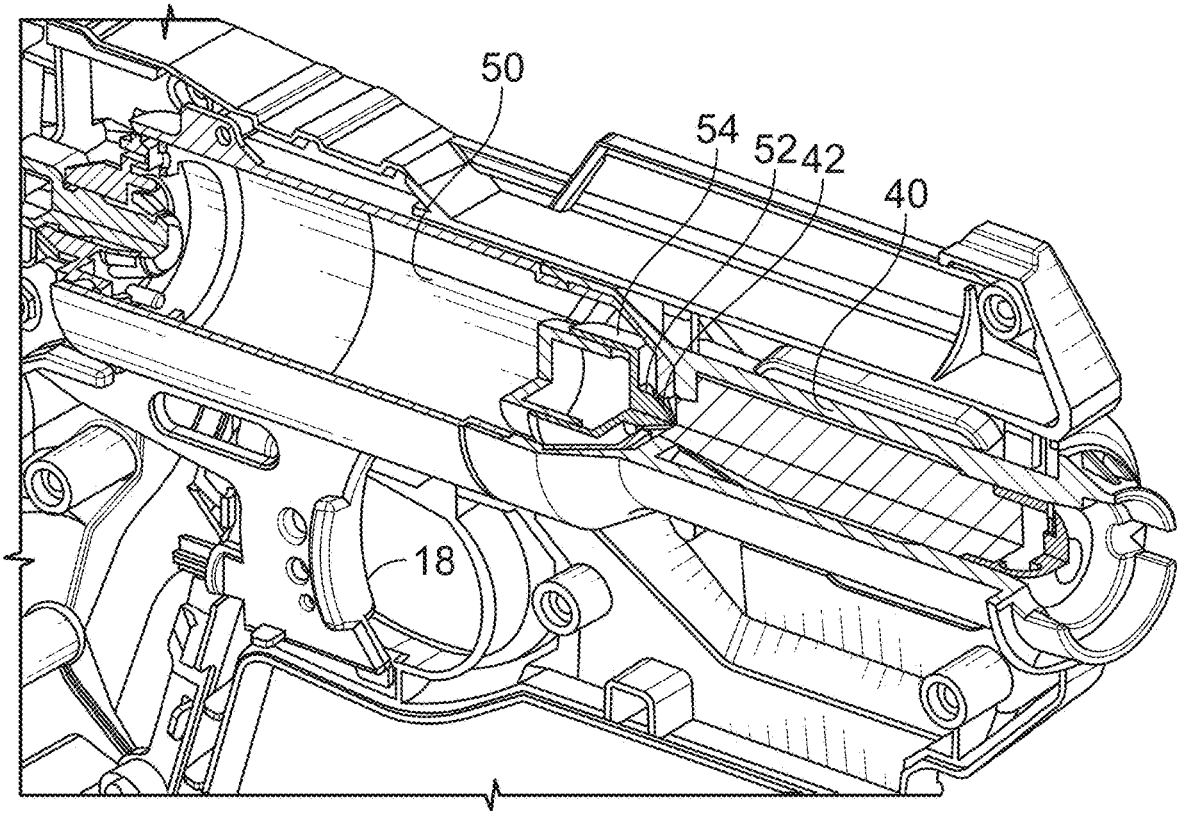
Figure 9B:
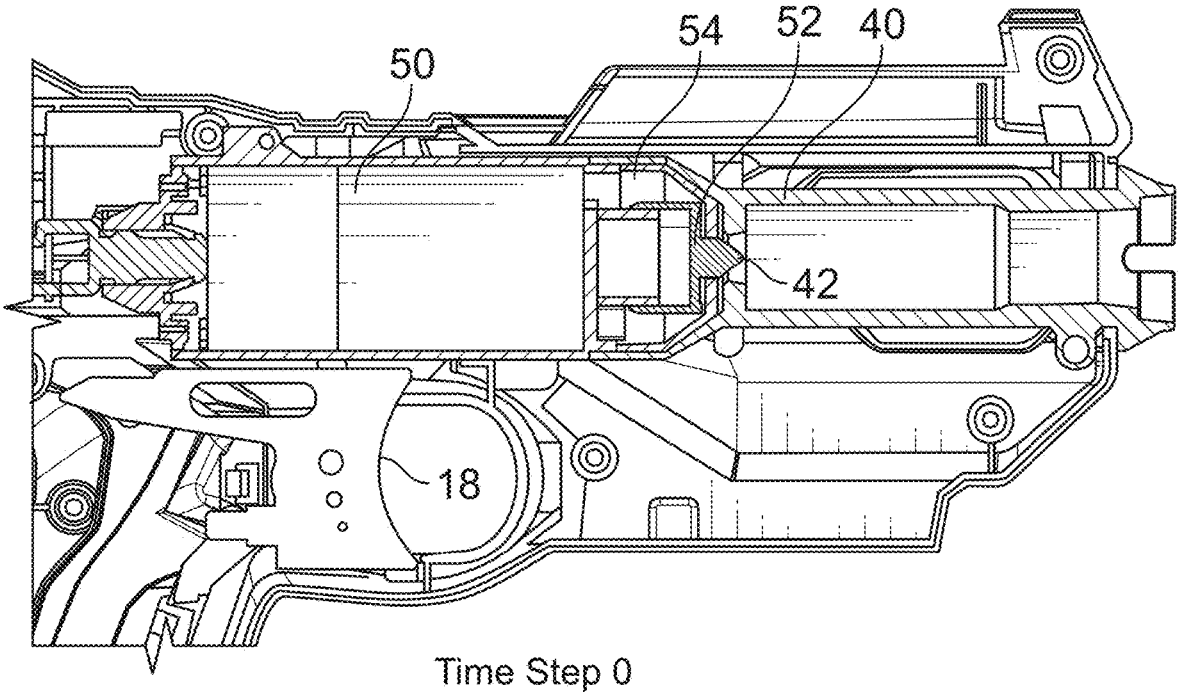
Figure 10:
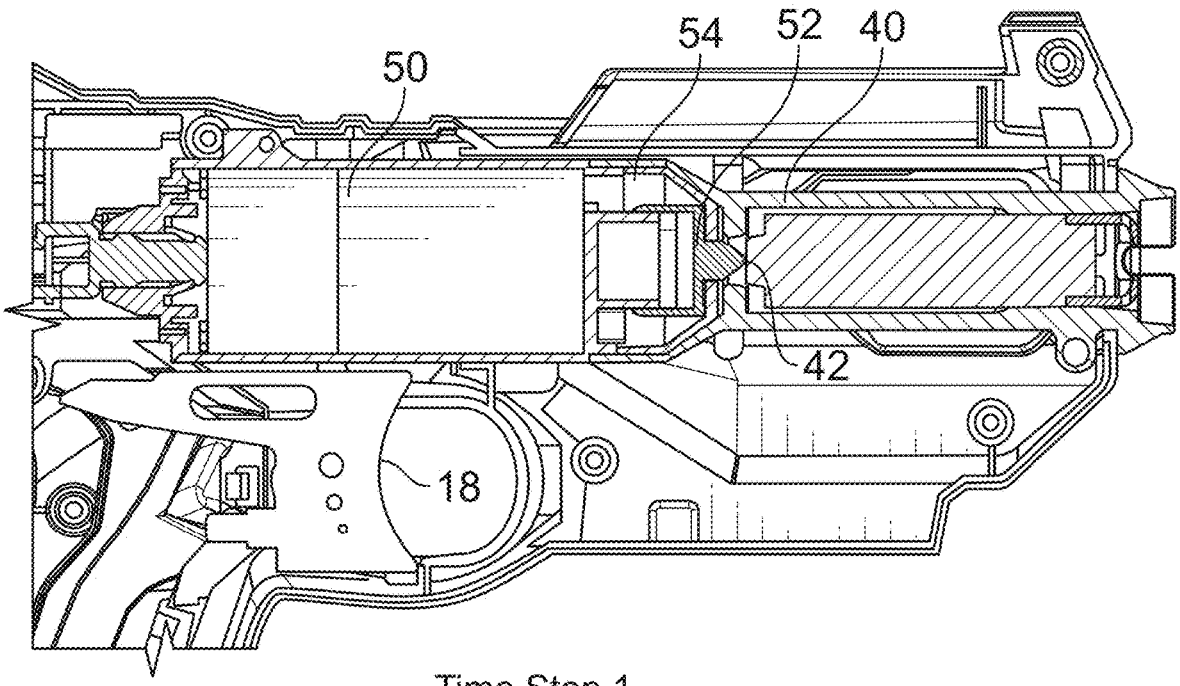

FIGS. 9A and 9B are exposed side elevational and perspective views, partially in section, of an alternate embodiment non-motorized toy projectile apparatus checking for an improvised projectile of the launch apparatus with an pneumatic air piston cylinder shown at rest without an inserted projectile present in FIG. 9B and showing an improvised projectile safety valve seat, FIG. 10 is a side elevation view, partially in section, of the FIG. 9B air piston cylinder launch apparatus shown as about to check and appropriate size projectile present at the projectile receiving opening of the improvised projectile checking housing assembly.

Figure 11:
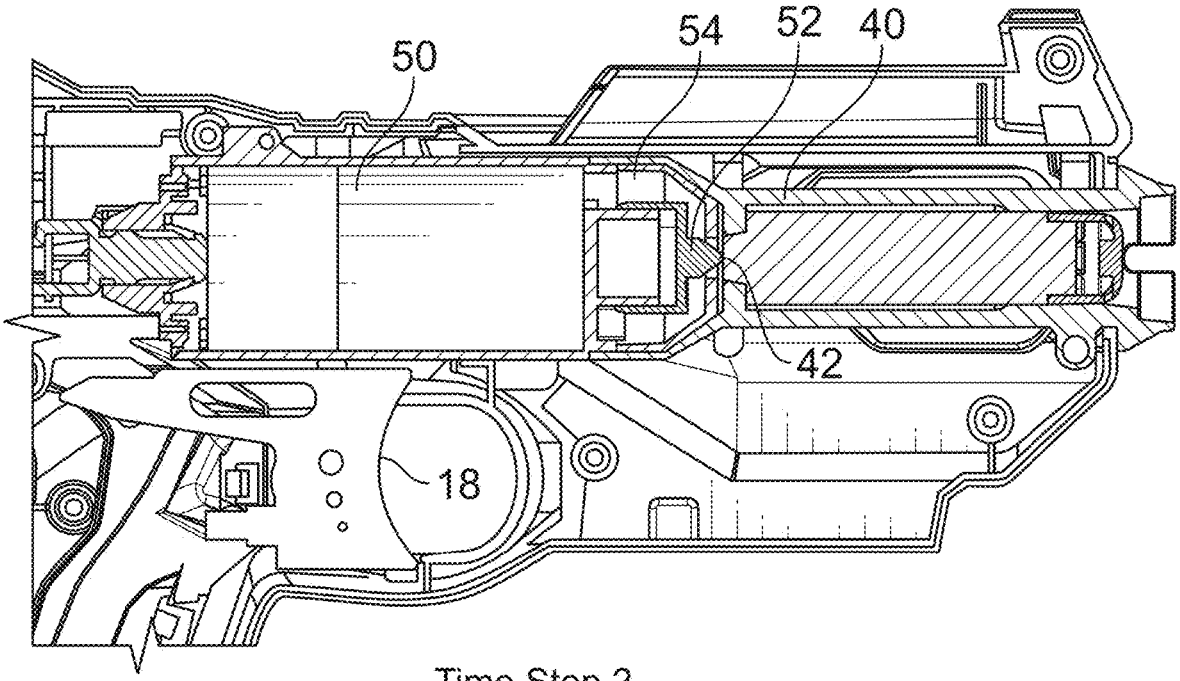

FIG. 11 is a side elevation view, partially in section, thereof where the pneumatic air piston cylinder launch apparatus is shown checking the appropriate size projectile present at the projectile receiving opening of the improvised projectile checking housing assembly.

Figure 12:
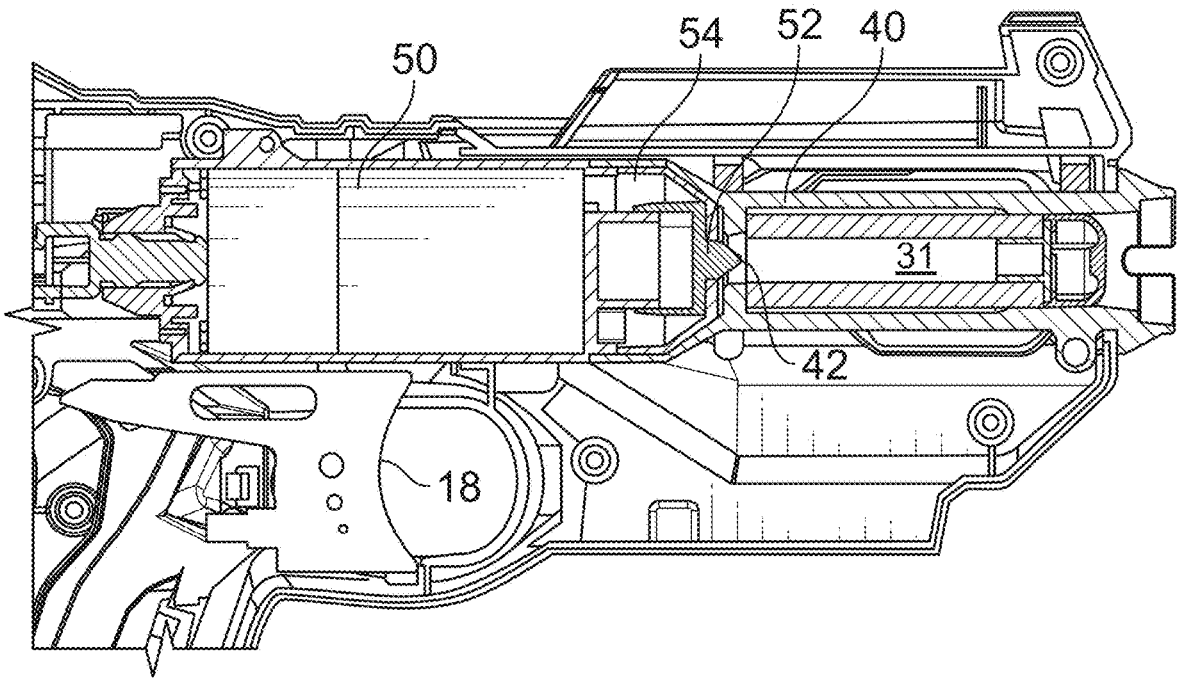

FIG. 12 is a side elevation view, partially in section, thereof where the pneumatic air piston cylinder launch apparatus shown as preventing insertion, loading of inappropriate objects, or a non-authorized tubular projectile with a hollow central core thus further preventing operation of the launch apparatus based on the checked opening of the improvised projectile checking housing assembly.

Figure 13:
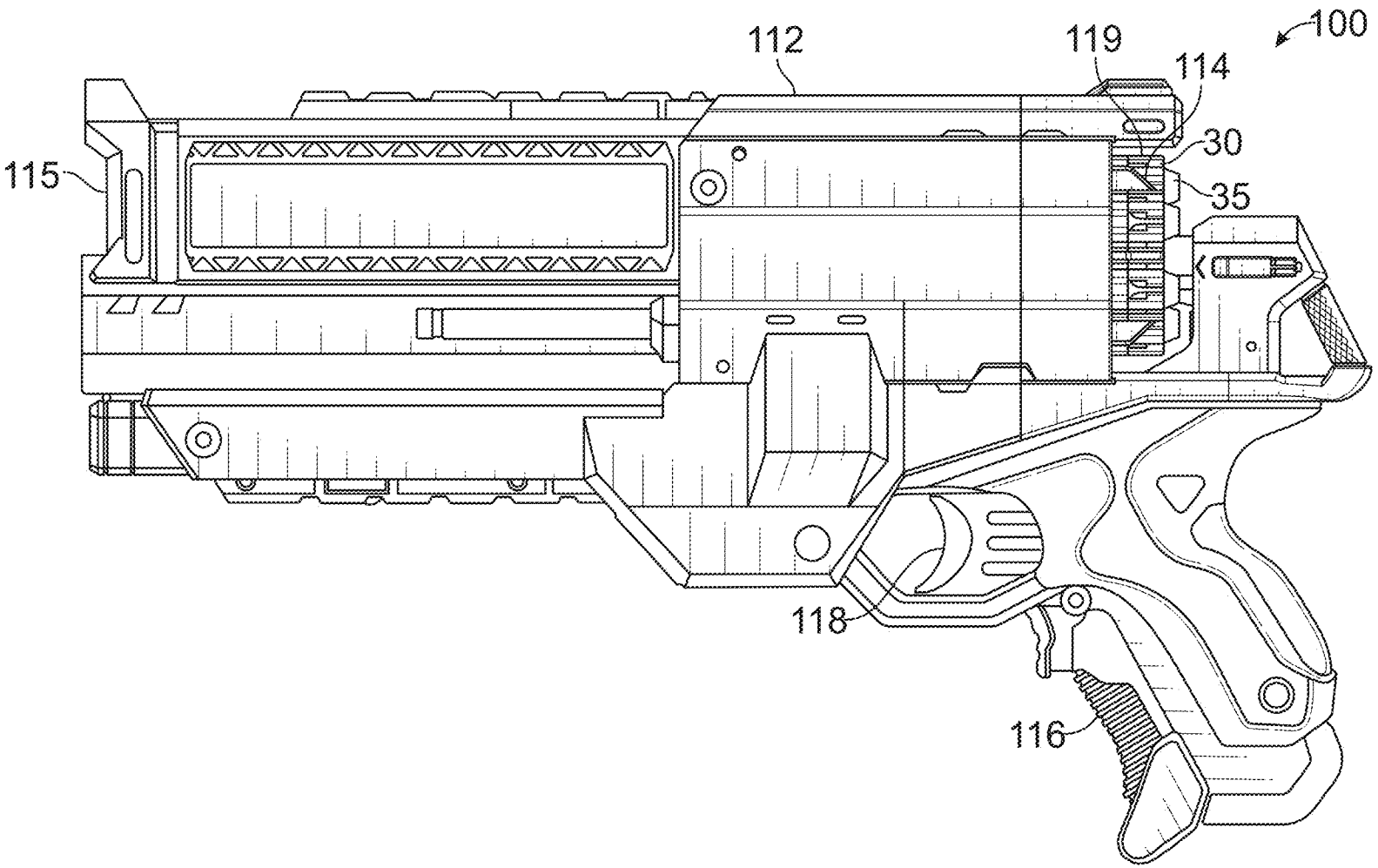
Figure 14:
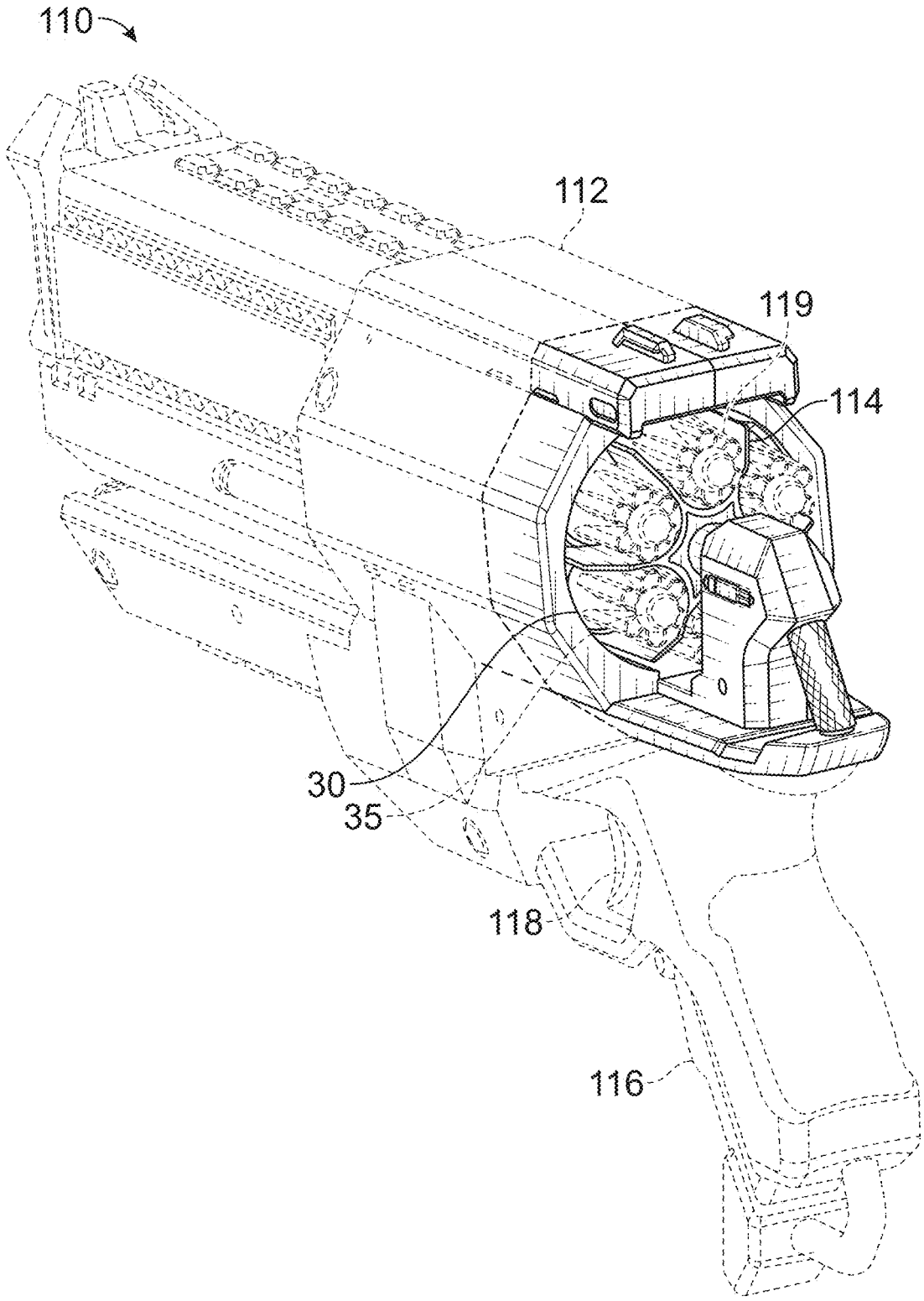

FIG. 13 is a perspective view of a toy launch apparatus rearward darts, and FIG. 14 shows a side elevational view of the launch apparatus showing launch apparatus rearward pusher engagement embodiment of the invention is shown in launch apparatus.

Figure 15:
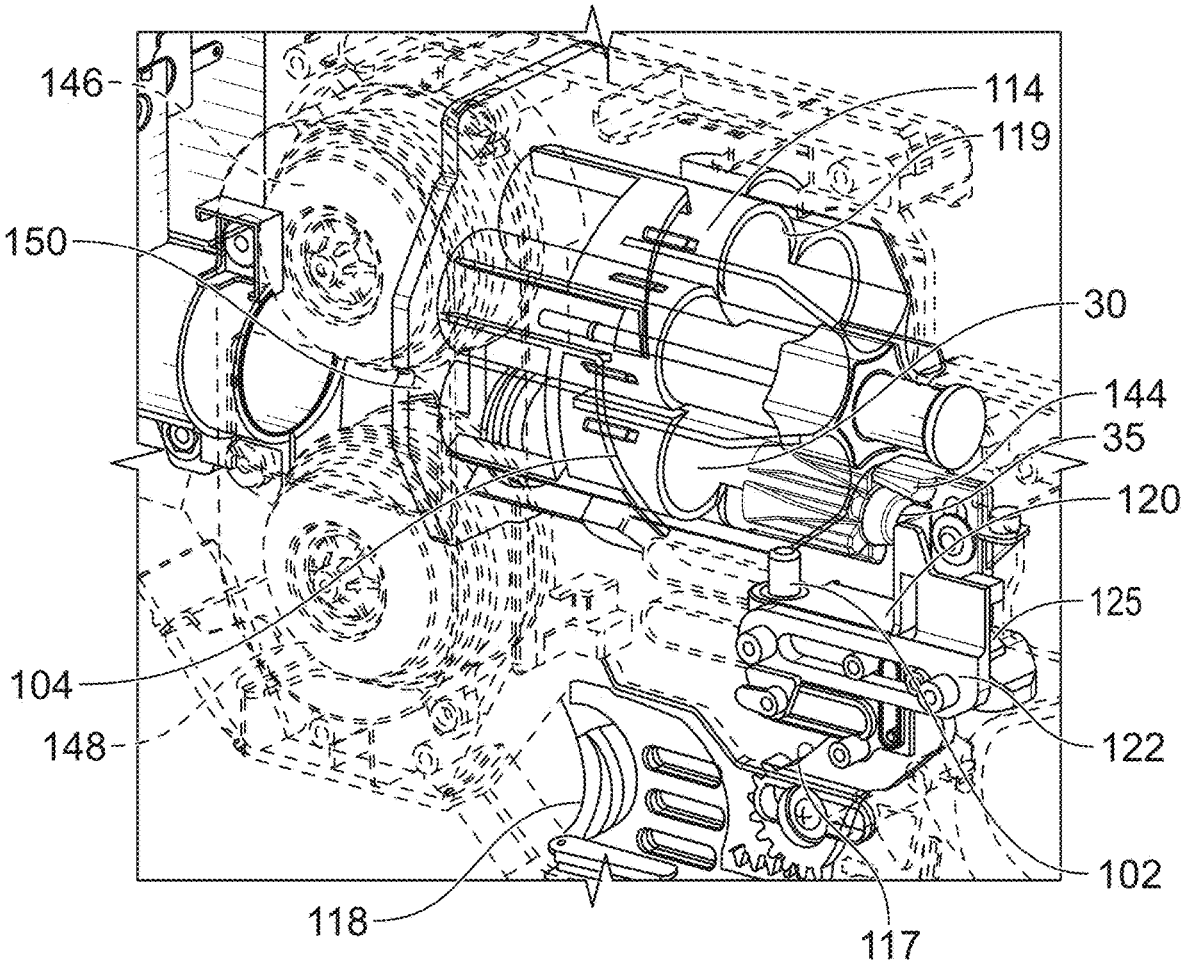
Figure 16:
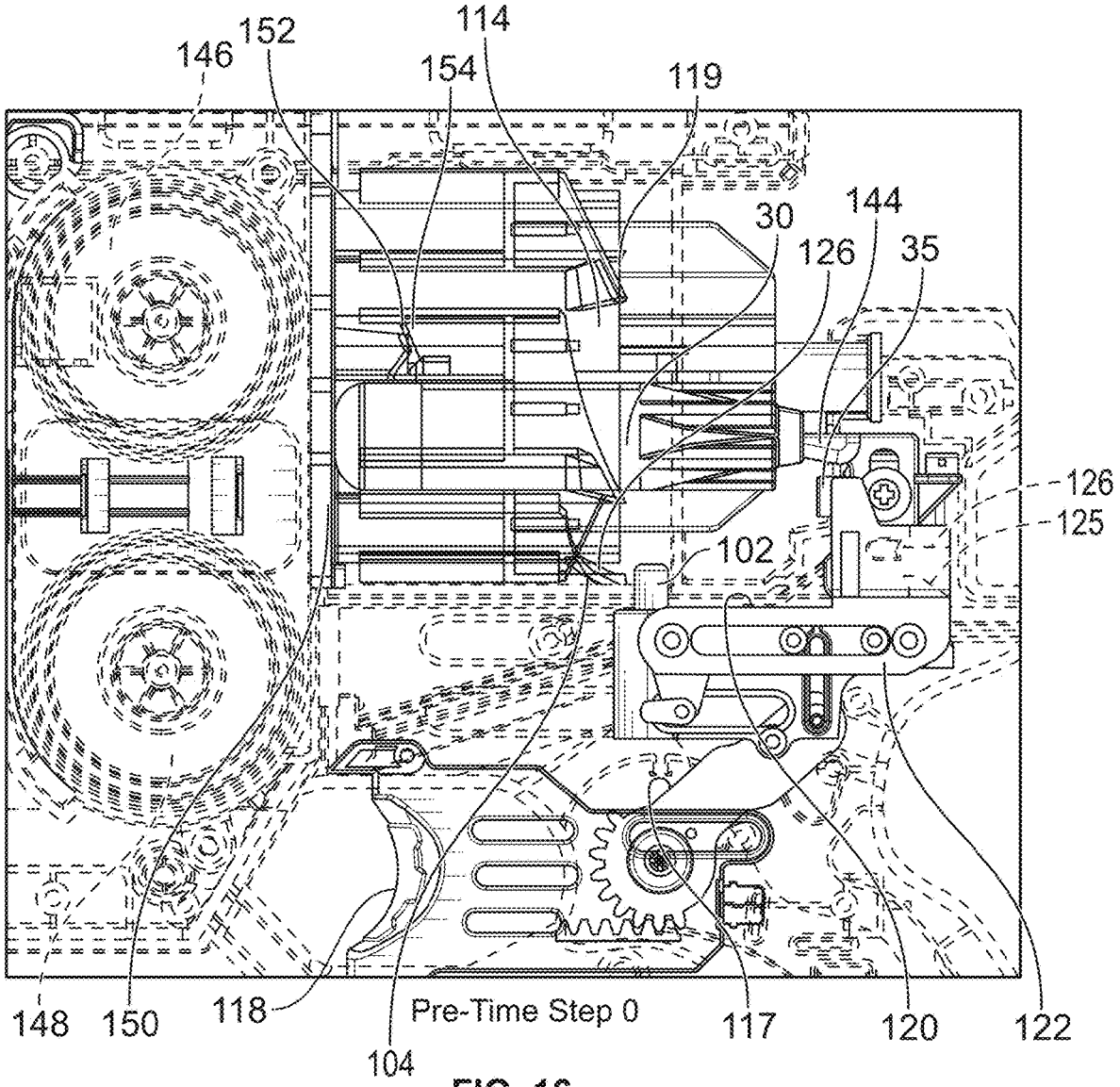

FIGS. 15 and 16 are exposed side perspective and side elevational views of the toy projectile apparatus with multiple improvised projectile features to be checked for the launch apparatus with single projectile loaded into rotating barrel dart chamber.

Figure 17A:
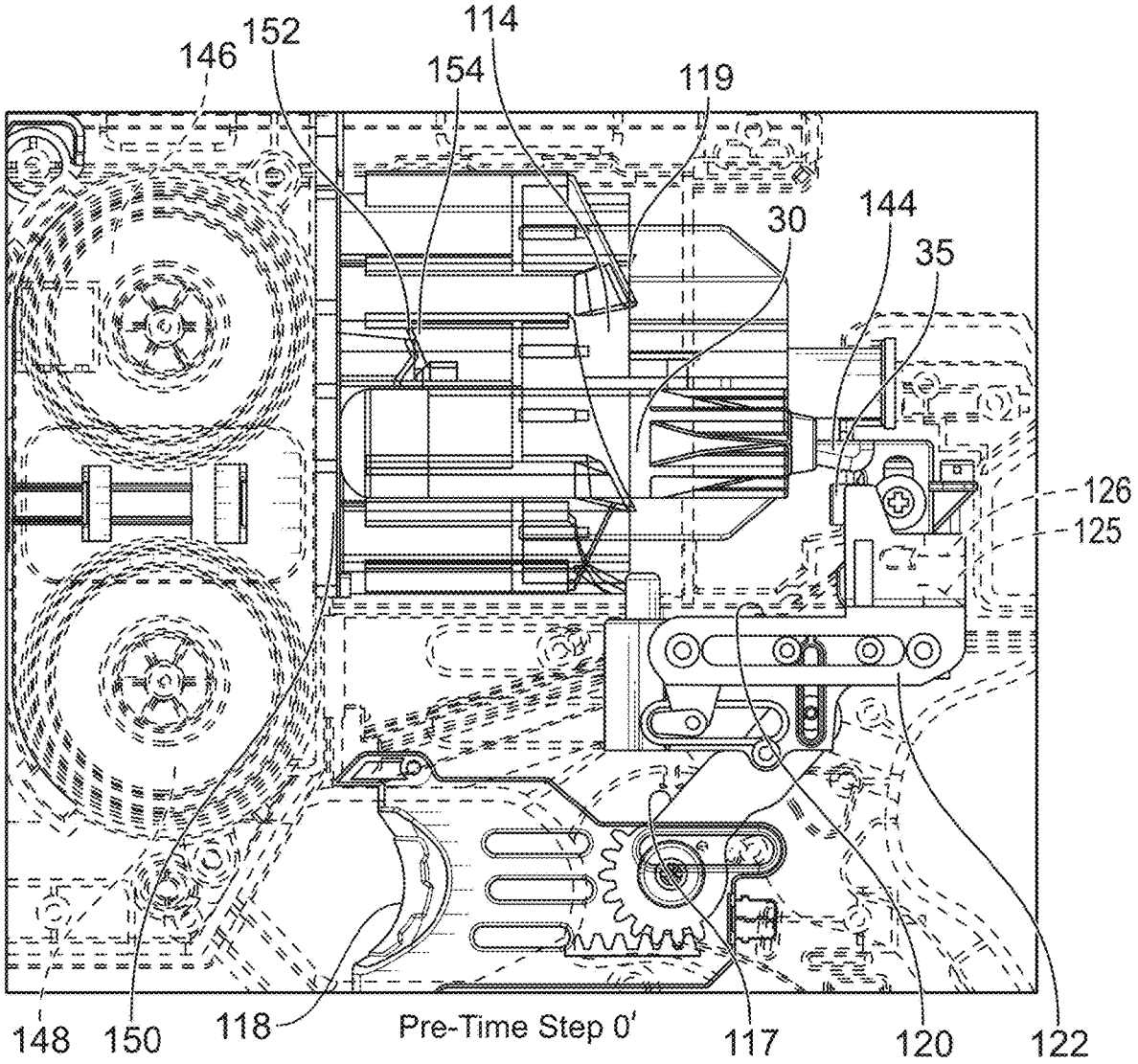
Figure 17B:
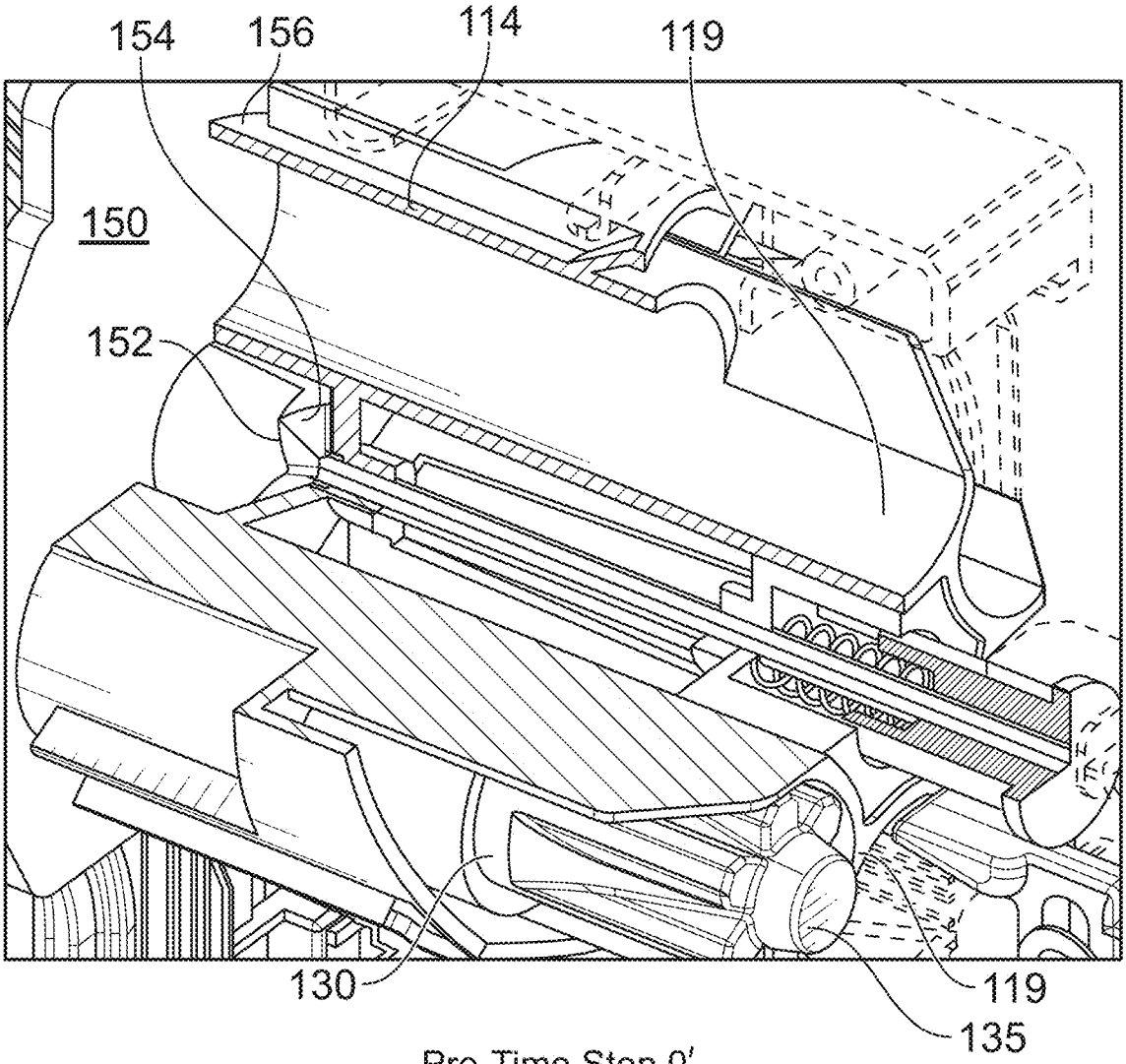

FIGS. 17A and 17B illustrate where the apparatus has slight pressure on the trigger and a projectile in the next chamber to be fired, for realigning the dart tip with respect to the dart backstop as the drum structure translates while initiating advancing of the drum.

Figure 18A:
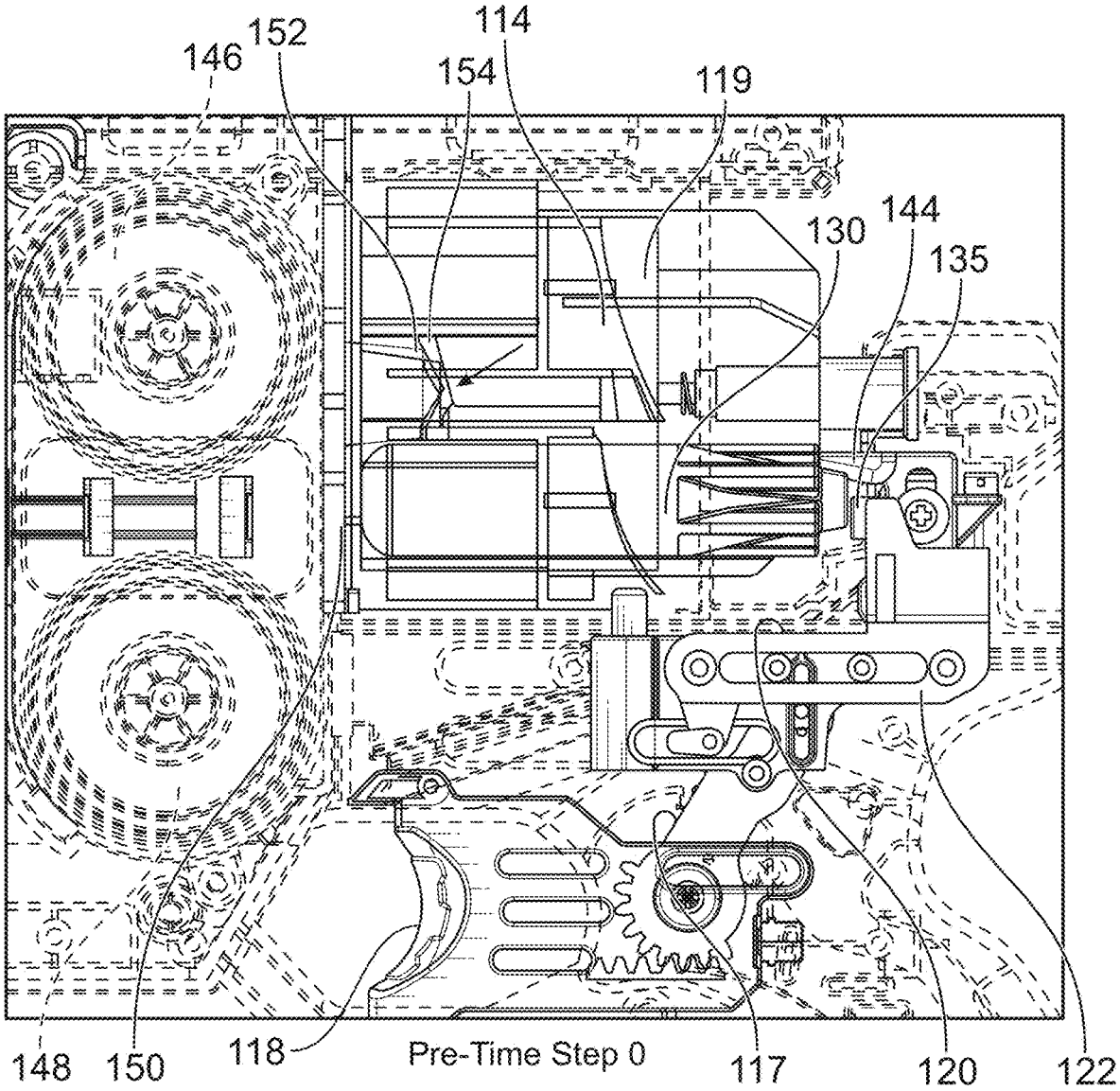
Figure 18B:
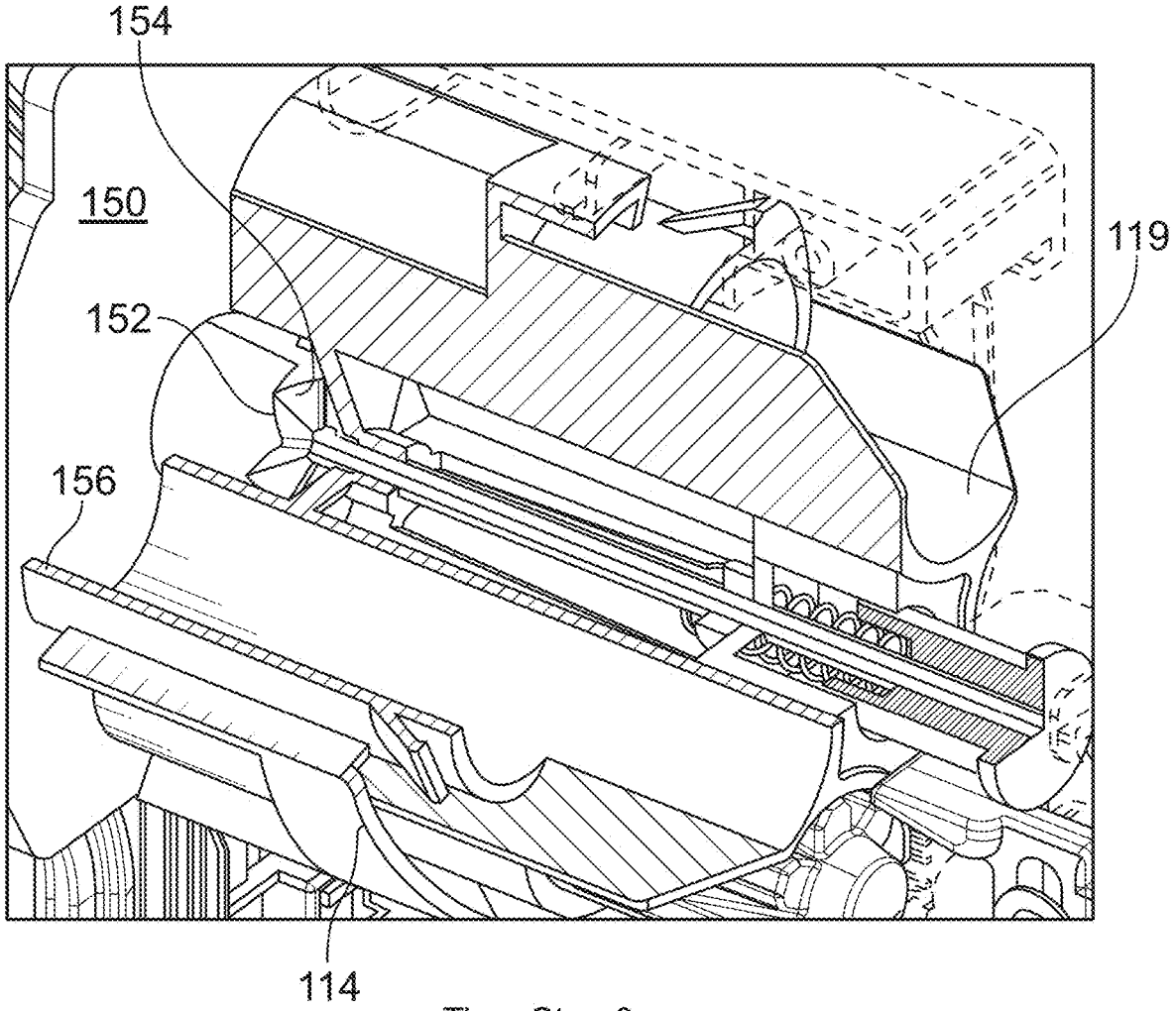

FIGS. 18A and 18B illustrate initiation of a dart depth check for the next chamber to be fired with the projectile portion in the correct location for sensing.

Figure 19A:
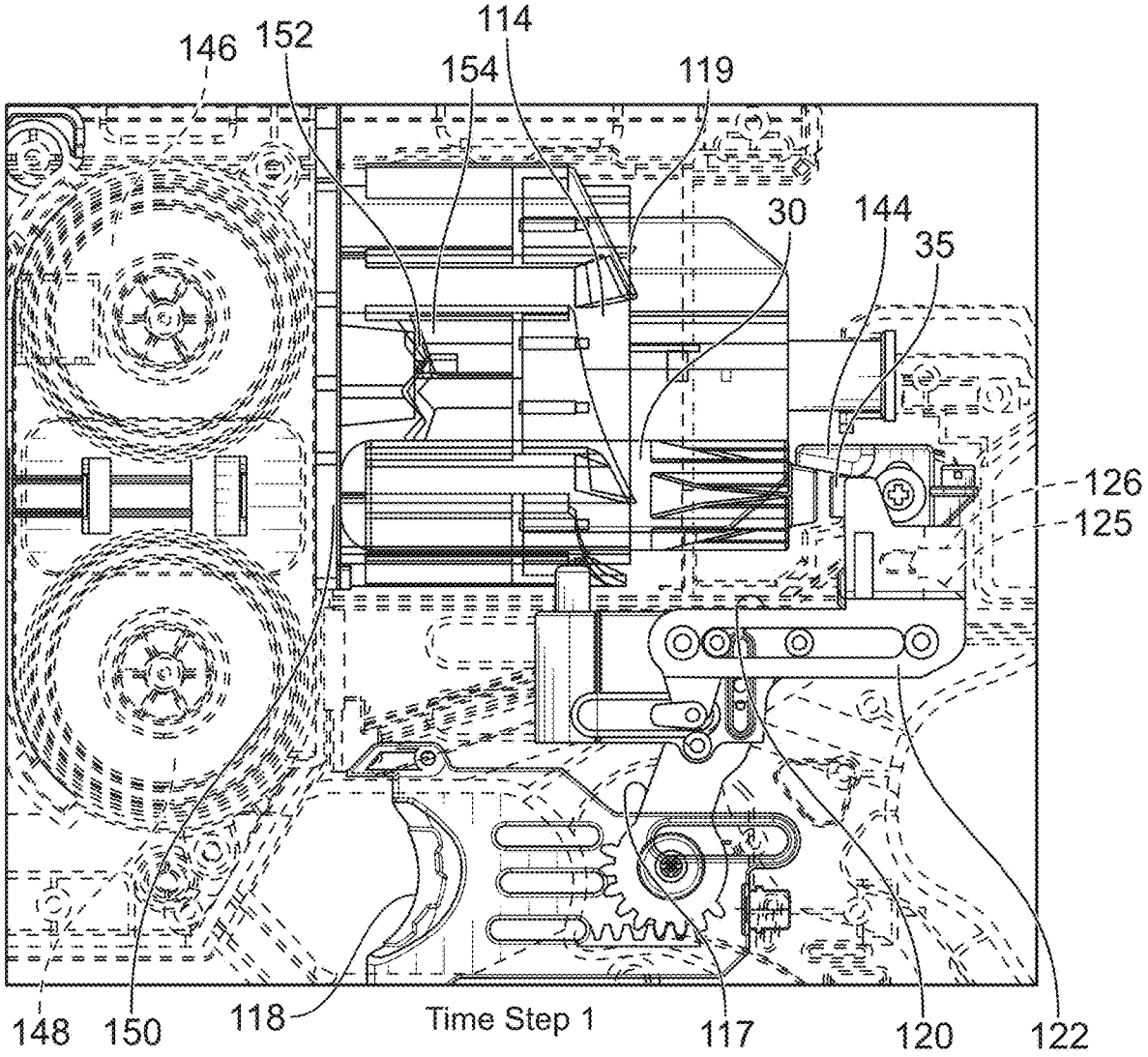
Figure 19B:
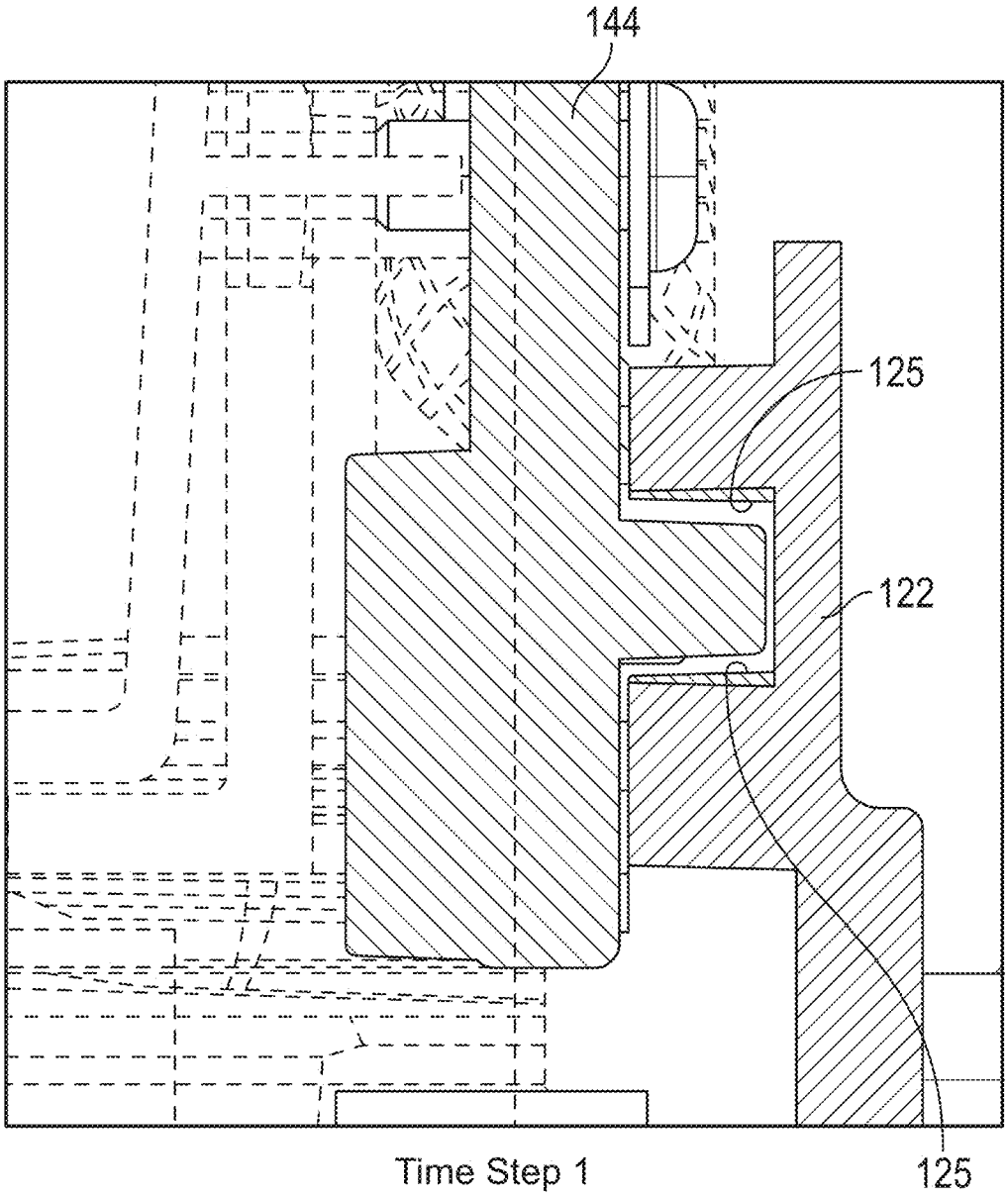
Figure 19C:
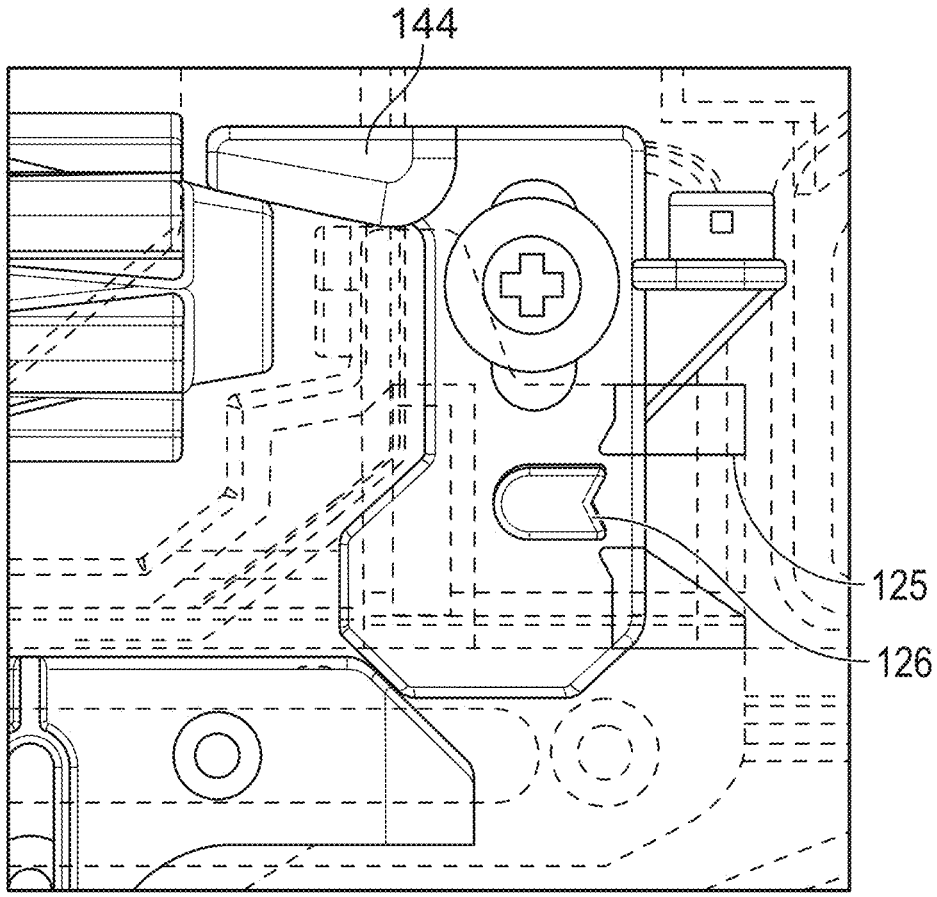

FIGS. 19A, 19B and 19C illustrate where the apparatus is about to check projectiles with slight pressure on the trigger to remove slack and have IP lock gauge in contact with the projectile portion touching the outer diameter (OD) on the back thereof.

Figure 20A:
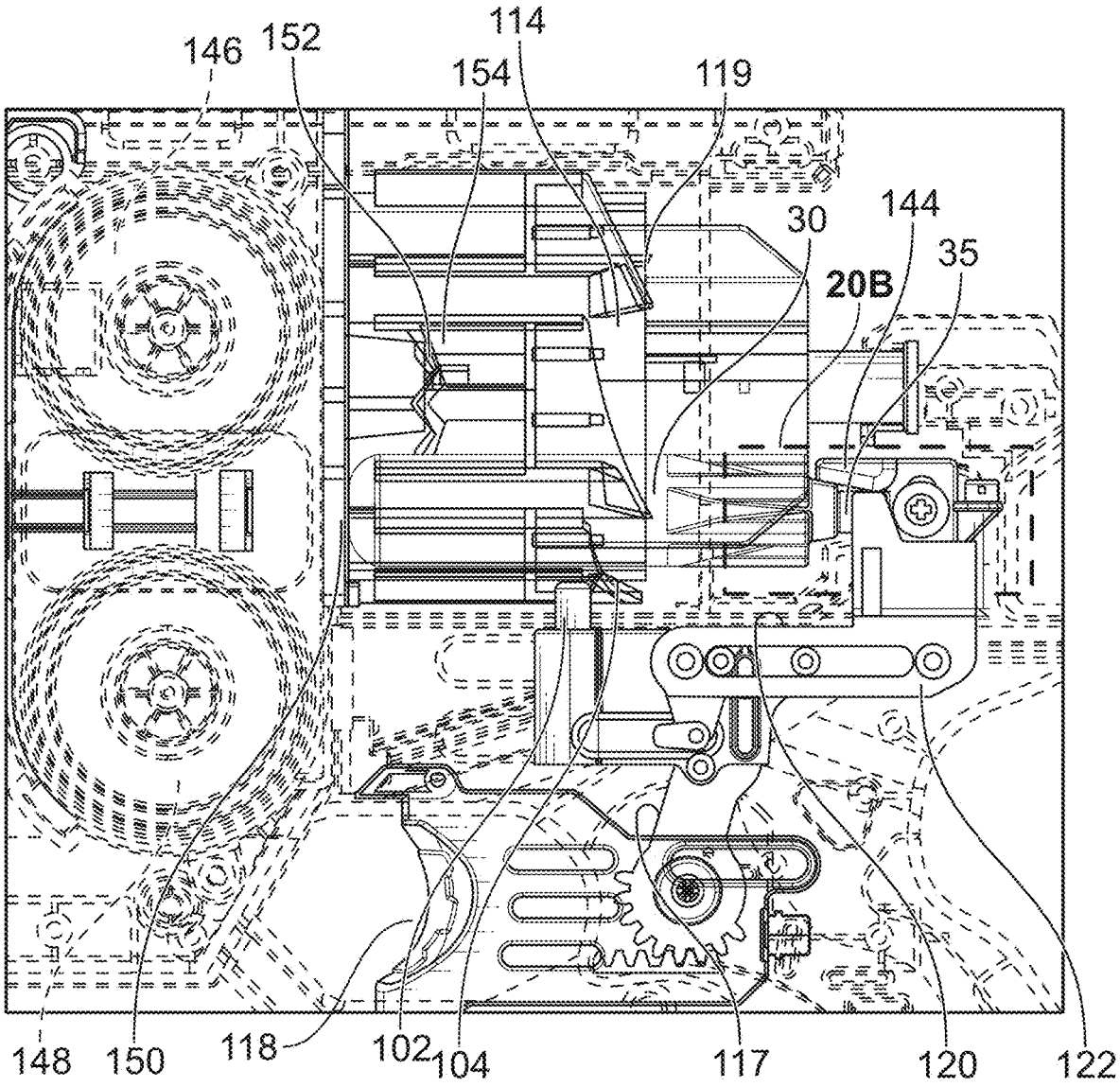
Figure 20B:
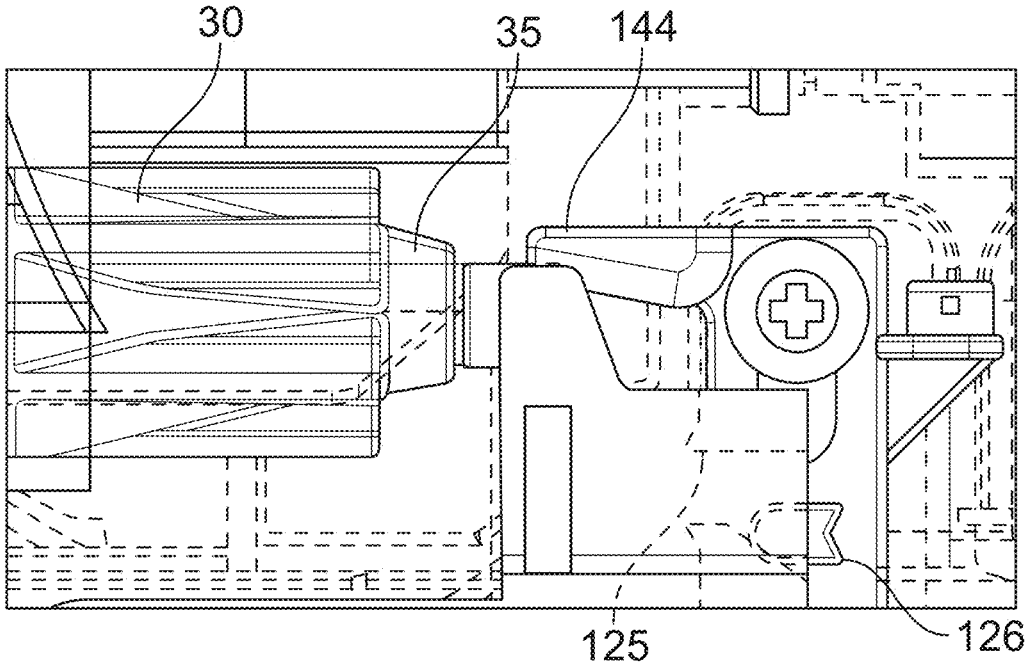

FIGS. 20A and 20B illustrate the apparatus engaged, checked and pushing with slight pressure on the projectile.

Figure 21:
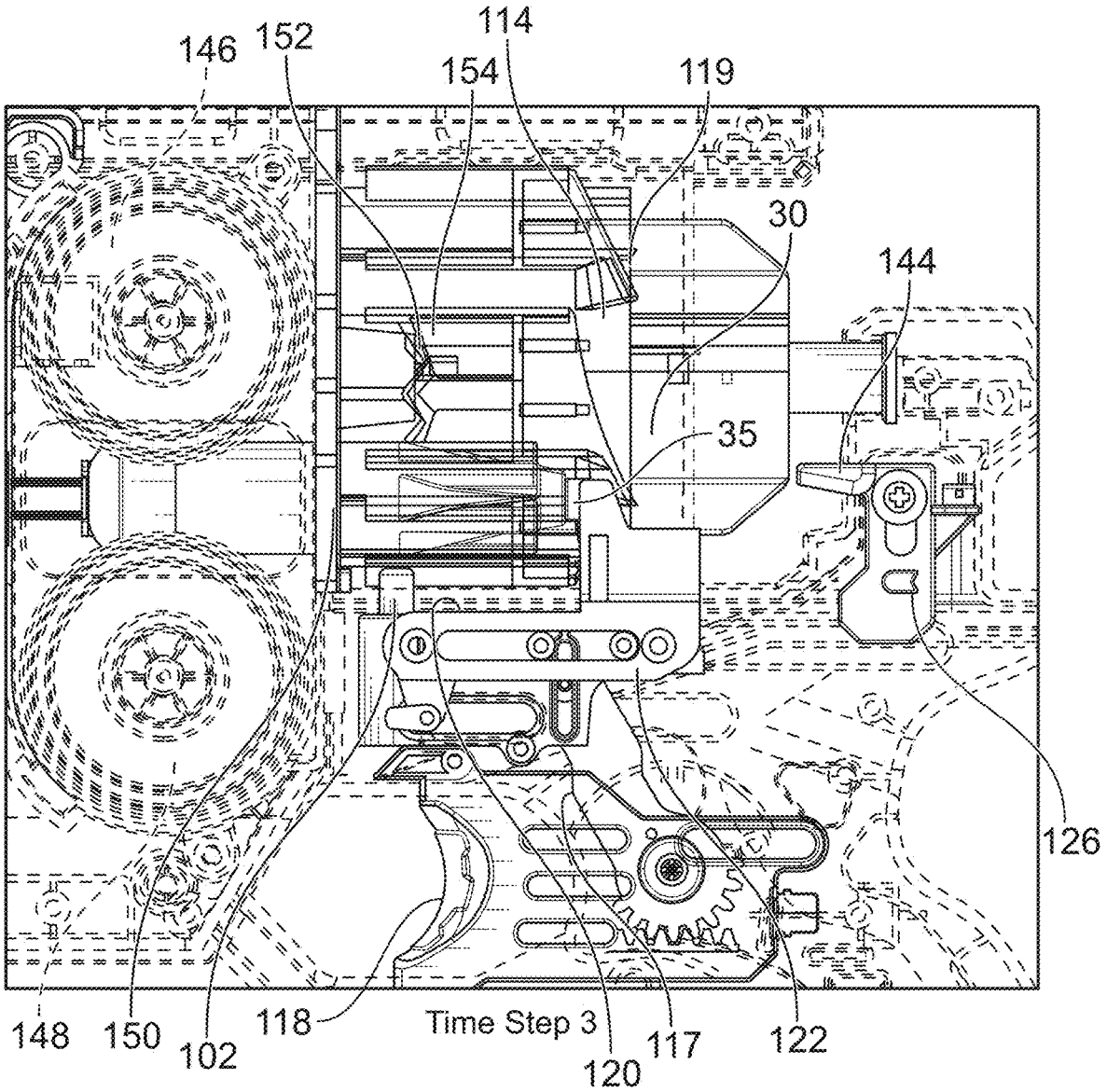

FIG. 21 illustrates the apparatus advancing the projectile into flywheels with full pressure on the trigger to advance the projectile.

Figure 22A:
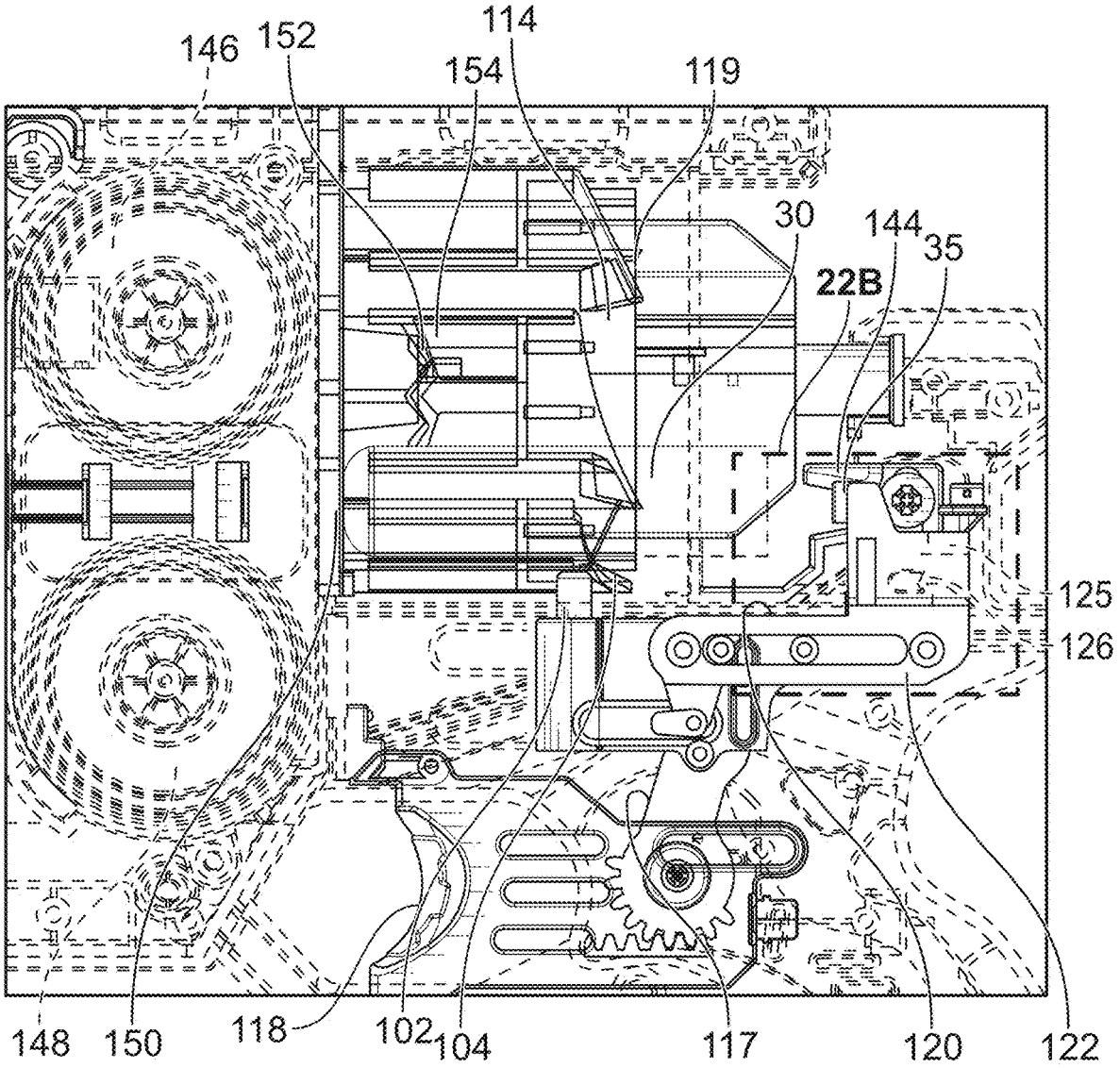
Figure 22B:
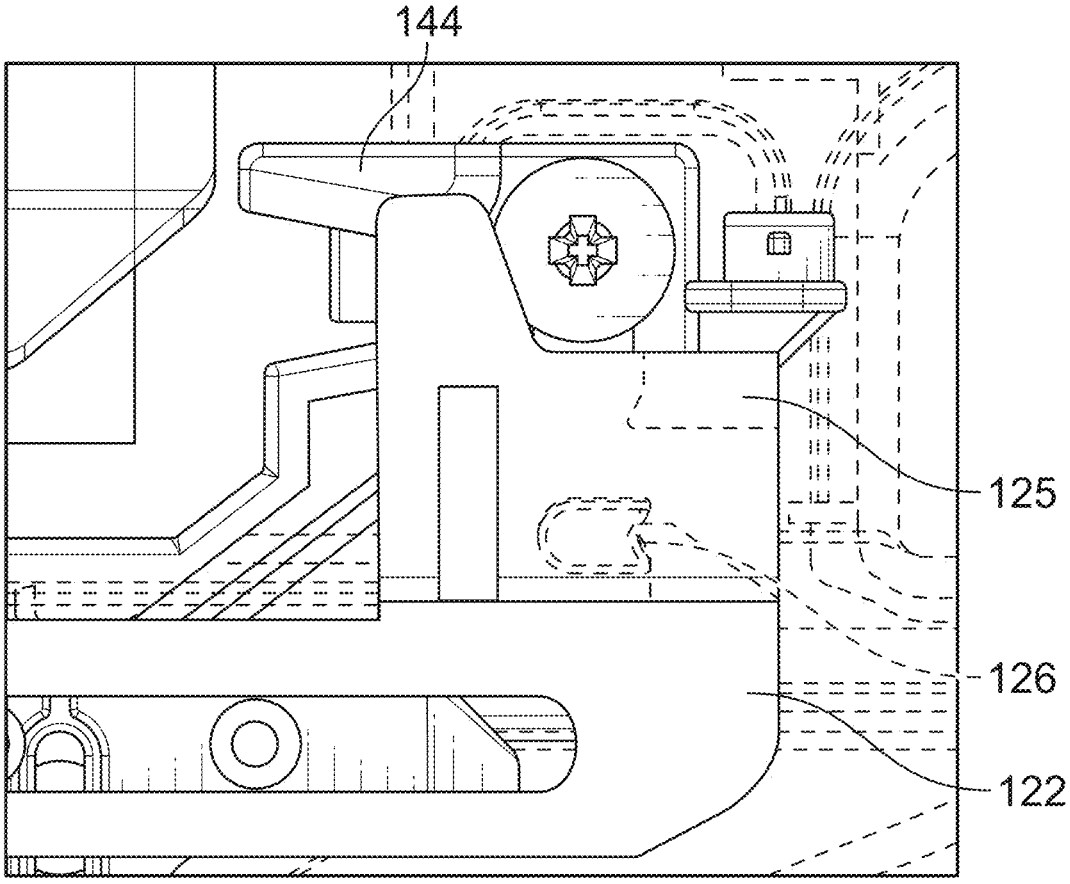

FIGS. 22A and 22B illustrate where the apparatus following its IP lock gauge being improperly translated in the absence of a verified projectile catching and locking the pathway so as to prevent advancing of the projectile.

Figure 23:
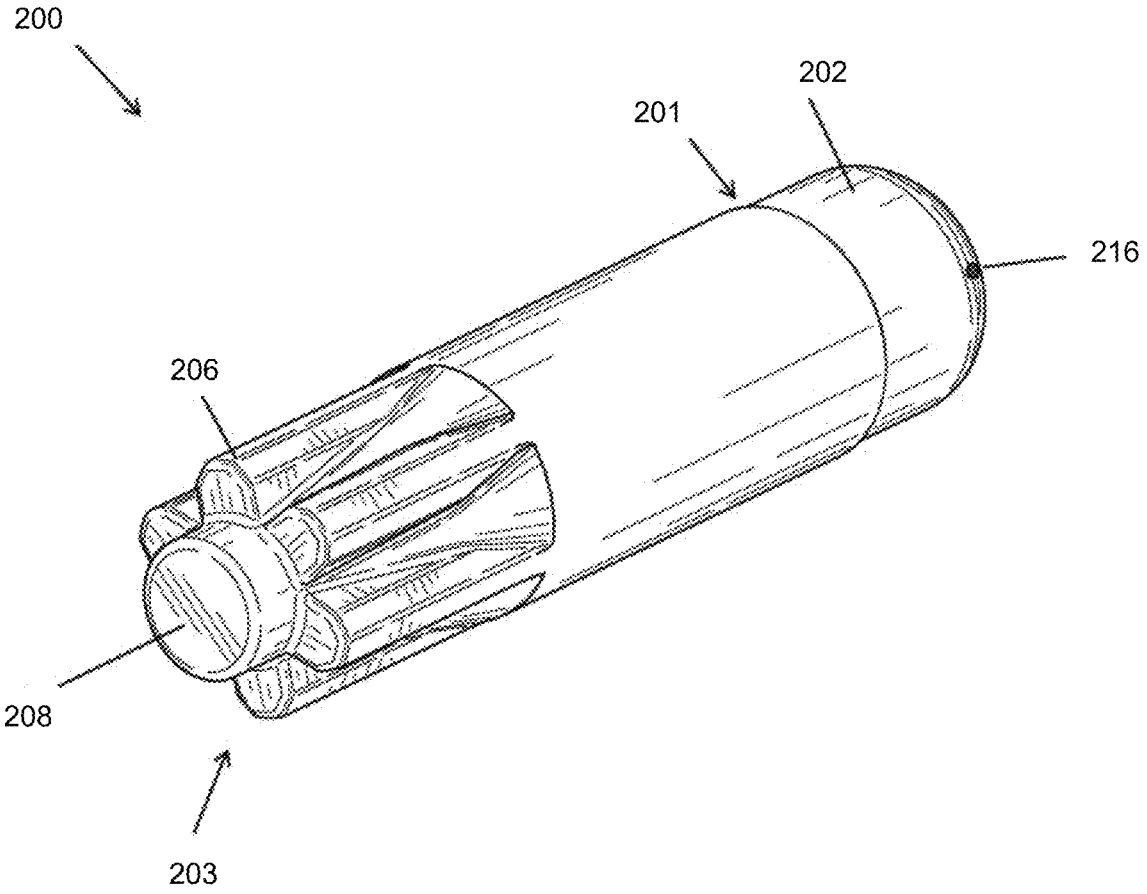
Figure 24A:
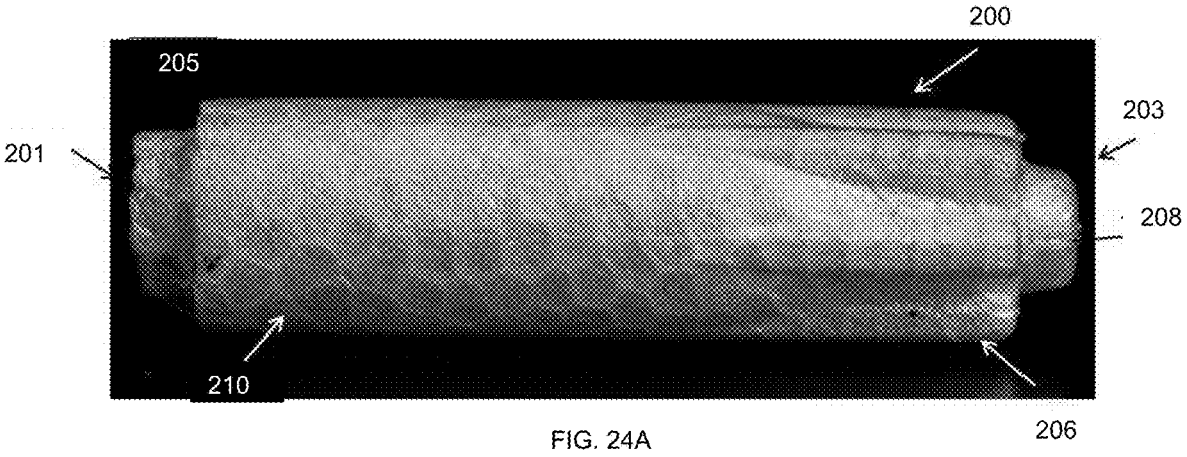
Figure 24B:
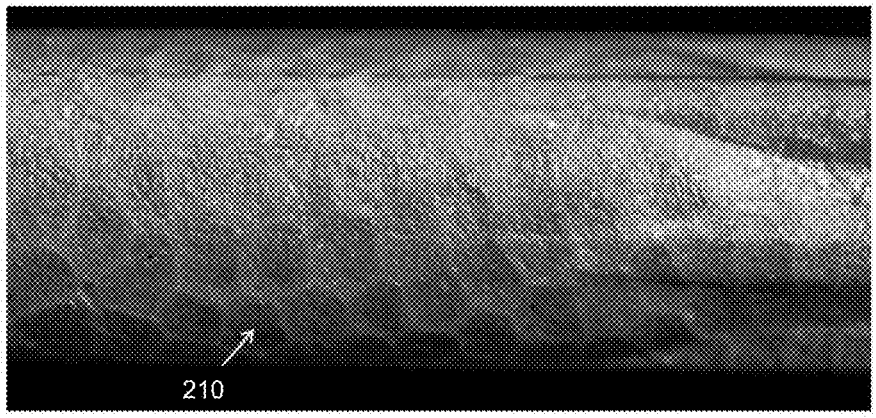
Figure 24C:
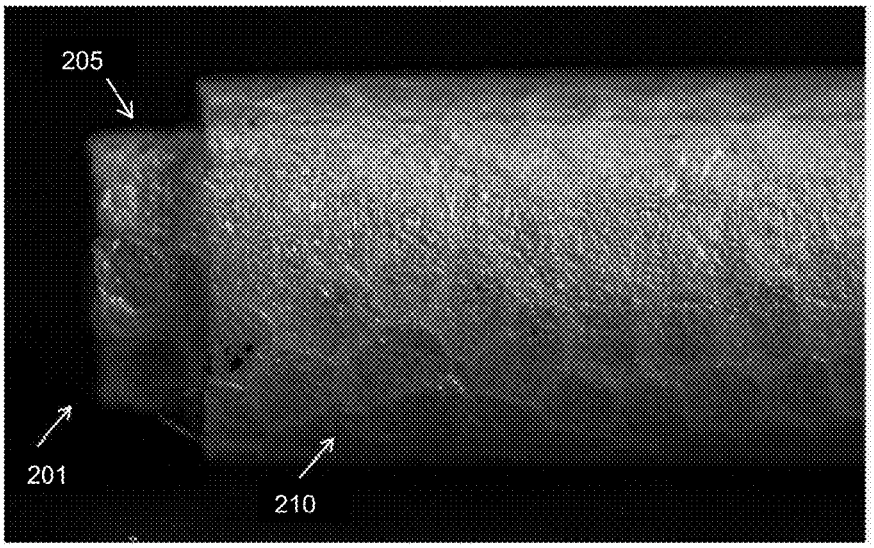
Figure 24D:
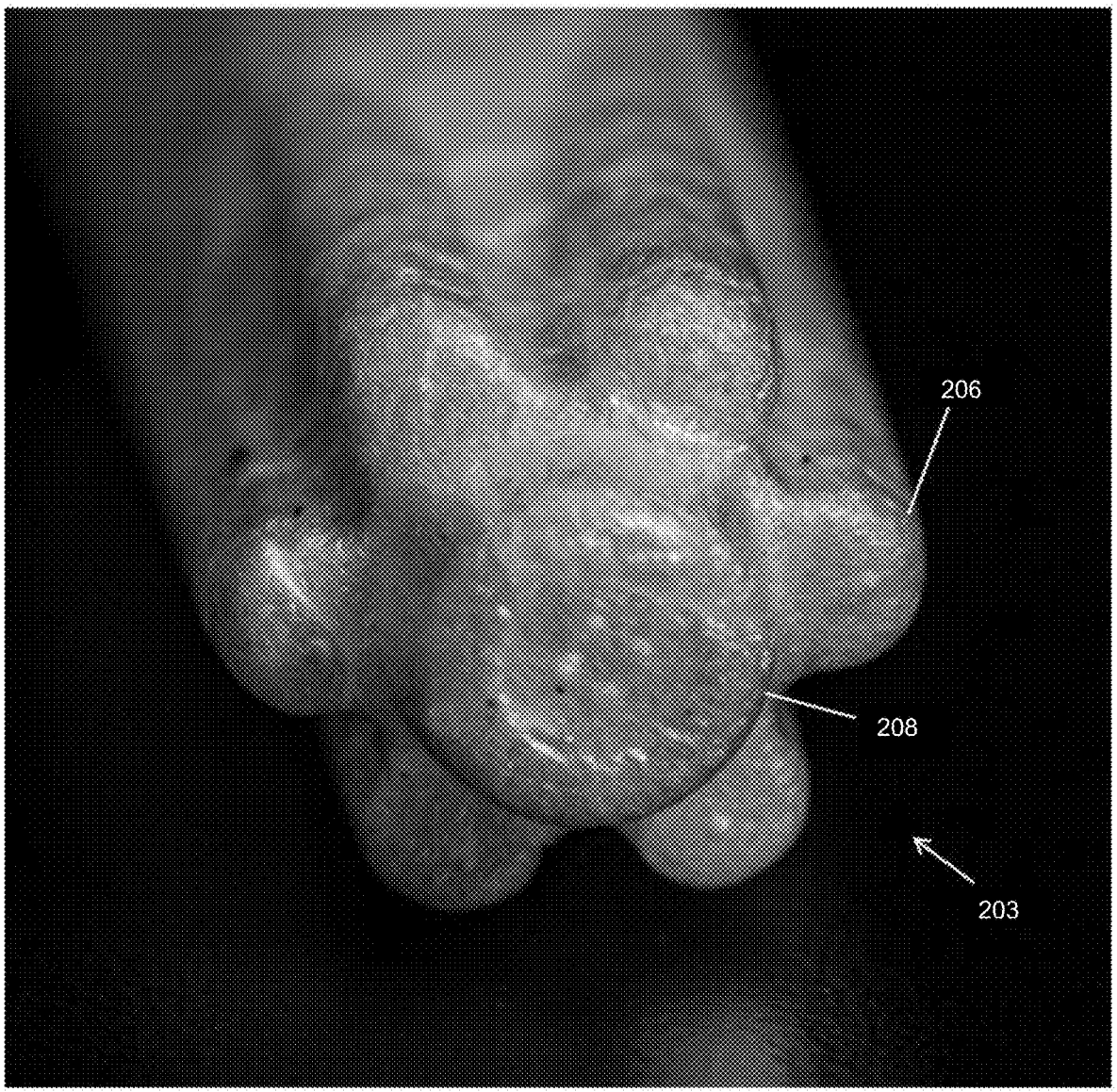
Figure 25:
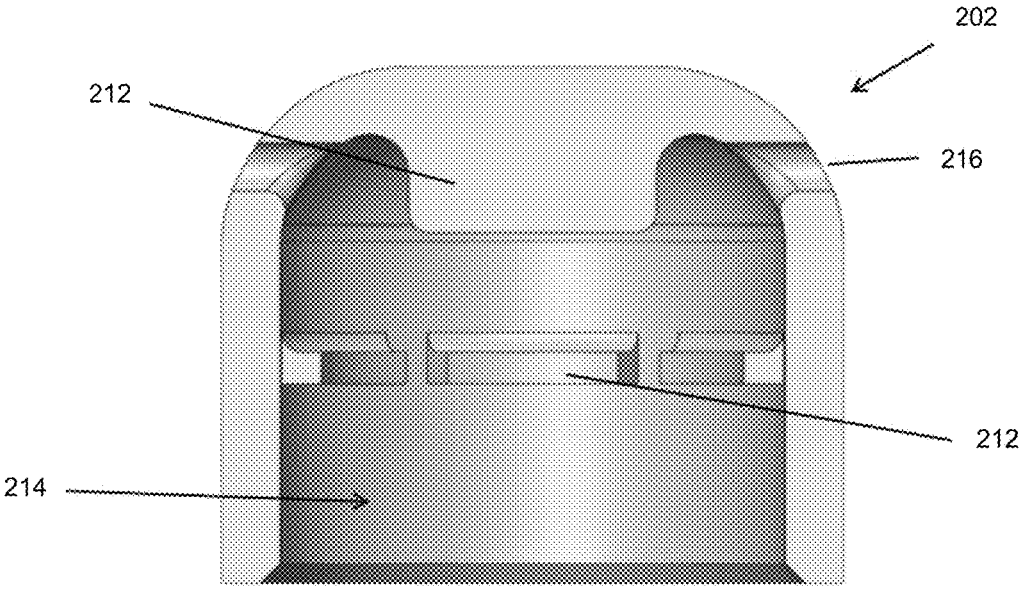
Figure 26:
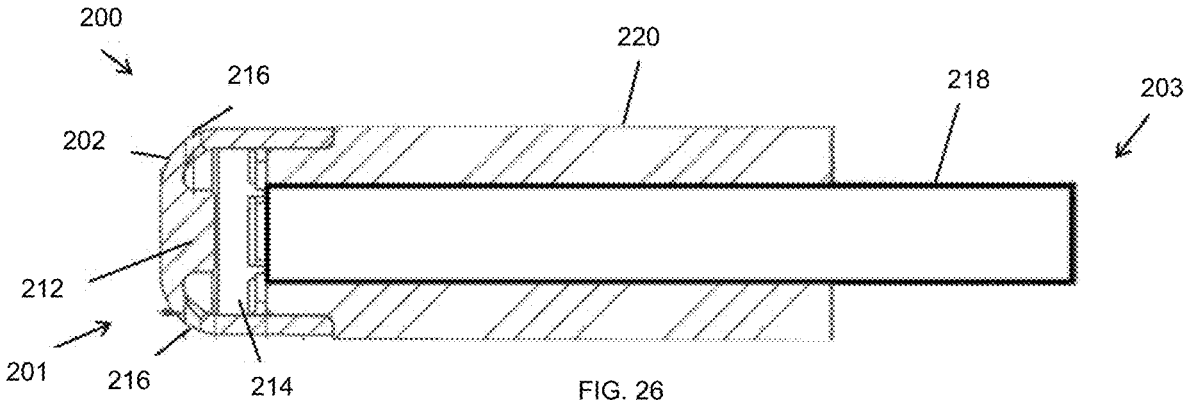
Figure 27:
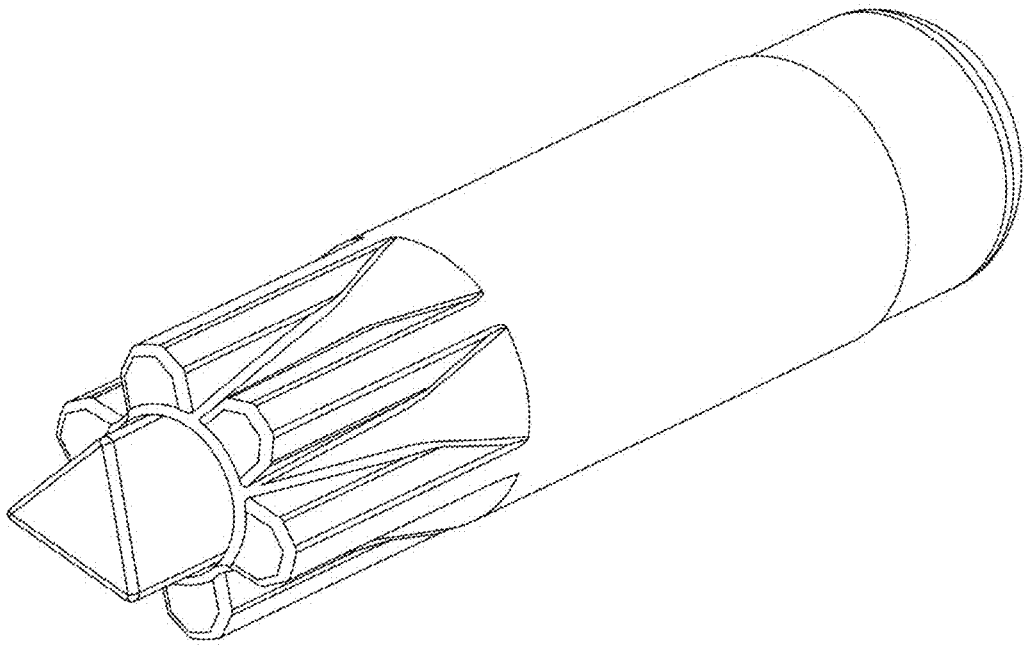
Figure 28:
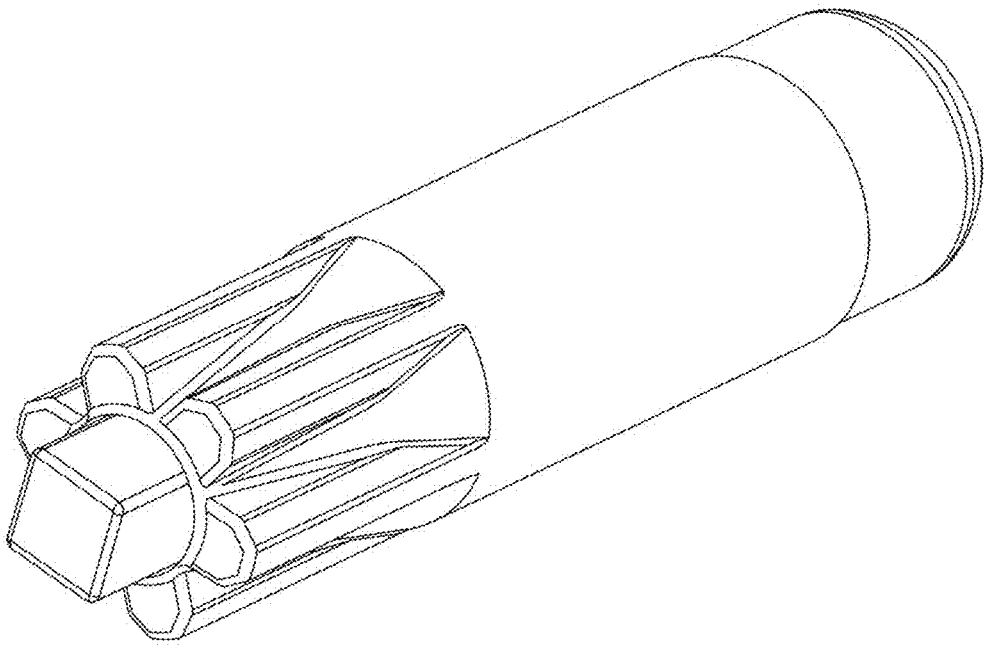
Figure 29:
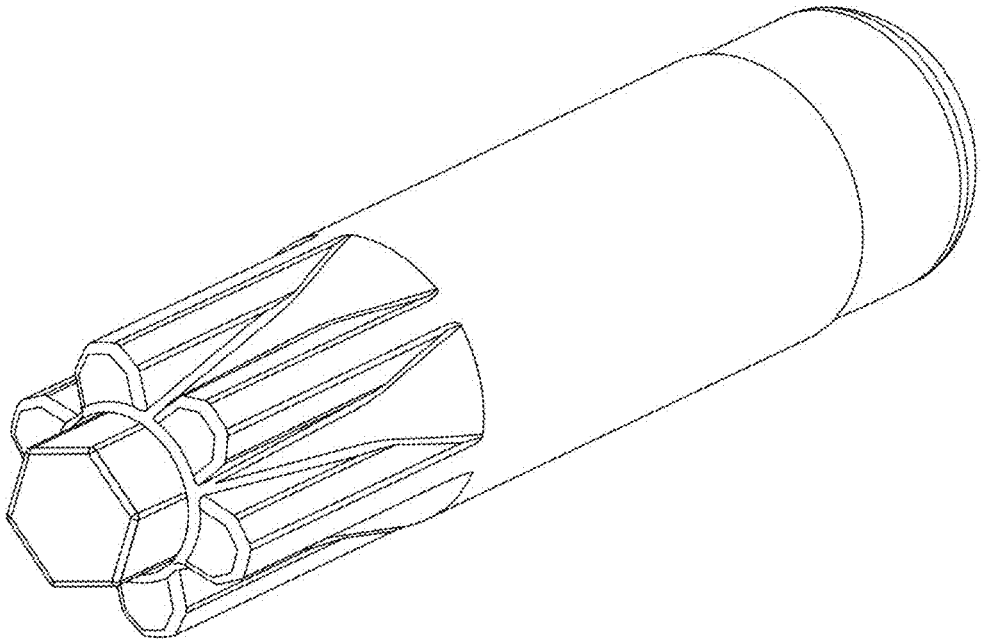
Figure 30:
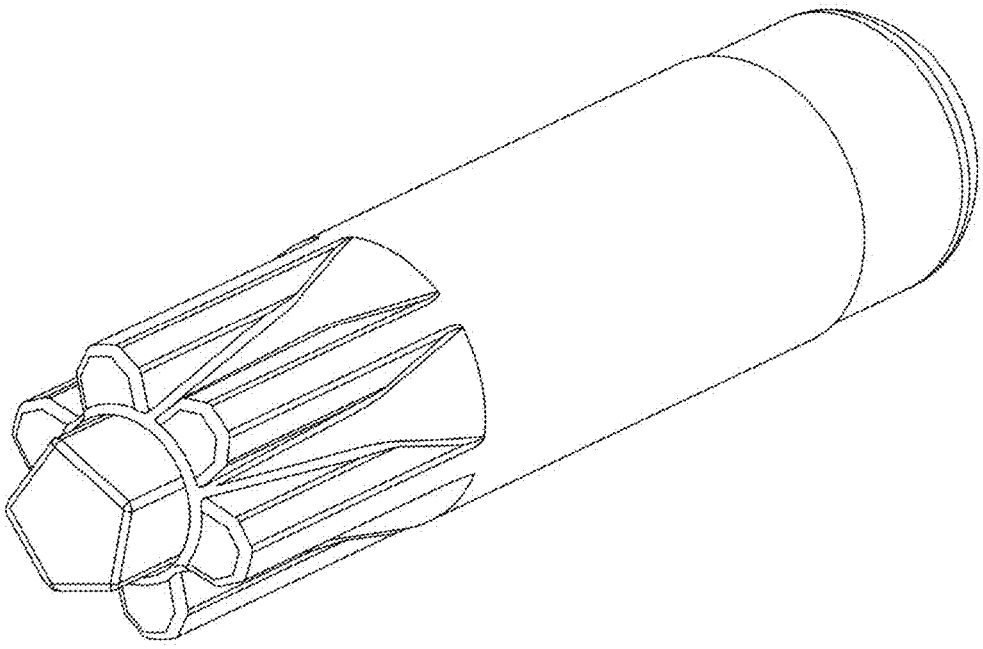
Figure 31:
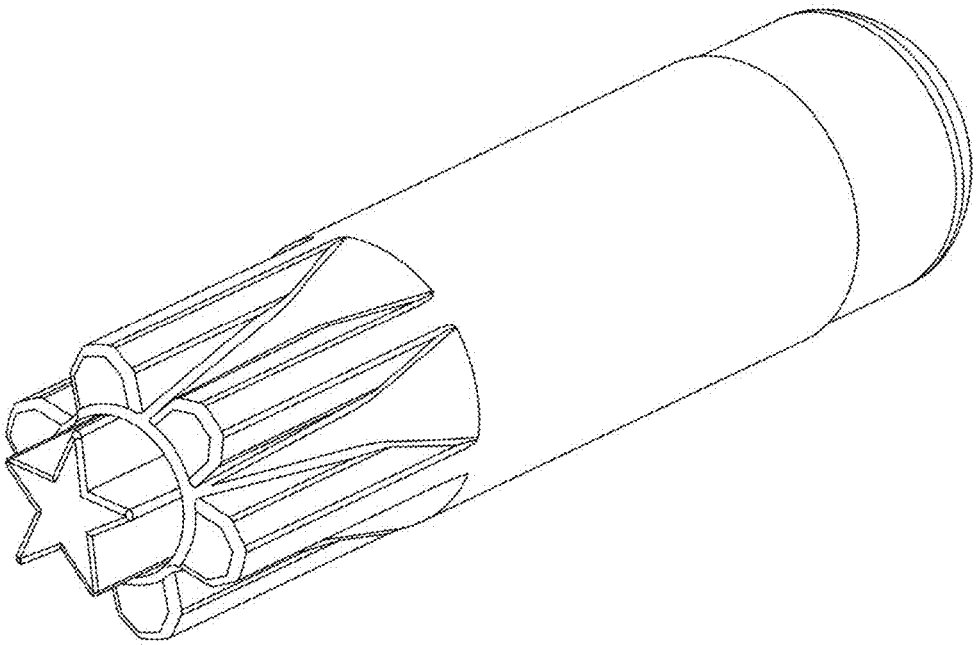
Figure 32A:
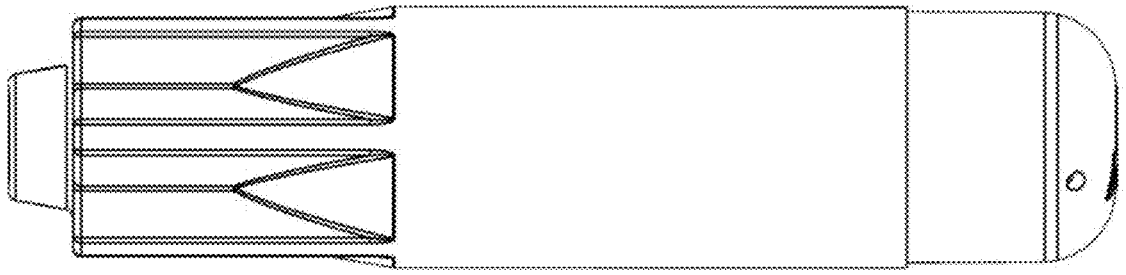
Figure 32B:
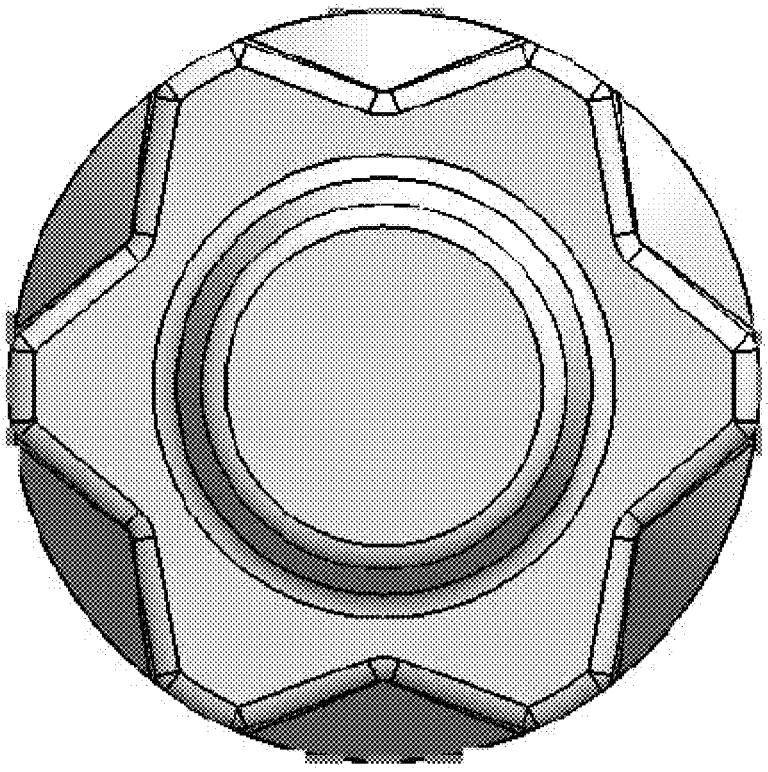
Figure 32C:
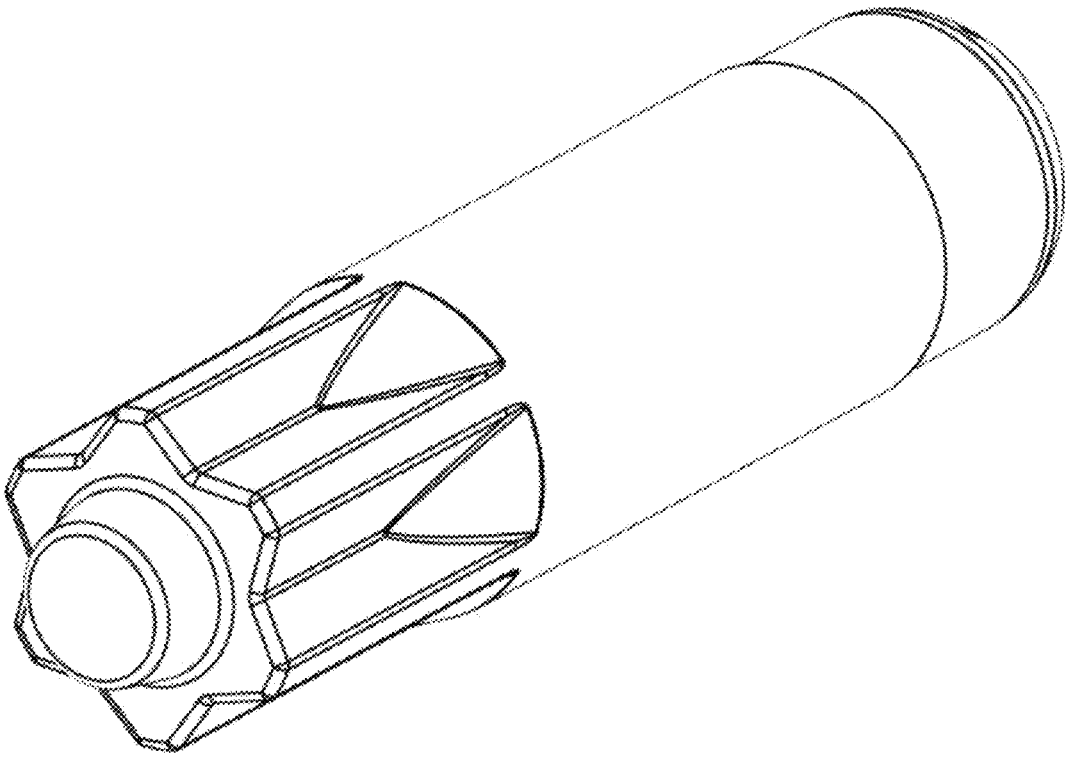
Figure 33A:
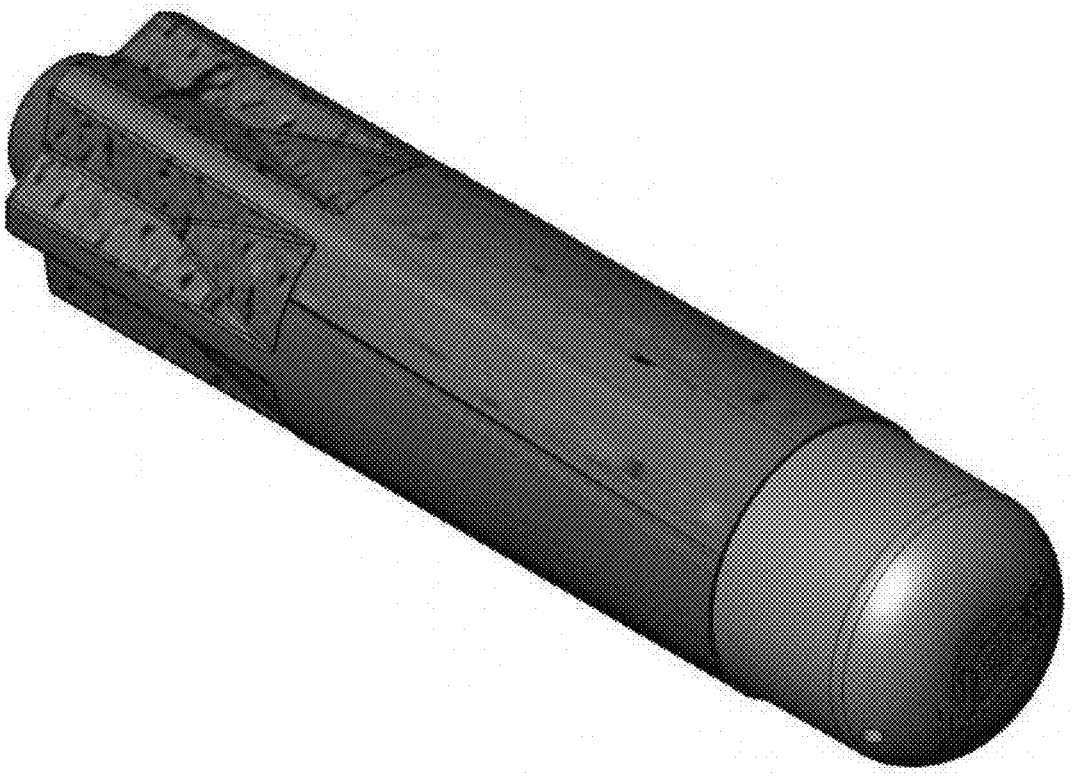
Figure 33B:
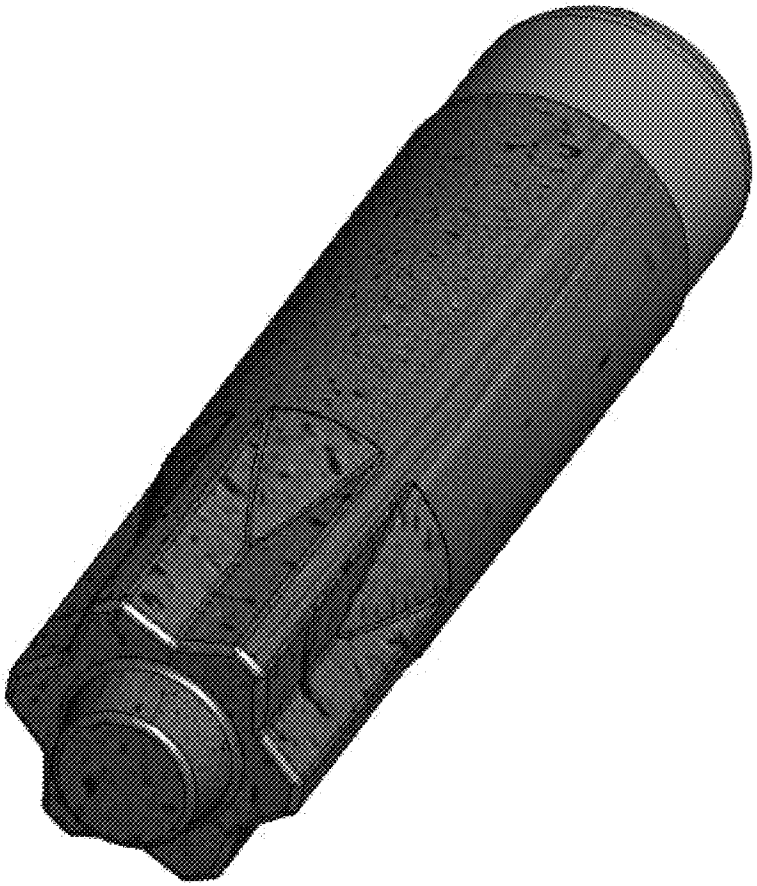

FIG. 23 is a perspective view of a schematic illustration of a toy projectile in accordance with embodiments of the disclosure;

FIGS. 24A to 24D are photographs of a body of a toy projectile in accordance with embodiments of the disclosure showing a closed cell structure of the body made from an expanded beaded material;

FIG. 25 is a cross-sectional view of a tip of a toy projectile in accordance with embodiments of the disclosure;

FIG. 26 is a cross-sectional view of a toy projectile having an inserted solid core in accordance with embodiments of the disclosure;

FIG. 27 is a perspective view of a schematic illustration of a toy projectile in accordance with embodiments of the disclosure, showing a triangular nub;

FIG. 28 is a perspective view of a schematic illustration of a toy projectile in accordance with embodiments of the disclosure, showing a rectangular nub;

FIG. 29 is a perspective view of a schematic illustration of a toy projectile in accordance with embodiments of the disclosure, showing a hexagonal nub;

FIG. 30 is a perspective view of a schematic illustration of a toy projectile in accordance with embodiments of the disclosure, showing a pentagonal nub;

FIG. 31 is a perspective view of a schematic illustration of a toy projectile in accordance with embodiments of the disclosure, showing a star-shaped nub; and FIG. 32A is a side view of a toy projectile in accordance with an embodiment of the disclosure; and FIG. 32B is a rear view of the toy projectile of FIG. 32A;

FIG. 32C is a perspective view of the toy projectile of FIG. 32A;

FIGS. 33A and 33B are perspective views of the toy projectile of FIG. 32A showing the surface texture resulting from forming the projectiles using an expanded beaded material.

DETAILED DESCRIPTION

In embodiments, a toy projectile system can include a toy projectile having a stepped and nub and a toy projectile launch apparatus having a projectile receiving opening and improvised projectile checking housing assembly that can identify the toy projectile as compatible for the blasters.

In embodiments, the toy projectile system includes a toy projectile having a nub extending from an end thereof having a reduced diameter relative to the body of the projectile such that the nub is sized to interact with an improvised projectile checking housing assembly of a toy projectile launch apparatus.

Improvised projectile checking housing assemblies in accordance with embodiments of the disclosure generally include an opening through which only a properly sized nub can extend when the projectile is loaded into the apparatus. When loaded, a properly sized nub engages a features, such as a spring loaded button or level to shift the improvised projectile checking housing assembly into a checking position, thereby allowing the apparatus to launch. Without detecting of a nub when a projectile is loaded, the improvised projectile checking housing would not shift to the checking positions and the apparatus would remain locked against launching. Such a projectile which is not designed for use with the system of the disclosure is also referred to herein as an improper projectile.

The apparatus can include in embodiments, a projectile retaining element with a projectile barrel assembly extending rearward of the projectile retaining element. The projectile barrel assembly can include an improvised projectile checking housing assembly that is movable between checking and non-checking positions. When a projectile is inserted into the launch apparatus, it is received in the projectile barrel assembly and if the projectile is proper for use with the system, as projectiles described herein having the nub, it is received such that the nub is received within a projectile receiving opening. The improvised projectile checking housing assembly can include an elongated structure that checks for the presence of a proper projectile by detecting the nub. In particular, the elongated structure can have an improvised projectile button positioned at the end with in improvised projectile checking spring mounted thereto. When a proper projectile having the nub is inserted into the improvised projectile checking housing assembly, the improvised projectile button is shifted to a checking position. If an improper projectile is inserted and the improvised projectile button is not shifted to the checking position, the apparatus will be prevented from launching.

In embodiments, the apparatus can include a projectile retaining element having a front side and a backside on the toy launch apparatus for receiving projectiles therein at the backside of the projectile retaining element. The apparatus can include an improvised projectile checking lock gauge supported with the toy launch apparatus rearward the projectile retaining element where said gauge is disposed to translate alongside the projectiles received at the backside of the projectile retaining element for checking the outer diameter of received projectiles. The projectile launch apparatus can further include a projectile propelling mechanism forward the projectile retaining element for propelling the received projectiles from the front side of the projectile retaining element; a follower housing configured to reciprocate adjacent and rearward the backside of the projectile retaining element and towards the front side thereof; a linkage in the toy launch apparatus for moving the follower housing; a pusher coupled to the follower housing for advancing projectiles received at the backside of the projectile retaining element; and a catch at said gauge preventing advancing of the projectile forward in the projectile retaining element.

Further details on suitable toy projectiles and toy projectile launcher apparatuses for use in the system and methods of using the system are described in detail below.

Toy Projectile Launch Apparatus

Figure 1A:
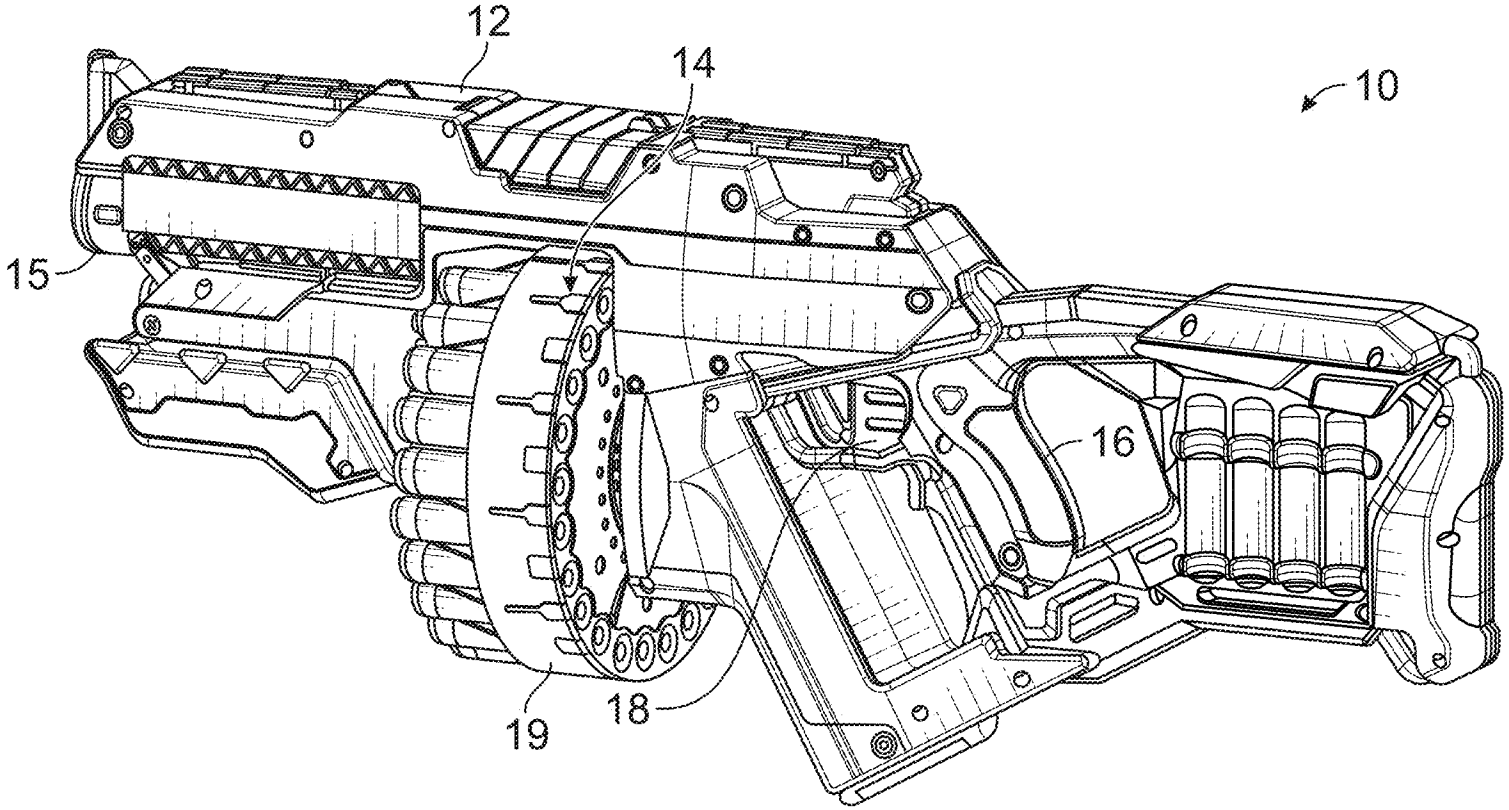
Figure 1B:
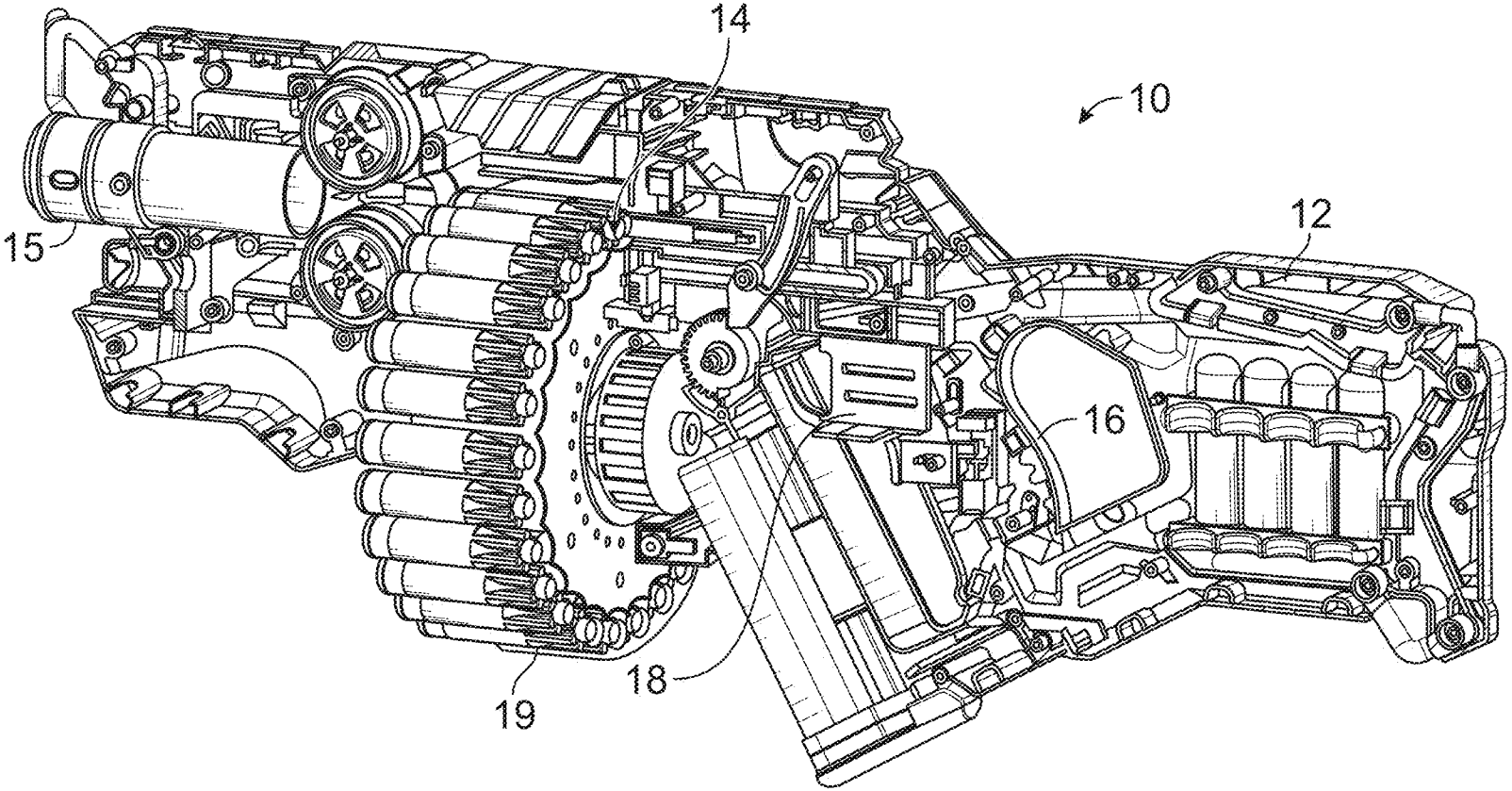

Referring now to FIGS. 1A and 1B, there is shown an embodiment of the invention in the form of a toy launch apparatus 10 having a housing assembly 12 including a barrel portion 14, a muzzle portion 15, a grip portion 16 and a trigger 18. The housing assembly 12 may be molded in two parts. The launch apparatus 10 is constructed for discharging a projectile of predetermined dimensions, and has safety features to prevent other objects from being inserted and discharged. Such acceptable projectiles are shown with projectile reference nos. 30, 32, 34, 36, and 38, in FIGS. 2C through 2F discussed below, having a soft weighted tip portion and rigid light-weight foam body material, including features such as a rearward nub 35 preventing launch apparatus 10 operation using improvised projectile checking housing assembly 20 for correspondingly structured and appropriately sized projectiles. Such features include requiring the corresponding stepped end 33 and nub 35 present at a projectile receiving opening 42. A step structure 40 surface of a projectile retaining element 19 is provided for contacting rearward stepped fins 33 for detecting offset dual parallel surfaces on backside of the dart at reference numbers 33 and 35. The nub 35 portion of appropriate projectiles extends into the projectile receiving opening 42.

FIG. 1A is a perspective view of a toy launch apparatus 10 embodiment and FIG. 1B illustrates the launch apparatus having a housing half removed to reveal internal structures for multiple improvised projectile checking and locking features embodied with a present preferred embodiment. The toy launch apparatus 10 includes the projectile retaining element 19 with a projectile barrel assembly 14. The projectile retaining element 19 is shown as a dart projectile drum but may be provided as a rotating barrel, dart magazine or projectile clip structure. The projectile retaining element 19 is provided further with the projectile barrel assembly 14 area extending rearward the projectile retaining element 19 with the improvised projectile checking housing assembly 20 of the projectile barrel assembly 14 movable between checking and non-checking positions. An elongated structure 24 is moveably positioned in the improvised projectile checking housing assembly 20 to check the step structure 40.

The step structure 40 of the projectile barrel assembly creates a projectile receiving opening 42 at the interface of the projectile retaining element 19 and the improvised projectile checking housing assembly 20. The projectile receiving opening 42 allowing an appropriate size projectile with a corresponding step 40 present with the rearward nub 35 at the projectile receiving opening 42 of the improvised projectile checking housing assembly 20 thus preventing another projectile from the projectile receiving opening 42. An improvised projectile button 26 is positioned at the end of the elongated structure 24 at IP checking housing collar 27 for checking the rearward nub 35 discussed further below.

An improvised projectile checking spring 28 is mounted to the improvised projectile button 26 with the end of the elongated structure 24, having the improvised projectile button 26 positioned for checking at the projectile receiving opening 42 with reference to FIGS. 1C, 1D, 2A and 2B discussed below. Extending rearward of the projectile retaining element 19, the improvised projectile checking housing assembly 20 has the button 26 and first and second sidewalls 22A/22B with first and second catch latch apertures 23A/23B opening to a catch 25 latch recess of elongated structure 24 using an improvised projectile checking spring 28 opening to receive a locking key 44 structure based upon the projectile receiving opening 42 to the improvised projectile checking housing assembly 20, such that IP detection checks the dart pusher using the key 44 with catch 25. Accordingly with the projectile receiving opening 42 at the interface of the projectile retaining element 19, the improvised projectile checking housing assembly 20, the improvised projectile button 26 and elongated structure 24 move between checking and non-checking positions and prevent trigger movement unless the appropriate sized projectile is present by detecting offset dual parallel surfaces on backside of dart, such as those illustrated in FIGS. 2C through 2G below embodiments of dart projectile designs with rearward stepped structures such as fins 33 and nub 35 portions.

For example, the projectile 30 can include a stepped end 33 and a nub 35, such that when the stepped end and nub are present at a projectile receiving opening with any corresponding step, e.g., allowing rearward stepped structure fins 33 portions as discussed for appropriate projectiles at the projectile receiving opening, such that detection checks are triggered. In the alternate embodiment of FIG. 2G, the projectile 34 has a solid core 68 can extend outwardly from the hollow portion 70 of the body, such that the hollow portion 70 surrounds a portion of the solid core 68. The overall length of the extension can be varied depending on the overall desired length of the projectile 60, and needed compatibility with the particular launching apparatus with which the projectile 60 is to be used. In embodiments, the projectiles can include features to allow it to be used with launchers having an improvised projectile checking housing structure such as described in U.S. provisional and design application Nos. filed concurrently herewith.

Figure 2A:
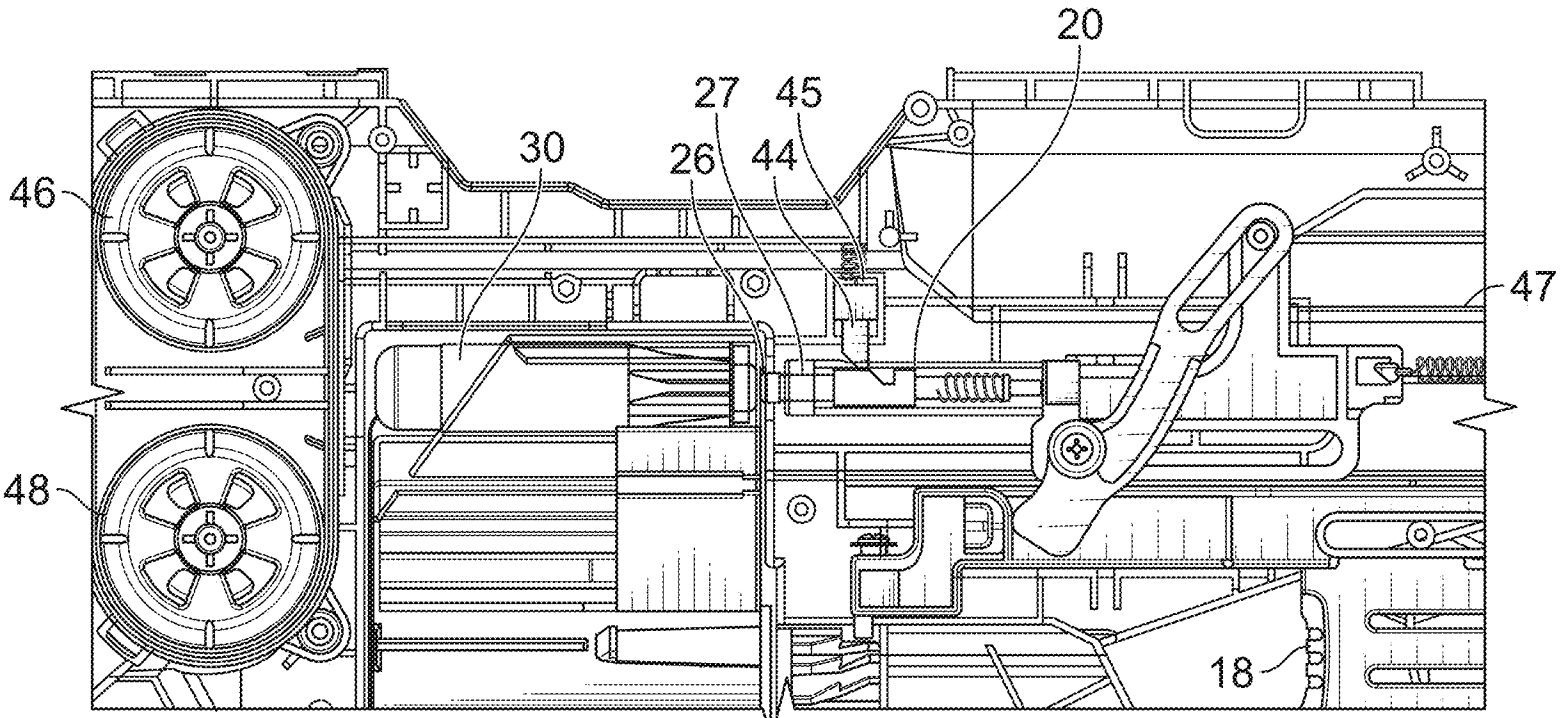
Figure 2B:
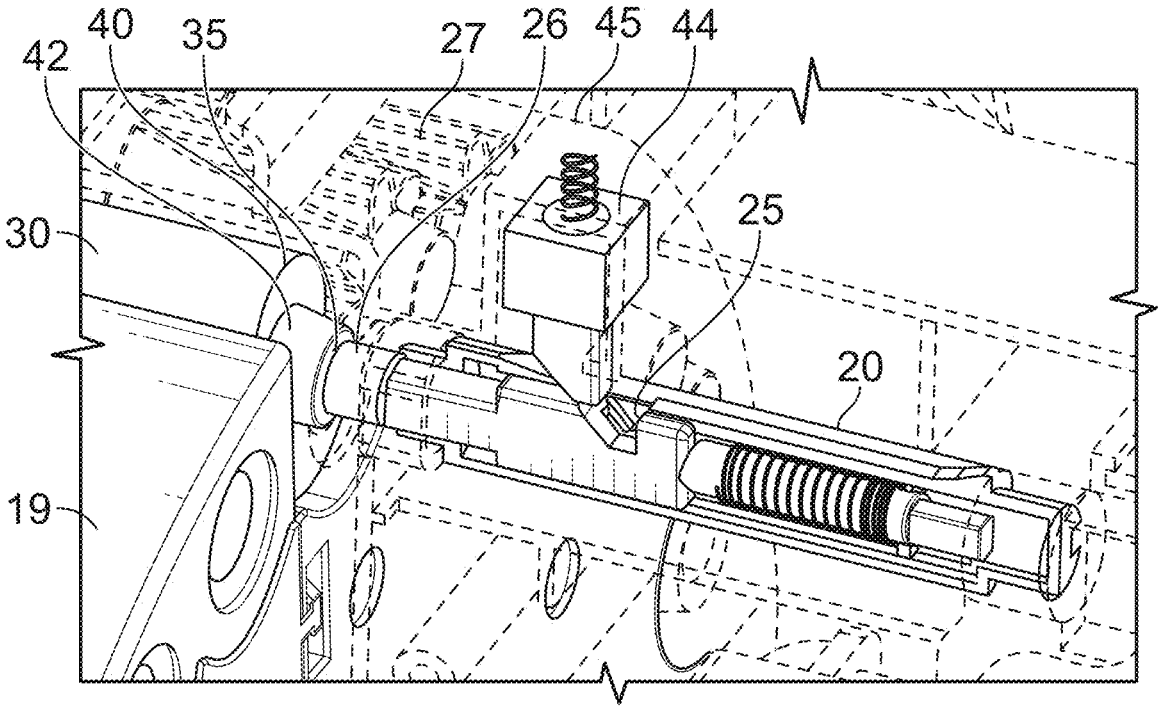
Figure 2C:
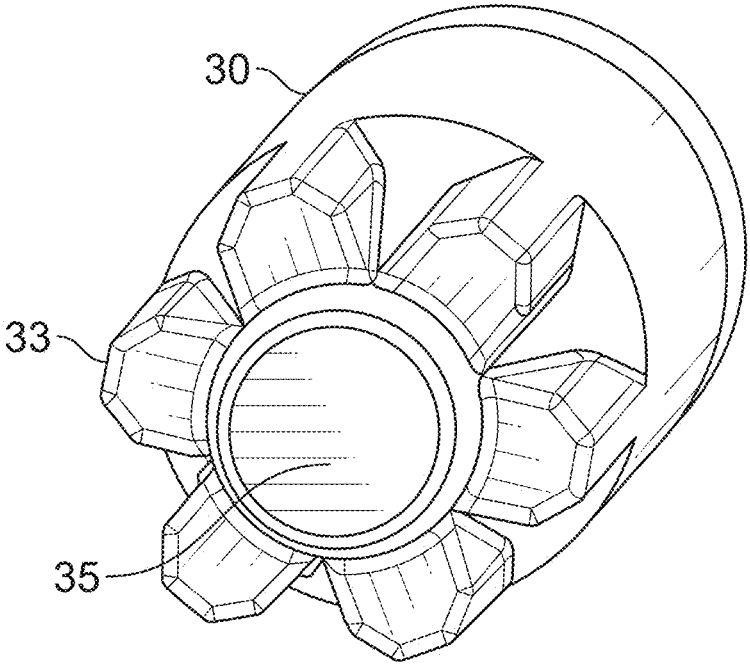
Figure 2D:
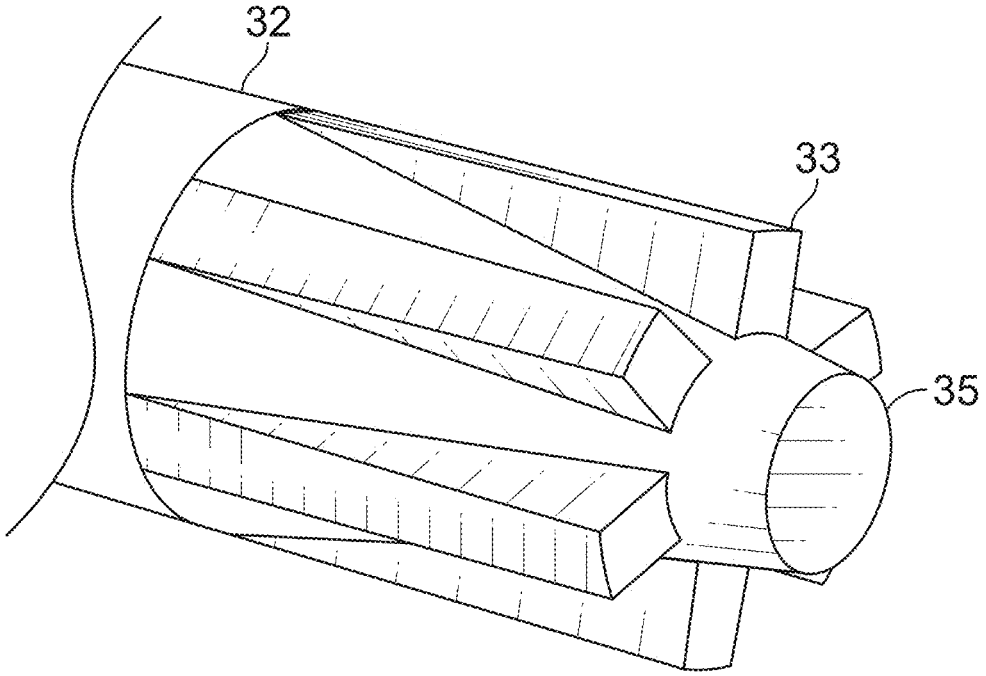
Figure 2E:
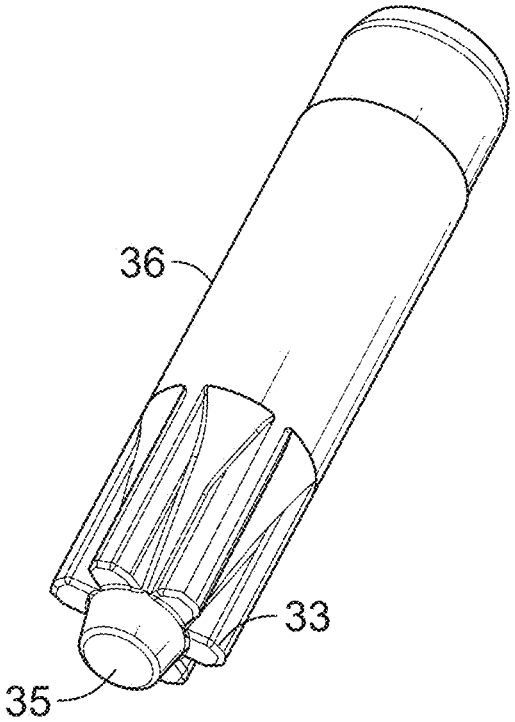
Figure 2F:
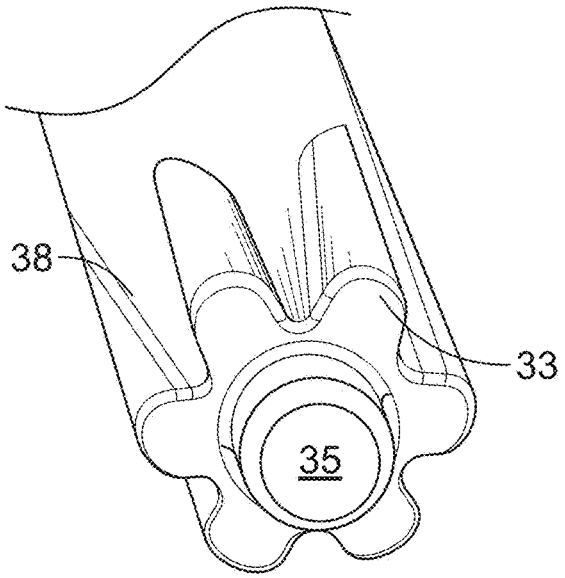
Figure 2G:
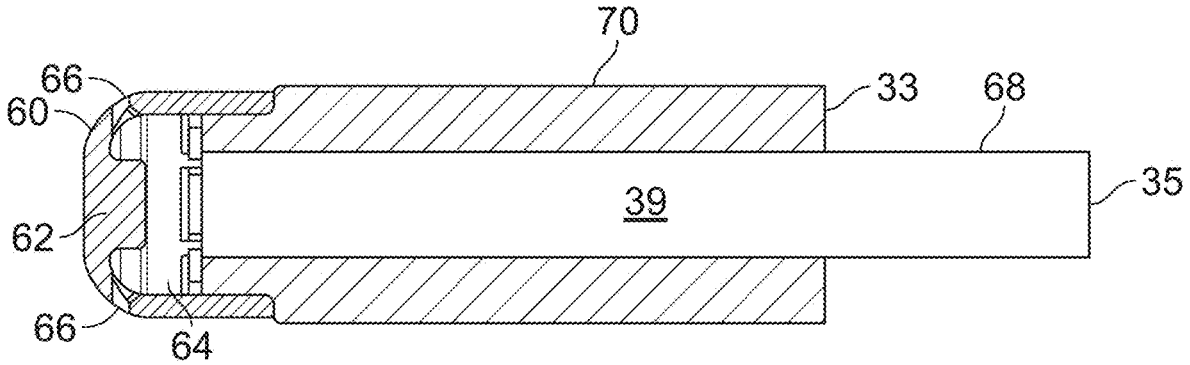

As seen in FIG. 2G, the alternate dart 34 includes a tip 60 which includes internal projections 62 into an internal chamber 64 into which the projections 62 extend. The internal chamber 64 is vented by one or more vent holes 66 disposed in the tip 60. The vent holes 66 can be positioned variously on the tip 60 so long as they are in fluid communication with the internal chamber 64. The vent holes 66 allow air from within the internal chamber 64 to escape upon impact of the tip against a surface, to thereby allow the outer walls of the tip 60 to expand outwardly such that the tip 60 impact area expands upon contact. This allows for increased impact area, which can further aid in keeping a kinetic energy density (KED) within toy safety standard, while allowing the projectile to be launched with increase velocity. Thus a projectile with a light weight body, yet a large impact producing tip area and relatively heavier tip may provide advantageous flight characteristic, while soft highly flexible durometer materials provides acceptable KED. Hazard evaluation of improvised projectile (IP) includes preventing the insertion or loading of inappropriate objects to prevent launched improvised projectiles may include but is not limited to tip 60 relative to kinetic energy.

FIG. 10 is a side view that illustrates the projectile barrel assembly 14 extending rearward the projectile retaining element 19 with an improvised projectile checking housing assembly 20 of the projectile barrel assembly 14 movable between checking and non-checking positions, and is shown at rest. In Time Step 0, there is the opening 42 on the housing relative to catch 25 opening in the IP housing, with no pressure on the trigger 18, with a single dart loaded into the projectile retaining element 19, and the IP lock key 44 riding the top of the IP detector housing 20 following its contour, as shown in FIG. 2B discussed below. A lock spring 45 downwardly biases the IP lock key 44. A trigger return spring 47 rearwardly biases the trigger 18 and the connected trigger linkages. As discussed herein, the IP detector button 26 is positioned to be pushed into housing 20 at IP checking housing collar 27 maintaining the elongated structure 24 for registration with the catch latch apertures, the apertures 23A/23B to completely close so the lock key 44 may ride over the IP detector housing 20 without dropping into the catch 25 latch recess of elongated structure 24.

Figure 1C:
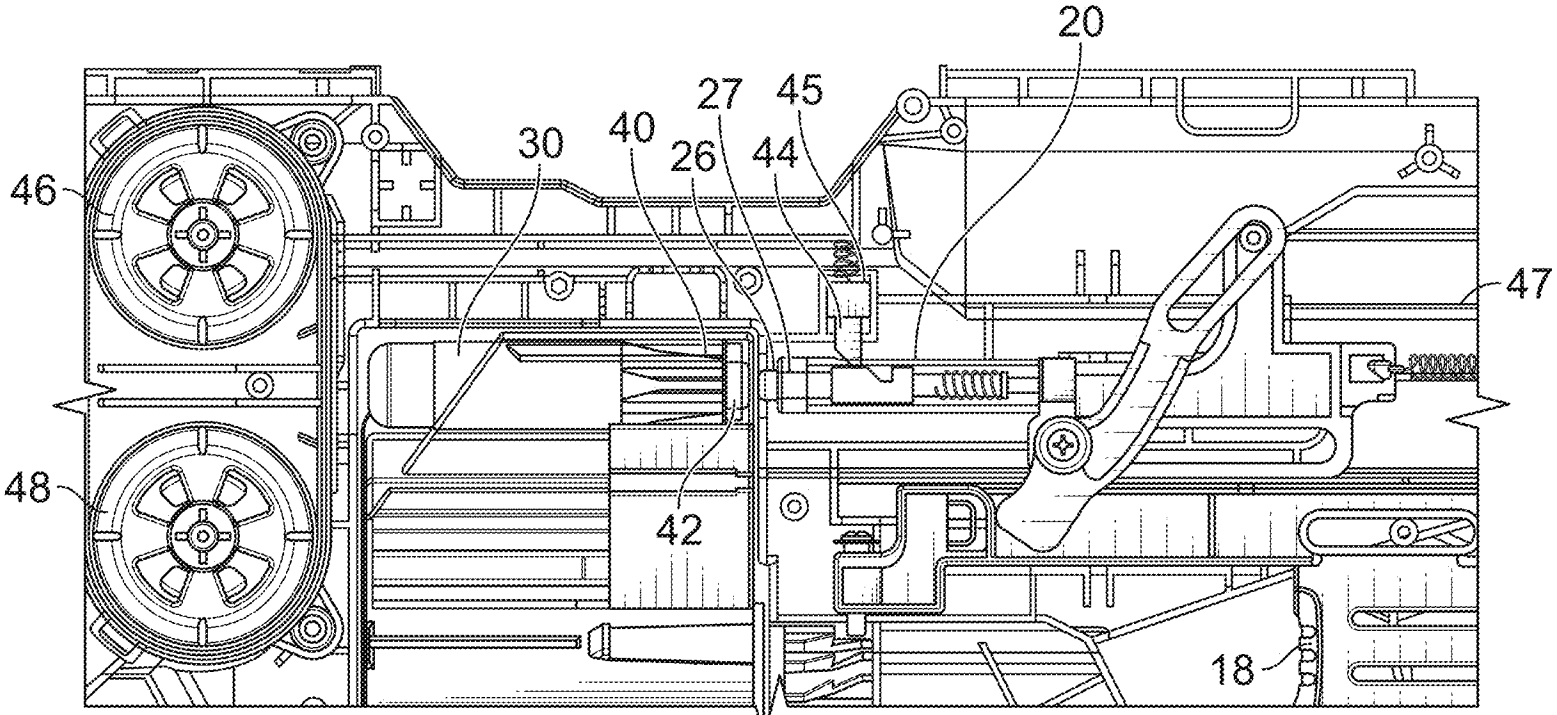
Figure 1D:
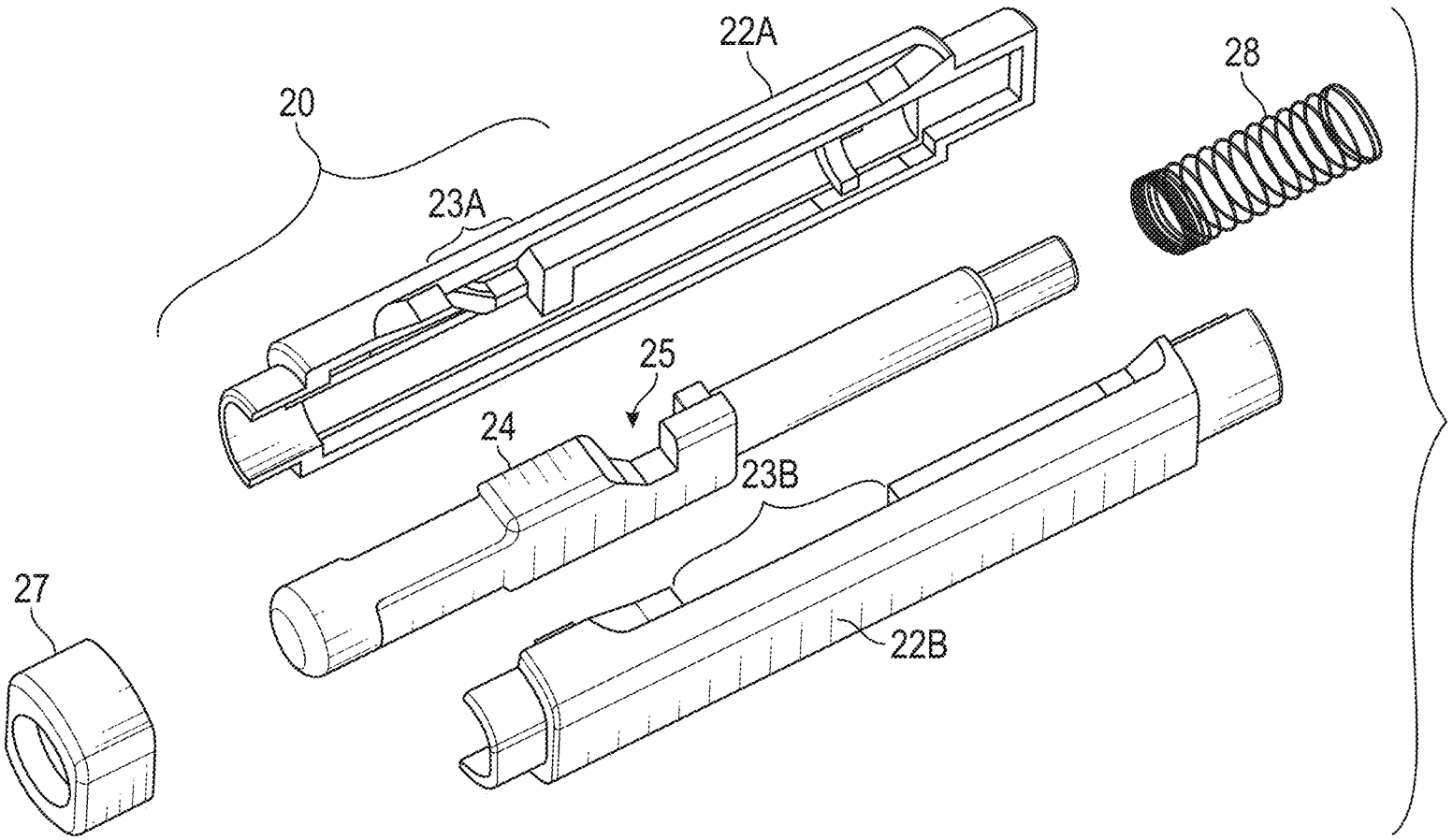
Figure 1E:
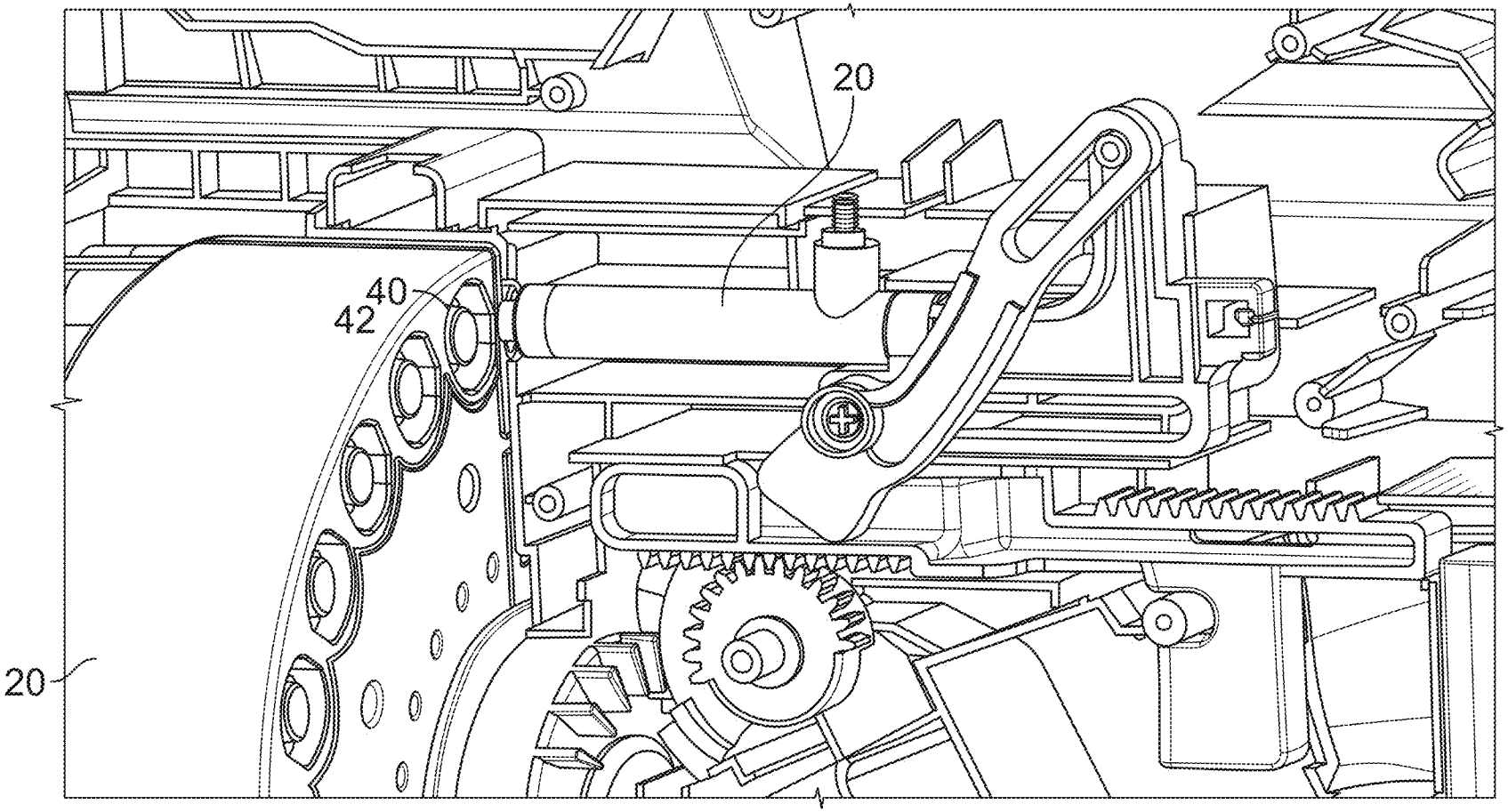

FIG. 1D button 26 and first and second sidewalls 22A/22B with first and second catch latch apertures 23A/23B open to the latch recess catch 25 of elongated structure 24 using an improvised projectile checking spring 28. The elongated structure 24 has proximal and distal ends thereof and the catch 25 latch recess there between. The exploded view componentry shows the openings at apertures 23A/23B for respective first and second sidewalls 22A/22B. Thus the improvised projectile checking housing 20 provides a catch latch aperture rearward from the projectile receiving opening 42 used with the improvised projectile checking housing assembly 20 where elongated structure 24 resides between the first and second sidewalls 22A/22B thereof to check the projectile receiving opening 42 and accordingly the step structure. FIG. 1E also shows a different alternate embodiment positioning a locking key 44 atop moving with the improvised projectile checking housing assembly 20 in accordance with the present embodiments.

FIGS. 2A and 2B are exposed side elevational and perspective views of a toy projectile apparatus with multiple improvised projectile features about to be checked for the launch apparatus shown in FIGS. 1B-D. In FIG. 2B the side view that illustrates the improvised projectile checking housing assembly 20 about to check, in Time Step 1, with slight pressure on the trigger 18 to remove slack and have IP button 26 in contact with dart. The dart has not moved and has no pressure on it yet; the IP detector lock key 44 rides the top of the IP detector button 26. Still, in Time Step 1, the movement of the housing at this time is moving forward because the IP catch 25 is not forward enough to be aligned with first and second catch latch apertures 23A/23B. IP button 26 and housing 20 are simultaneously translated forward together to remove the slack and check for the presence of the correct dart.

The trigger 18 assembly provides movement of the improvised projectile checking housing with the improvised projectile button 26 from the elongated structure 24 proximal end with the improvised projectile checking spring 28 towards the projectile receiving opening 42 of the improvised projectile checking housing assembly 20. The locking key 44 structure is positioned rearward from the projectile receiving opening 42 to the improvised projectile checking housing assembly 20, intermediate the proximal and distal ends of the elongated structure 24, and opposing the first and second catch latch apertures 23A/23B of the first and second sidewalls 22A/22B for preventing further movement of the improvised projectile checking housing unless the appropriate size projectile is present at the projectile receiving opening 42 of the improvised projectile checking housing assembly 20. Alternatively stated, with the detection of a proper projectile, the trigger assembly 18 is able to move the projectile into the launching structure because the locking key 44 slides over the first and second side walls 22A/22B. However, with an improper projectile, a locking structure 44 is biased towards/into the aperture 23A/23B to therefore engage the housing assembly 20, thus preventing further movement of the housing assembly 20 in a direction towards the launching structure.

FIGS. 2C through 2F provide views of dart projectile designs with rearward stepped fins 33 and nub 35 portions of acceptable projectiles 30, 32, 34, 36, and/or 38 for the launch apparatus using improvised projectile checking housing assembly 20 for correspondingly structured and appropriately sized projectiles with a corresponding feature present at a projectile receiving opening 42 with a corresponding step 40. The rearward stepped fins 33 and nub 35 portions may be formed with either sharp edges, rounded or tapered edges for complementary use for with the corresponding step present at the projectile receiving opening of the improvised projectile checking housing assembly 20 as discussed. Further if the rearward nub 35 object is too soft, or of the incorrect diameter, the nub 35 structure may not be allowed or able to pass improvised projectile checking. With an alternative shaped nub, it is also contemplated as shown in the FIG. 2G dart projectile design with its rearward step and nub portions, where the body may include a hollow portion with a solid core 68 inserted into the hollow portion 70. In embodiments one or both of the solid core and the hollow portion. The darts herein described may be formed using a variety of processes and materials, including but not limited to solids, foam, extruded plastics and/or foam materials as hollow or tubular structures or conventional NERF™ brand dart materials.

Figure 3A:
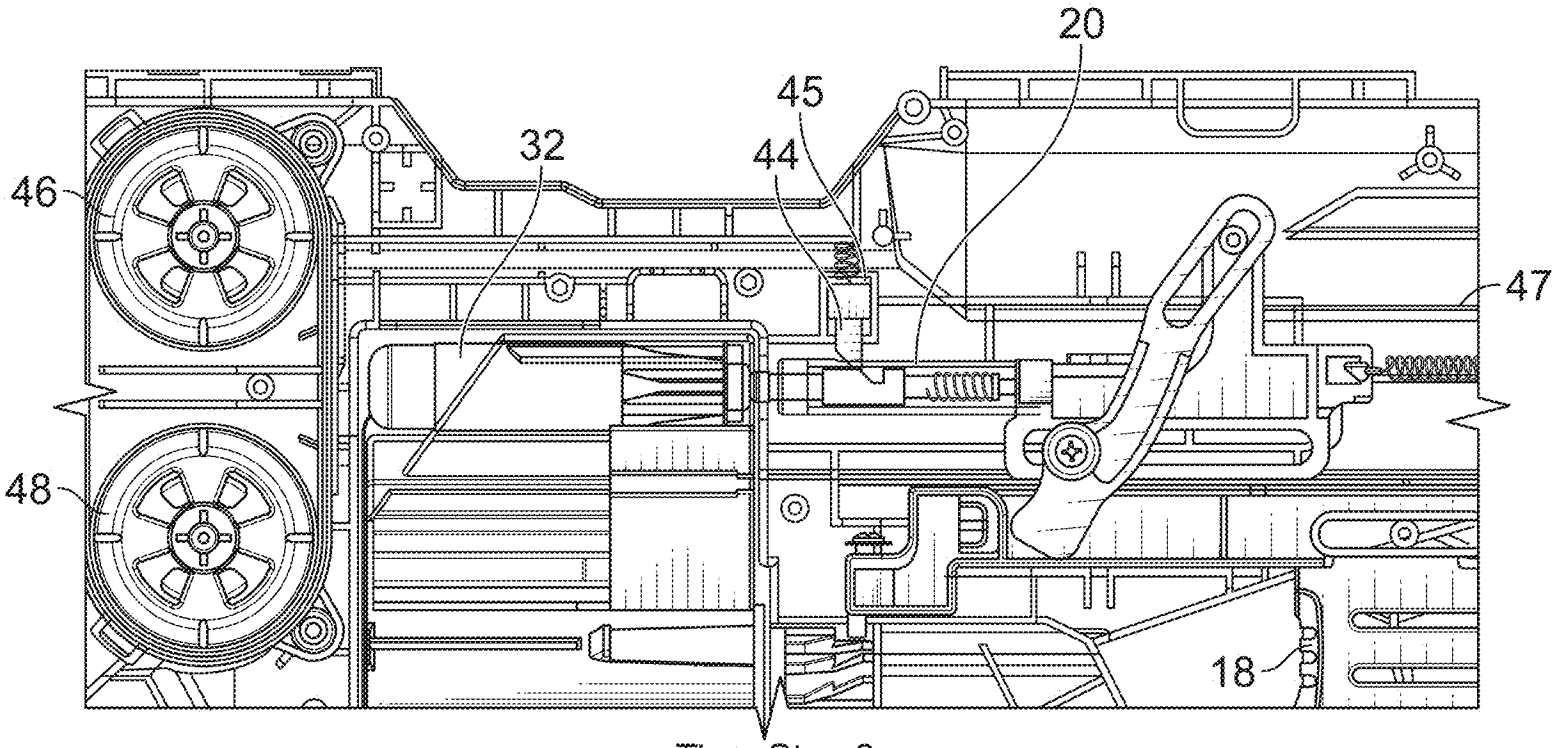
FIGS. 3A and 3B are exposed side elevational and perspective views of a toy projectile launch apparatus checking the appropriate size projectile present at the projectile receiving opening of the improvised projectile checking housing assembly checking for an improvised projectile while pushing the loaded projectile in accordance with the present inventions.
Figure 3B:
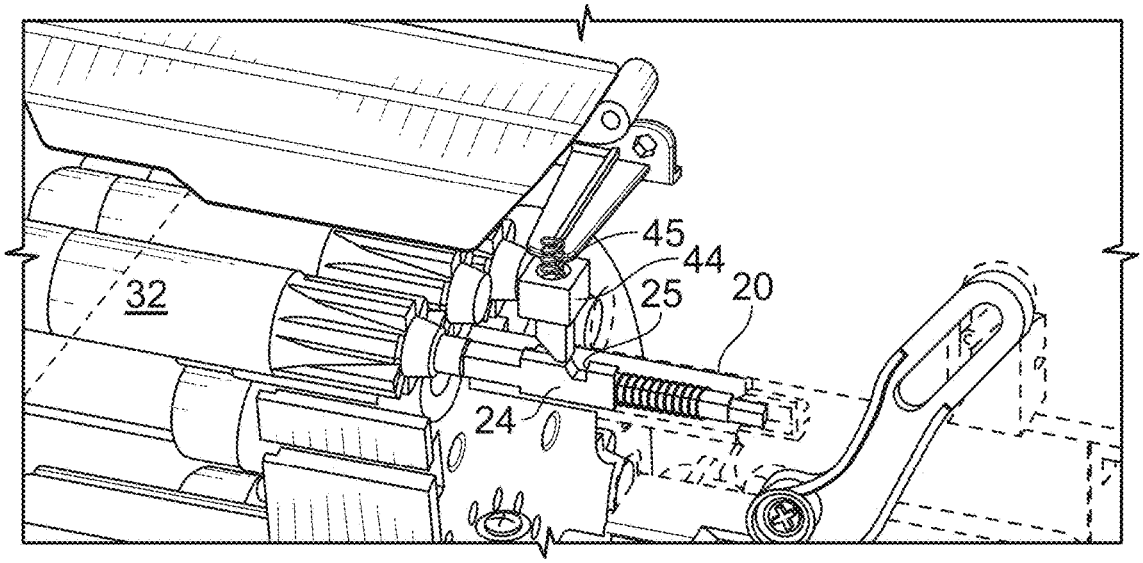

FIGS. 3A and 3B are exposed side elevational and perspective views of a toy projectile launch apparatus checking the projectile present at the projectile receiving opening 42 of the improvised projectile checking housing assembly 20 while pushing the loaded projectile in accordance with the present embodiments. FIG. 3B (at Time Step 2) illustrates the side view with slight pressure on the trigger 18 to engage and push IP detector system, having the IP detector button 26 retracted into IP detector housing via pressure on dart, with the IP detector lock riding the top of the IP detector button 26. The IP housing and IP button 26 with first and second catch latch apertures 23A/23B positioned as misaligned in relation to the IP catch 25 are thus blocking the IP lock key 44 from engaging with the IP catch 25. Otherwise with the incorrect dart with an improper nub or no dart, the downwardly biased lock would soon engage with alignment of first and second catch latch apertures 23A/23B opening the resulting aperture in relation to the IP catch 25 thus locking downwardly biased IP lock key 44 as engaging in the IP catch 25.

Figure 4:
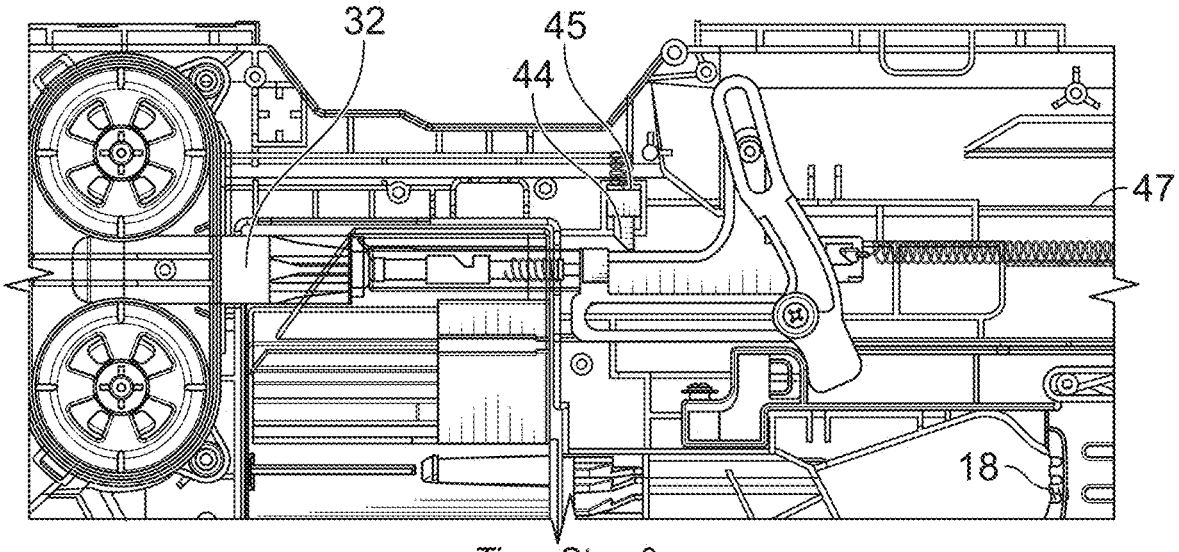
FIG. 4 is a side elevational view of a toy projectile apparatus pushing the loaded appropriate authorized projectile into motor driven rotating flywheels for motor driven projectile propelling in accordance with the present inventions.

FIG. 4 is a side elevational view of a toy projectile apparatus pushing the loaded appropriate authorized projectile into motor driven rotating flywheels 46/48 for motor driven projectile propelling in accordance with the present embodiments. The authorized dart is maintained in the projectile retaining element 19 with an interference fit or friction fit as between the dart body and the projectile retaining element 19 to allow for checking the projectile and particularly nub 35 at the projectile receiving opening 42. To this end, in FIG. 4 the side view illustrates the improvised projectile checking housing assembly 20 checked and advancing, in Time Step 3 with the dart checked and pushing into flywheels 46/48, advancing full pressure on the trigger 18 to push dart into flywheels 46/48, with the IP detector lock riding the top of the trigger 18 linkage. Thereafter when trigger 18 pressure is removed, system will rest to Time step 0.

FIGS. 5A and 5B are exposed side elevational and perspective views of a toy projectile launch apparatus shown as preventing advancement of inappropriate objects, or a non-authorized tubular projectile with as shown, a hollow central core. Thus the inappropriate projectile prevents further operation of the launch apparatus based on the checked opening 42 of the improvised projectile checking housing assembly 20, and showing further having the trigger 18 locked with its downwardly biased IP lock key 44. Specifically, with the absence of an appropriately dimensioned numb structure on projectile, there is no structure to push against IP button 26 in a rearward direction against force of spring 28. As trigger 18 advances improvised projectile housing 20, apertures 23A/23B expose IP lock catch 25 to downwardly biased lock 44 permitting engagement of IP lock 44 in catch 25 before first and second catch latch apertures are able to move over and cover IP catch 25, thereby preventing engagement. In FIGS. 5A and 5B the views illustrate the improvised projectile checking housing assembly 20 check indicating an incorrect dart or no authorized dart, and at this step with full pressure on the trigger 18, IP lock key 44 inserted into IP lock catch 25, loading of inappropriate objects, or a non-authorized tubular projectile with a hollow central core thus further preventing operation of the launch apparatus based on the checked opening 42 of the improvised projectile checking housing assembly 20, the IP lock key 44 locks the trigger 18 due to IP lock button 26 IP catch 25 and IP housing's IP catch being aligned.

FIG. 6 is a perspective view of a toy projectile apparatus showing the IP locking key 44 structure rearward from the projectile receiving opening 42 to the improvised projectile checking housing assembly 20, intermediate the proximal and distal ends of the elongated structure 24, where the launch apparatus is shown prior to checking the appropriate size projectile with the nub 35 of the projectile present at the projectile receiving opening 42 of the improvised projectile checking housing assembly 20 shown at rest, in Time Step 0, with the IP housing assembly 20 relative to catch opening aperture at rest.

Figure 7A:
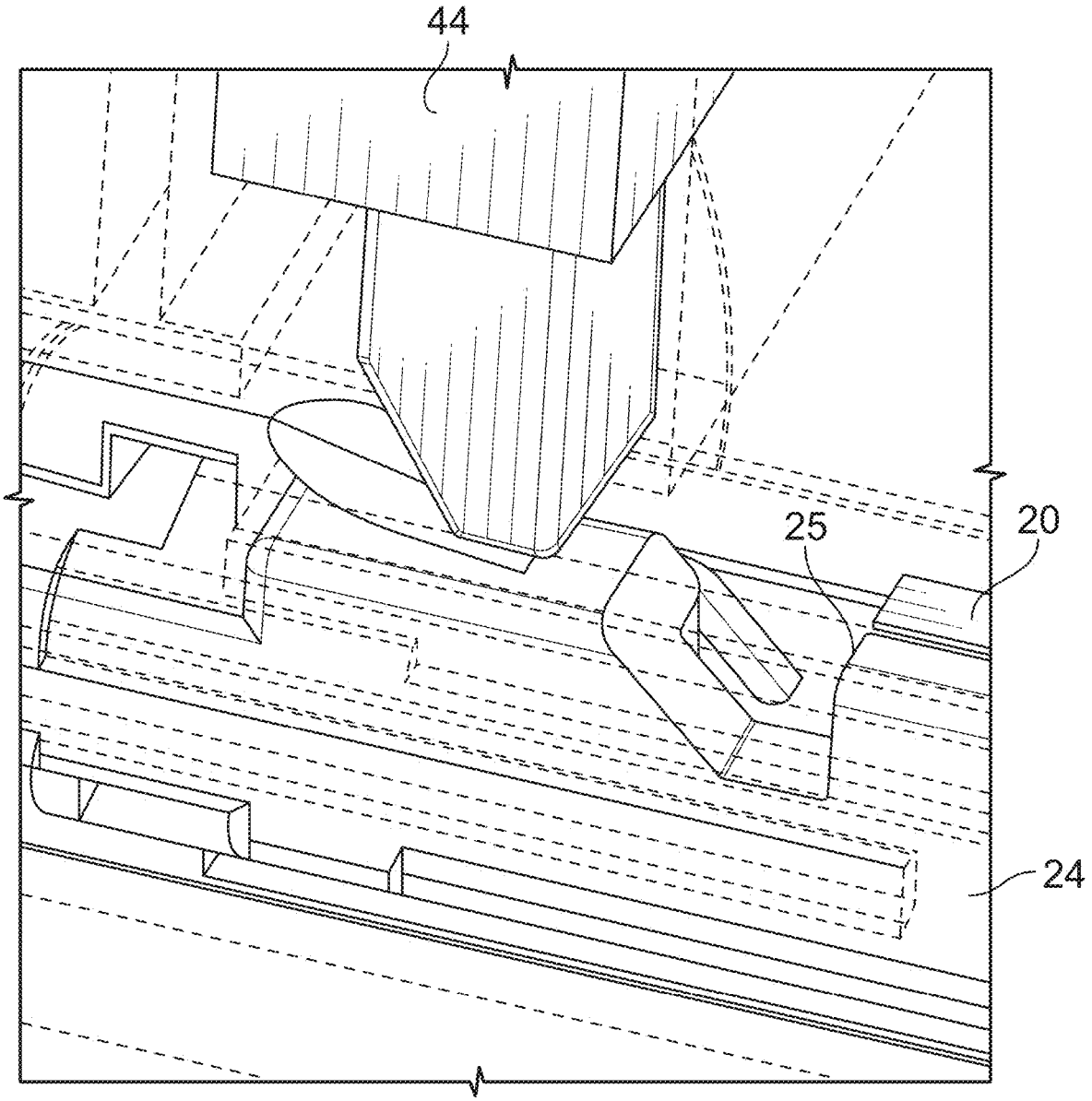
Figure 7B:
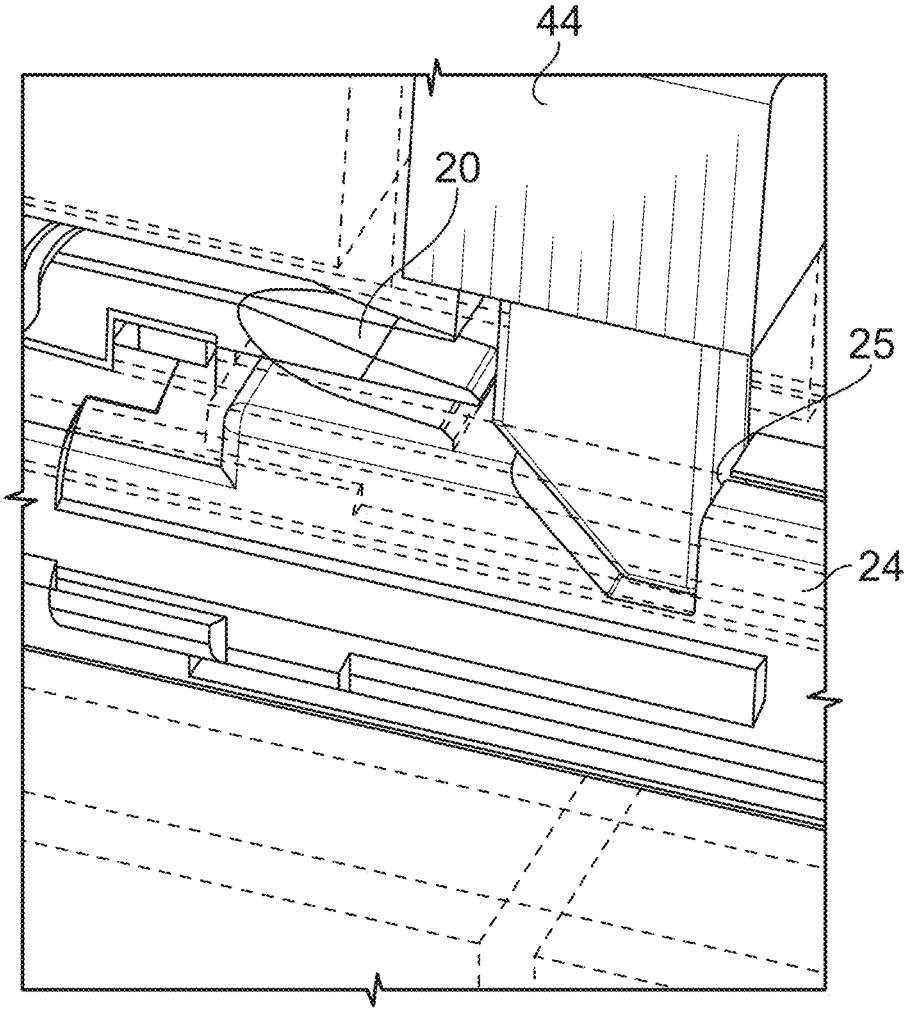
Figure 7C:
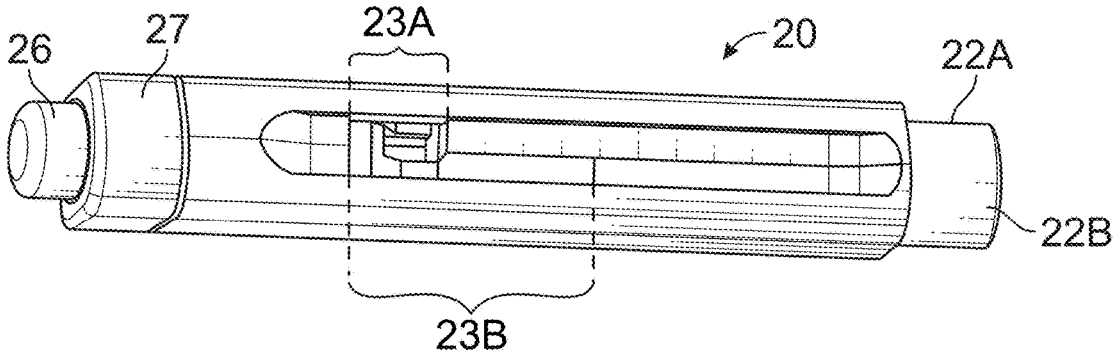
Figure 7D:
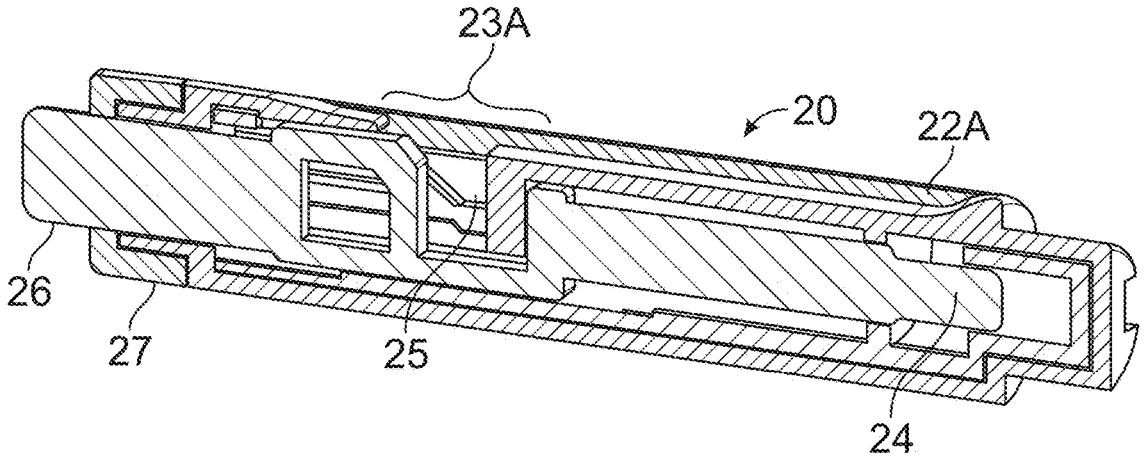

FIGS. 7A and 7B are enlarged perspective views, partially in section, showing respectively the IP locking key 44 engaged having the launch apparatus and trigger 18 as preventing insertion, loading of inappropriate objects, or a non-authorized tubular projectile with a hollow central core thus further preventing operation of the launch apparatus based on the checked opening 42 of the improvised projectile checking housing assembly 20, where opposing the first and second catch latch apertures 23A/23B of the first and second sidewalls 22A/22B for preventing further movement of the improvised projectile checking housing, with first and second catch latch apertures 23A/23B opening to a catch 25 latch recess of elongated structure 24 in accordance with the present embodiments. FIGS. 7C and 7D show the opening on the housing relative to catch opening in the IP housing 20.

FIGS. 8A and 8B are enlarged perspective views, partially in section, showing the IP locking key 44 with the lock closed and disengaged, having the first and second catch latch apertures 23A/23B closed off the catch 25 latch recess of elongated structure 24 in accordance with the present embodiments. With reference to the length of the dart and particularly its nub 33, e.g., in the present embodiments the IP detector button 26 may be pushed into housing 20 on the order of approximately 4 mm inward for registration for maintaining alignment with the catch latch apertures, the apertures 23A/23B to completely close and the lock key 44 can ride over the IP detector housing 20 without dropping into the catch 25 latch recess of elongated structure 24.

FIGS. 9A and 9B are exposed side elevational and perspective views, partially in section, of an alternate embodiment non-motorized toy projectile apparatus checking for an improvised projectile of the launch apparatus with an pneumatic air piston cylinder 50 shown at rest without an inserted projectile present in FIG. 9B and showing an improvised projectile safety valve seat 52 at an alternate projectile receiving opening 42 with corresponding step 40 with a small spring for keeping valve closed to close off air pathway to dart tube, with the contact valve contact component 54 provided as an alternate elongated structure facilitating the improvised projectile checking housing assembly to check the step structure 40 and projectile receiving opening 42. Herein as shown in FIG. 9B, the launcher is at rest at Time Step 0 where the piston is already primed and pulled back.

FIG. 10 is a side elevation view of the air piston cylinder launch apparatus shown as about to check an appropriate size projectile present at the projectile receiving opening 42 of the improvised projectile checking housing assembly 20, with the launcher about to check Time Step 1 where the dart is beginning to be inserted into front load barrel. The tip of the dart is not yet aligned with the base of the cutout found on the barrel tip, at which time the dart starts to contact valve contact component 54 elongated structure for the improvised projectile checking.

FIG. 11 is a side elevation view, partially in section, thereof where the pneumatic air piston cylinder launch apparatus is shown checking the appropriate size projectile present at the projectile receiving opening 42 of the improvised projectile checking housing assembly 20, with the launcher checked and ready at Time Step 2 where the IP nub 35 is fully inserted into IP nub 35 receptacle found on dart barrel backstop. The valve is now fully open wherein that dart is fully inserted into barrel. The barrel cutout is aligned with tip of the dart, indicating pushing further is not required.

FIG. 12 is a side elevation view, partially in section, thereof where the pneumatic air piston cylinder launch apparatus shown as preventing insertion, loading of inappropriate objects, or a non-authorized tubular projectile with a hollow central core. The improperly structured dart or non-authorized tubular projectiles prevents further operation of the launch apparatus based on the checked opening 42 of the improvised projectile checking housing assembly 20 based on such a dart fully inserted and seated on dart barrel backstop because there is no structure to push against valve contact 54, thus keeping valve seat 52 still completely closed, and even if dart had solid foam body, valve would stay closed.

In the forgoing, the above described embodiments disclosed front loaded toy projectile launchers include motorized and non-motorized toy projectile apparatus embodiments providing checking for improvised projectile at the launch apparatus with motor driven projectile propelling flywheels as well as alternate pneumatic air piston cylinder embodiments having IP detection systems. As detailed herein so long as the nub portion 35 has an effective diameter with features such as a rearward nub portion 35 to fit within and engage with launch apparatus 10 operation using improvised projectile checking housing assembly 20 for correspondingly structured and appropriately sized projectiles. Such features include requiring the corresponding stepped end 33 and nub portion 35 present at a projectile receiving opening 42 locking or other interfacing structure of an IP detection system.

Various toy projectile launchers can be used with the systems herein having a stepped and nub portion 35 and a toy projectile launch apparatus having a projectile receiving opening and improvised projectile checking housing assembly that can identify the toy projectile as compatible for the launchers. Details of the checking operation are discussed below for an embodiment of the system and illustrated in time steps, identifying the time step status in checking and non-checking positions, i.e. detection of the nub portion 35 as beginning initial removal of system slack discussed below.

As discussed below, a rear loaded launcher having such IP detection system is described. Likewise in the absence of an appropriately dimensioned numb structure on projectile, there is no structure to unlock as trigger 18, 118 advances thereby preventing engagement. In embodiments, a toy projectile launcher having an IP detection system may identify a step between a second end of the projectile and the nub portion. The step can be defined by a difference in diameter between at the second end or fin end and the nub portion. In embodiments, the difference between the diameter at the second end or fin end and the diameter of the nub can be about 0.5 mm to about 3 mm, about 1 mm to about 2 mm, about 1 mm to about 3 mm, or about 0.7 mm to about 1.6 mm.

FIG. 13 is a perspective view of a toy launch apparatus embodiment rearward pusher engagement to advance darts, with FIG. 14 showing the side elevational view of the launch apparatus.

FIGS. 15 and 16 are exposed side perspective and side elevational views of the toy projectile apparatus with multiple improvised projectile features to be checked for the launch apparatus having a housing partially removed to reveal internal structures showing the rearward loading and pusher engagement to advance dart projectiles checking and locking features embodied with a rearward embodiment checking housing assembly in accordance with the present inventions.

Referring now to FIGS. 13 through 15, and particularly 16 the shown toy launch apparatus rearward pusher engagement embodiment of the invention is shown in launch apparatus 110 having a housing assembly 112 including a barrel portion 114 with chambers 119, a muzzle portion 115, a grip portion 116 and a trigger 118. FIG. 16 is shown in a pre-time step 0 with the launch apparatus 110 at rest, having no pressure on the trigger 118.

As shown in FIGS. 15 and 16 with single projectile 30 loaded into rotating barrel projectile retaining element 114 at dart chamber 119. As discussed above in connection with projectile reference nos. 30, 32, 34, 36, 38 and FIGS. 2C through 2F, the projectile 30 has predetermined dimensions and safety features, including its rearward nub portion 35 likewise preventing launch apparatus 110 operation where other objects may be inserted at dart chamber 119. If projectile 30 is inserted too far, friction of dart tip with the dart backstop 150 could bind the drum 114 structure, and to realign gear teeth 152 are provided and here fully engaged with gear teeth 154 with a peak to valley engagement. At pre-time step 0, with reference to FIG. 16 with the apparatus 110 at rest and no pressure on the trigger 118, an improvised projectile (IP) checking lock gauge 144 rides atop of a follower housing 120 which advances a follower 102 for rotating the projectile retaining element 114 to its next dart chamber 119, while the follower housing 120 also keeps the IP lock gauge 144 locked in the up position so the follower 102 can de-couple and still advance the dart drum projectile retaining element 114, even when no darts are present. Presently follower 102 is not in contact with the dart drum ramps 104 as yet for advancing drum 114. Steps discussed in detail below during full trigger 118 pull will fire the dart projectile 30 provided its having the predetermined dimensions and features discussed, with multiple improvised projectile checking by the rear loaded launcher 110 employing its IP detection system.

As shown the projectile retaining element or drum 114 has a front side and a backside on the toy launch apparatus for receiving projectiles 30, 32, 34, 36, 38 at the backside thereof. In FIGS. 15 and 16 projectile propelling rotating flywheels 146, 148 as a motor driven projectile propelling mechanism is forward the projectile retaining element 114 for propelling the received projectile 30. The IP lock gauge 144 is supported within the apparatus 110 rearward the dart chamber 119 and drum 114 with IP lock gauge 144 disposed to translate alongside the projectile 30 received at the backside of the drum 114 for checking the outer diameter of the nub portion 35 of received projectile 30. The follower housing 120 is configured to reciprocate adjacent and rearward the backside of the drum 114 and towards the front side thereof, with the follower housing including cam surfaces 125, 126 to translate the IP lock gauge 144. The cam surfaces 125, 126 are seen further as cam surfaces 125 providing an Unlock Pathway there-through in the case of correct dart alignment, while the backside of cam surfaces 126 provides a catch thereat for locking abutment in the case of incorrect dart gauge misalignment for locking the misaligned cam surfaces 125, 126 with one another to prevent launch of an inappropriate object or a non-authorized projectile therefrom, as discussed herein and in FIGS. 19C and 22B showing close up views of lock engaged and disengaged conditions of the pathway as between cam surfaces 125, 126. Accordingly at least one latch is positioned to lock in relation to the catch backside of cam surfaces 126 of the IP lock gauge 144 with the IP lock gauge 144 improperly translated in the absence of a verified projectile preventing the pathway so as to prevent advancing of the projectile 30 forward.

A linkage 117 is provided operable with the trigger 118 of the apparatus 110 for moving the follower housing 120. A pusher 122 is coupled to the follower housing 120 for advancing the received projectile 30. The cam surfaces 125 pathway is cooperatively positioned as discussed at the pusher 122 in relation to the catch backside of cam surface 126 with the IP lock gauge 144 having translated alongside the projectile 30. To confirm the outer diameter of an authorized and verified projectile 30, cam surfaces 125 allow the discussed Unlock Pathway through which cam surface 126 passes in the case of correct alignment, allowing the pathway of the pusher 122 to pass the catch of cam surface 126 of the IP lock gauge 144 thus advancing the projectile 30 forward in the dart chamber 119 of drum 114. The described IP lock gauge 144 is able to unlock or unlock the pusher 122 respectively based on alignment or misalignment thereof.

Referring now to FIGS. 17A and 17B, the apparatus 110 is shown in a pre-time step 0' with slight pressure on the trigger 118. The projectile 30 is in the next chamber to be fired. The gear teeth 152 are engaged with gear teeth 154 found inside dart drum 114. The gear teeth 152 are engaged with gear teeth 154 with a peak to valley engagement for drum 114 and projectile 30 realignment should an individual projectile be inserted too far, for realigning the dart tip with respect to the dart backstop 150 as the drum 114 structure translates. The follower 102 is now in contact with the dart drum ramps 104 initiating advancing drum 114.

Referring now to FIGS. 18A and 18B, the apparatus 110 is shown in time step 0 for a Dart Depth Check, follower 102 in contact with the dart drum ramps 104 advanced drum 114 such that the element 144 has translated up and atop the projectile 30 nub portion 35 wherein the projectile 30 is in the next chamber to be fired and is now midway to getting behind the pusher 122. It will be noted that gear teeth 152 are disengaged with gear teeth 154 found inside dart drum 114 as valley to valley, not valley to peak as between gear teeth 152 and gear teeth 154 therein. At this point dart drum 114 at 156 has backed away from the dart backstop 150. Where projectile 30 may have been over inserted with dart tips expanded, tips can now rebound. With tips under no compression from over insertion the dart drum 114 returns to being closer to the dart backstop 150. Now tips hit backstop ensuring projectile 30 nub portion 35 is in the correct location for sensing.

Referring now to FIGS. 19A, 19B and 19C, the apparatus 110 is shown in time step 1 as About to Check with slight pressure on the trigger to remove slack and have IP lock gauge 144 in contact with projectile 30 nub portion 35, as the dart lines up with the firing location. The projectile 30 nub portion 35 has no pressure on it yet, while IP detector Dart Depth Check is performed with the IP lock gauge 144 touching the outer diameter (OD) of the nub portion 35 on the back of the projectile 30. IP detector IP lock gauge 144 is lined up with the unlock pathway 125 on the pusher 122 but has not yet moved.

Referring now to FIGS. 20A and 20B, the apparatus 110 is shown in time step 2 for Checked and Pushing with slight pressure on the projectile 30. The IP detector IP lock gauge 144 has entered the unlock pathway 125 and is now clear to allow pusher 122 to advance, while having IP detector IP lock gauge 144 ride the pusher 122 so as to reset after the projectile 30 has been launched. As such the IP lock gauge 144 will continue to fall past where it was when it checked for the nub portion 35. Below the IP lock gauge 144 contact face that was touching the nub 35 is now below the location it was during the dart check.

Referring now to FIG. 21, the apparatus 110 is shown in time step 3 for advancing the projectile 30 into flywheels 146, 148 with full pressure on the trigger to push dart into flywheels 146, 148. It will be appreciated that IP detector IP lock gauge 144 is at its lowest state waiting to ride up follower housing 120 when trigger returns. When trigger 118 pressure is removed, apparatus will rest to pre-Time step 0.

Referring now to FIGS. 22A and 22B, the apparatus 110 is shown as Time Step A inasmuch as the apparatus cannot proceed to a later step following the IP lock gauge 144 being improperly translated in the absence of a verified projectile, catching and locking the pathway so as to prevent advancing of the projectile 30 in view of catch at the gauge preventing advancing at FIG. 22B. With cam surfaces 125, 126 locked with full pressure on the trigger 118, the follower 102 is nonetheless de-coupled and may still advance the dart drum projectile retaining element 114 without launching any objects, despite loading of inappropriate objects, or a non-authorized dart which does not have IP bump being without nub portion 35. IP lock gauge 144 is thus able to lock pusher 122 due to IP lock gauge 144 at the catch of the cam 126 with the pusher 122 latch.

The toy launch apparatus and methods with multiple improvised projectile checking and locking features, further include the appropriate size projectile positioned at the projectile barrel assembly adjacent the projectile receiving opening at the improvised projectile checking housing assembly thereof; and the improvised projectile checking housing assembly allows the appropriate size projectile with the corresponding step present at the projectile receiving opening of the improvised projectile checking housing assembly and preventing another projectile from the projectile receiving opening. A projectile retaining element having a front side and a backside on the toy launch apparatus for receiving projectiles therein at the backside of the projectile retaining element; a projectile propelling mechanism forward the projectile retaining element for propelling the received projectiles from the front side of the projectile retaining element; an improvised projectile checking lock gauge supported with the toy launch apparatus rearward the projectile retaining element where the gauge is disposed to translate alongside the projectiles received at the backside of the projectile retaining element for checking the outer diameter of received projectiles; a follower housing configured to reciprocate adjacent and rearward the backside of the projectile retaining element and towards the front side thereof; a linkage in the toy launch apparatus for moving the follower housing; a pusher coupled to the follower housing for advancing projectiles received at the backside of the projectile retaining element; and a catch at the gauge preventing advancing of the projectile forward in the projectile retaining element.

The pathway at the pusher cooperatively positioned in relation to the catch at the gauge where the gauge having translated alongside the projectile to confirm the outer diameter of a verified projectile allows the pathway of the pusher to pass the catch of the gauge and advance the projectile forward in the projectile retaining element; and at least one latch at the pusher positioned to lock in relation to the catch of the gauge with the gauge improperly translated rearward the projectile retaining element in the absence of a verified projectile preventing the pathway of the pusher to pass the catch of the gauge and preventing advancing of the projectile forward in the projectile retaining element.

The cam surface translates the gauge with the follower housing configured to reciprocate with the linkage moving the follower housing where the catch at the gauge locks the pusher in relation to alignment having the pathway at the pusher cooperatively positioned in relation to the catch at the gauge with the gauge having translated. A cam surface to translate the gauge with the follower housing configured to reciprocate with the linkage moving the follower housing; a pathway at the pusher cooperatively positioned in relation to the catch at the gauge where the gauge having translated alongside the projectile to confirm the outer diameter of a verified projectile allows the pathway of the pusher to pass the catch of the gauge and advance the projectile forward in the projectile retaining element; and at least one latch at the pusher positioned to lock in relation to the catch of the gauge with the gauge improperly translated rearward the projectile retaining element in the absence of a verified projectile preventing the pathway of the pusher to pass the catch of the gauge and preventing advancing of the projectile forward in the projectile retaining element.

Toy Projectile

Referring to FIG. 23, a toy projectile 200 in accordance with embodiments generally includes a tip 202 attached to or disposed on a body 204. The tip 202 can be removable attached to or permanently attached to the body 204. The body 204 extends from a first end 201 to a second end 203. The tip 202 can be attached to the first end and the second end 203 can be a rear end. In various embodiments, as illustrated in FIG. 23, the toy projectile 200 can include further body structures such as one or more stepped fins 206 and a rearwardly projecting nub 208. In other embodiments, the body 204 can be a cylindrical or other shaped structure without such additional body structures. Suitable body shapes can include cylindrical, hexagonal, pentagonal, octagonal, or other faceted shape.

In accordance with embodiments, the body 204 that is made from an expanded beaded polyolefin materials. However, it is also contemplated herein that other non-beaded foam materials could be used.

Referring to FIGS. 24A-24D, the use of an expanded beaded material provides a body 204 that includes a plurality of closed cell structures 210. Each cell represents an expanded bead of material. Without intending to be bound by theory, it is believed that a closed-cell foam material can aid in improving accuracy and precision of the dart by improving rigidity through absorption and transfer of a rearward launch energy through the cellular structure during use as compared to, for example, open cell materials. In embodiments, the projectile can have a closed cell foam material optionally with further surface treatments to further enhance the flight characteristics such as reduced drag.

Expanded beaded materials can be shaped into the desired projectile configuration using known methods, including molding methods. The projectile can be a dart, an arrow, a ball, a disc, or any other known projectile configuration. In accordance with embodiments, the expanded beaded material can be an expanded beaded polyolefin, and/or expanded beaded thermoplastic polyolefins. For example, the expanded beaded material can be an expanded beaded polypropylene, expanded beaded polyethylene, expanded beaded polystyrenes, expanded beaded thermoplastic polyurethane, expanded beaded polylactic acid, and combinations thereof. In embodiments, the beaded material to be expanded can be solid or hollow or a combination of solid and hollow beads can be used. In embodiments, the body 204 includes expanded beads expanded an average amount of their original size by about 25× to 45×, about 30× to about 35×, about 35× to about 45×, or about 20× to about 30×. Other suitable average expansion amounts include about 20, 21, 22, 23, 24, 25, 26, 27, 28, 29, 30, 31, 32, 33, 34, 35, 36, 37, 38, 39, 40, 41, 42, 43, 44, or 45 times their original size. Other suitable expansion amounts can be determined as known in the art for a given specific expanded material.

In various embodiments, the body 204 can be provided as a solid structure of expanded beaded material. It has been advantageously found that due to the reduction in overall mass provided by the expanded beaded material, solid structures can be provided as opposed to conventional hollow structures. However, it is also contemplated herein that the body can be a hollow structure formed from an expanded beaded material. In embodiments in which the body includes or is a hollow expanded beaded material, it has been found that it can be advantageous to select a thickness of the wall of the hollow body to be at least 2 bead width thick to ensure sufficient structural rigidity and adhesion between beads during the molding process to avoid breakage during use and particularly repeated use.

It is also contemplated as shown in FIG. 26, that the body can include a hollow portion and solid core 218 inserted into the hollow portion 220. In embodiments, one or both of the solid core and the hollow portion can be made from an expanded beaded foam material. In embodiments, such as illustrated in FIG. 26, the solid core 218 can extend outwardly from the hollow portion 220 of the body, such that the hollow portion 220 surrounds a portion of the solid core 218. The overall length of the extension can be varied depending on the overall desired length of the projectile 200, and needed compatibility with the particular launching apparatus with which the projectile 200 is to be used.

In embodiments in which the body 204 includes a core inserted into and surrounded by a hollow portion, the density or mass of the body is to be understood herein as the combined density or mass of the solid core 218 and the hollow portion 220—that is the entire body structure whether provided as separate or unitary pieces.

The body 204 can have a variety of shapes. The shape of the body 204 can be tailored for the desired use. For example, toy projectiles can be shaped for insertion into a particular launch apparatus and/or play pattern.

As compared to conventional extruded materials used for toy projectile formation, formation of the projectiles in accordance with embodiments using expansion of beads of material in mold cavity can allow a variety of the shapes and features to be included on the projectiles that can be produced, particularly when producing a unitary structure. Additional elements such as fin structures and other potentially flight enhancing structures can be incorporated into a mold used for making the projectile from the expanded material. Expansion of the beads within the mold can allow for formation of additional body structures while maintaining adherence to the main body structure to prevent these additional structures from being broken, torn, separated from the body, or otherwise damaged during use. In various embodiments, the mold can have a polished interior surface, which can translate to a smooth surface finish on the molded product. In various embodiments, the smoothness achieved through molding can be sufficient. In other embodiments, surface coatings as are known in the art can be added if desired.

In various embodiments, projectile 200 can have a mass including the body and the tip of about 0.5 g to about 3 g, about 1.3 g to about 1.4 g, about 1 g to about 1.5 g, or about 1 g to about 2 g. Other suitable masses include about 0.5, 0.6, 0.7, 0.8, 0.9, 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, and 30 g.

In various embodiments, the body 104 made from an expanded beaded material can have a density of about 20 $kg/m^3$ to about 30 $kg/m^3$, about 26 $kg/m^3$ to about 28 $kg/m^3$, about 22 $kg/m^3$ to about 30 $kg/m^3$, or about 24 $kg/m^3$ to about 29 $kg/m^3$. Other suitable densities include about 20, 21, 22, 23, 24, 25, 26, 27, 28, 29, and 30 $kg/m^2$. In embodiments, the density is 27.7 $kg/m^3$. The reduced density of the toy projectile 100 can allow, in various embodiments, the projectile 100 to be launched at higher rates of speed while maintaining safe use as a toy, as evaluated by ASTM F963-16 (2016). The standard incorporates a maximum value of the kinetic energy density requirement, which is calculated by the following equation:

$$KED = \frac{\frac{1}{2}\text{mass} * \text{velocity}^2}{\text{impact area}}$$

Reduction of the mass of the toy projectile aids in overall reduction of the KED, which in turn allows the projectiles to travel at higher velocity while maintaining acceptable KED for toy safety. In various embodiments, high velocity can correlate to increased flight distances.

It has been found, however, that simply reducing the overall mass of the projectile, while allowing increased velocity within a given range of KED does not necessarily result in a projectile with desired flight characteristics, such as stability of flight path, accuracy of striking an intended target, and repeatability of accuracy (precision). In fact, based on a reduction of mass alone, one might expect reduced flight properties, as the projectile may be more susceptible to external forces during flight and/or instability upon exiting a launcher.

Referring to FIG. 25, in embodiments, the tip 202 can include an internal projection 212 that is designed to centrally add mass and raises the center of gravity of the tip 202. In various embodiments, the tip 202 can further include additional internal projections 212 on the internal side walls. In embodiments, these projections can enable attachment of tip 202 to dart body with an adhesive, for example. It has been advantageously found that the inclusion of an internal projection to increase mass of the tip results in positioning of the center of gravity of the projectile closer to the tip 202, given the lightweight nature of the body 204. This in turn provides a significant distance between the center of gravity of the projectile 200 and the center pressure of the projectile. In embodiments, the center of pressure is near the midpoint of the projectile. Without intending to be bound by theory, it is also believed that using a beaded foam material having a closed cellular structure can improve rigidity of the dart and stabilize the movement of the dart inside of a barrel of a launch apparatus, and flight path of the dart as it exits the launcher. Further, it is believed that the cellular structure does not absorb the launch energy and does not deform under such force and instead converts the launch energy to acceleration energy of the projectile. These benefits of improved rigidity and/or reduction of internal absorption of the launch energy to avoid deformation can result in improved precision.

It has been advantageously found that desired flight characteristics such as accuracy and/or precision, can be achieved in various embodiments by balancing a density of the body against the density of the tip 202 and having an increase mass in the tip. In embodiments, the ratio of the tip 202 density to the body 204 density can be about 25:1 to about 50:1. In embodiments, the ratio of the tip density to the body density can be about 30:1 to about 40:1, about 25:1 to 30:1, about 35:1 to 38:1 or about 35:1 to about 40:1. In embodiments, the ratio is about 37:1.

In embodiments, the density of the body 204 can have an increased density at the second end 203 as compared to the first end 201. In embodiments, the body 204 can have a gradient density increasing from the first end 201 to the second end 202. Differences and/or gradients of density can be provided by any variety of means, including but not limited to during a molding process or by addition of structures or other materials at or near the second end 202 after molding.

As further seen in FIG. 25, the tip can also include an internal chamber into which these projections extend. The internal chamber 214 is vented by one or more vent holes 216 disposed in the tip 202. The vent holes 216 can be positioned variously on the tip 202 so long as they are in fluid communication with the internal chamber 214. The vent holes 216 allow air from within the internal chamber 214 to escape upon impact of the tip against a surface, to thereby allow the outer walls of the tip 202 to expand outwardly such that the tip 202 impact area expands upon contact. This allows for increased impact area, which can further aid in keeping a KED within toy safety standard, while allowing the projectile to be launched with increase velocity.

In various embodiments, the tip 202 is formed of a flexible material that allows the tip to expand significantly upon impact, thereby providing a large impact area over which the force of impact is distributed. In embodiments, the tip is formed from a rubbery material having a Shore A hardness of about 20 to about 50, about 30 to about 40, about 25 to about 35, or about 35 to about 50. Other suitable Shore A hardness values include about 20, 25, 30, 35, 40, 45, and 50. In embodiments, the tip is made from a thermoplastic rubber (TPR).

In various embodiments, the tip 202 can have an impact area of about 250 $m^2$ to about 400 $m^2$, about 275 $m^2$ to about 325 $m^2$, about 290 $m^2$ to about 310 $m^2$. Other suitable values include about 250, 260, 270, 280, 290, 300, 310, 320, 330, 340, 350, 360, 370, 380, 390, and 400 $m^2$.

Referring to again to FIG. 23, in embodiments, the toy projectile can include rearward stepped fins and nub portions as part of the body. In other embodiments, the toy projectile can include a rearward stepped portion and nub, with no fins. In yet further embodiments, the toy projectile can be free of a stepped portion and include a taper from a width of the body to the width of the nub.

The toy projectile can have any suitable size. For example, the toy projectile can have an overall length of about 50 mm to about 100 mm, about 60 mm to about 80 mm, or about 75 mm to about 80 mm. Other suitable lengths include about 50, 52, 54, 56, 58, 60, 62, 64, 66, 68, 70, 72, 74, 76, 78, 80, 81, 82, 83, 84, 85, 86, 87, 88, 89, or 100 mm. For example, the toy projectile can have an overall length of about 61 mm. For example, the toy projectile can have an overall length of about 62 mm. For example, the toy projectile can have a length of about 69 mm.

In embodiments, the toy projectile can have a body that has a length as defined between the first and second ends of about 40 mm to about 65 mm, about 45 mm to about 55 mm, about 50 mm to about 60 mm. Other suitable body lengths include about 40, 41, 42, 43, 44, 45, 46, 47, 48, 49, 50, 51, 52, 53, 54, 55, 56, 57, 58, 59, 60, 61, 62, 63, 64, or 65 mm.

In embodiments, the body can have a cylindrical shape. In embodiments, the body can include a reduced diameter portion 205 at the first end 201 for over which the tip 202 can be disposed and attached to the body. Reference herein to a diameter of the body is made to the general and overall diameter of the body, which can be measured at a central portion of the body. The reduced diameter portion has a diameter reduced with respect to the overall diameter of the body. For example, the overall diameter (or diameter at a central portion of the body) can be about 10 mm. For example, the overall diameter can be the diameter of the body measured at a point at which the diameter is at its maximum. In embodiments, as illustrated in FIG. 32A, for example, the fins extending from the body can be arranged on a tapered diameter portion of the body such that the outer circumference of the fins has the same or substantially the same diameter as the overall diameter of the body (not including a reduced tip portions). For example, the body having the taper can have a boat tail structure. In such embodiments, when considering the circumference defined by the outrebounds of the fins, the body has a substantially uniform diameter except optionally for a reduced diameter portion at the first end to accommodate the tip. The nub portion, which can be a terminal end of the boat tail structure of the body or a separate or other integrally formed structure can have a reduced diameter as compared to the body diameter, as described herein.

For example, the body can have a diameter of about 10 mm to about 20 mm, about 14 mm to about 18 mm, about 15 mm to about 17 mm, or about 16 mm. Other suitable diameters may include about 10, 10.5, 11, 11.5, 12, 12.5, 13, 13.5, 14, 14.5, 15, 15.5, 16, 16.5, 17, 17.5, 18, 18.5, 19, 19.5, or 20 mm. The diameter can be measured as a maximum diameter of the body. In embodiments, the diameter of the body can remain substantially constant between at least a central portion of the body and the fin region when accounting for the circumferential dimension defined by the outer surfaces of the fins.

The body can include a nub portion extending from the second end. The nub portion can have a length extending between a first nub end and a second nub end. The first nub end can be continuous with the second end of the body. In embodiments, the body can have a boat tail structure at the second end that tapers and terminates in the nub portion having a reduced diameter as compared to the diameter of the body upstream of the boat tail structure. In such embodiments, the nub portion may not be considered as having a defined second nub end, but rather is provided as a continuous extension of the body. Also in such embodiments, the body having the boat tail structure can have a second end which is the terminal end of the projectile and thus is positioned at the end of the nub portion. The body, thus, has a reduced diameter portion, which defines the nub portion, as a tapered reduction from a point adjacent to the second end to the second end. As described in the paragraph above, the body can also have in such embodiments a reduced diameter portion at the first end for accommodating the tip. The diameter of the body in such boat tail embodiments is considered as measured at a position of the body in which the diameter is at a maximum, not including any extensions from the body such as fins, and the diameter of the nub is considered to be the diameter at the second end.

In embodiments, the body can have a substantially cylindrical shape with fins disposed at the second end and a nub portion 208 extending from the second end. The fins can be spaced uniformly around the circumference of the body and the portion of the body disposed in the space between fins can be tapered inwardly along a length of the fins towards the nub portion. That is, the portion of the body in the spacing can taper from a first diameter corresponding to the diameter of the body upstream of the fins to a second, reduced diameter corresponding to a diameter of the nub portion 208. Such taper can give the projectile the appearance of a boat tail structure at the second end, which terminates at the nub portion, and with the fins extending outwardly from the boat tail structure upstream of the nub portion. Without intending to be bound by theory, it is believed that the combination of the boat tail structure with the fins can result in improved flight characteristics, including but not limited to flight distance and flight stability.

The nub portion, for example, can be sized to interact with a housing structure of a toy projectile launch apparatus to ensure an appropriately sized projectile is being used with the given apparatus. Referring to FIGS. 27-31, the nub portion can have any suitable size and shape so long as it is of sufficient diameter to fit within the housing structure. In embodiments, the nub portion has a minimum length corresponding to a length of the housing structure through which the nub portion must pass to engage with a locking or other interfacing structure of the apparatus. Shapes of the nub portion include, but are not limited to, circular, elliptical, star, hexagonal, triangular, and rectangular. In embodiments, the nub portion has side walls, which taper to connect with the base from which the nub portion extends. In other embodiments, the nub portion does not taper with respect to the base from which it extends. In embodiments, the side walls of the nub portion are entirely connected to and in contact with the base. In other embodiments, the nub portion connects to the base at a point or a line, such that there is at least one gap between the nub portion and the base.

In embodiments, the nub portion terminates at a second end and has a flat or substantially flat surface at the second end. For example, a substantially flat surface may have some rounding or doming or mold markings from the manufacturing process such as minor indentations or dimples, but otherwise visually appears to be generally planar. For example, the terminal surface can be free of gaps, openings, apertures, notches, or the like.

In embodiments, for a toy projectile such as shown in FIG. 32, the nub portion 108 can have a length as defined between the second end or a fin end and an oppositely disposed end of the nub of at least about 1 mm to at least about 5 mm, about 2 mm to about 4 mm, about 3 mm to about 3.5 mm. For example, the nub portion 108 can have a length of about 1, 1.1, 1.2, 1.3, 1.4, 1.5, 1.6, 1.7, 1.8, 1.9, 2, 2.1, 2.2, 2.3, 2.4, 2.5, 2.6, 2.7, 2.8, 2.9, 3, 3.1, 3, 1.75, 3.2, 3.3, 3.4, 3.5, 3.6, 3.7, 3.8, 3.9, 4, 4.1, 4.2, 4.3, 4.4, 4.5, 4.6, 4.7, 4.8, 4.9, or 5 mm.

In embodiments, the ratio of the length of the body to the length of the nub can be about 12:1 to about 20:1, about 15:1 to about 18:1, about 17:1 to about 18:1, or about 15:1 to about 17:1. Other suitable ratios include, about 12:1, 13:1, 14:1, 15:1, 16:1, 17:1, 18:1, 19:1, and 20:1. For example, the ratio can be about 17.25:1. In an embodiment, the toy projectile can have a total length of about 60 mm to about 70 mm and the nub can have a length of about 3 mm to about 5 mm.

In embodiments, a length of the nub portion 108 may be irrelevant and longer lengths, for example of 10 mm or more, may be suitably used with toy projectile launchers having a IP detection system as detailed below so long as the nub portion 108 has a suitable diameter (or effective diameter) to fit within and engage with a locking or other interfacing structure of an IP detection system.

In embodiments for use with a toy projectile launcher such as shown in FIG. 32, the nub portion 108 may have a diameter of about 2 mm to about 8 mm, about 3 mm to about 7 mm, about 4 mm to about 8 mm, or about 5 mm to about 7 mm. Other suitable diameters include about 2, 2.1, 2.2, 2.3, 2.4, 2.5, 2.6, 2.7, 2.8, 2.9, 3, 3.1, 3, 1.75, 3.2, 3.3, 3.4, 3.5, 3.6, 3.7, 3.8, 3.9, 4, 4.1, 4.2, 4.3, 4.4, 4.5, 4.6, 4.7, 4.8, 4.9, 5.1, 5.2, 5.3, 5.4, 5.5, 5.6, 5.7, 5.8, 5.9, 6, 6.1, 6.2, 6.3, 6.4, 6.5, 6.6, 6.7, 6.8, 6.9, 7, 7.1, 7.2, 7.3, 7.4, 7.5, 7.6, 7.7, 7.8, 7.9, or 8 mm.

In embodiments, a toy projectile launcher having an IP detection system may identify a step between a second end of the projectile and the nub portion. The step can be defined by a difference in diameter between at the second end or fin end and the nub portion. In embodiments, the difference between the diameter at the second end or fin end and the diameter of the nub can be about 0.5 mm to about 3 mm, about 1 mm to about 2 mm, about 1 mm to about 3 mm, or about 0.7 mm to about 1.6 mm. Other suitable differences in diameter include about 0.5, 0.6, 0.7, 0.8, 0.9, 1, 1.1, 1.2, 1.3, 1.4, 1.5, 1.5875, 1.6, 1.7, 1.8, 1.9, 2, 2.1, 2.2, 2.3, 2.4, 2.5, 2.6, 2.7, 2.8, 2.9, 3.

In embodiments, a toy projectile in accordance with the disclosure can have a ratio of the diameter of the body (at a maximum width of the body) to the diameter of the nub portion of about 10:1 to about 1.25:1, about 5:1 to about 2.5:1, about 3:1 to about 2:1, about 10:1 to about 5:1. Other suitable amounts include about 10:1, 9.5:1, 9:1, 8.5:1, 8:1, 7.5:1, 7:1, 6.5:1, 6:1, 5.5:1, 5:1, 4.75:1. 4.5:1, 4.25:1, 4:1, 3.75:1, 3.5:1, 3.25:1, 3:1, 2.75:1, 2.5:1, 2.25:1, 2:1, 1.75:1, 1.5:1, or 1.25:1.

In embodiments, the body can include rearward fins. Any suitable number of fins can be included on the body. For example, the projectile can include 6 fins spaces to surround the circumference of the body. Other fin numbers are contemplated. The fins can be disposed at the second end and can terminate in a fin end from which the nub projection then extends to define a step between the fin end and the nub projection. The fins can also have various cross sectional shapes and can be for example rounded or faceted in various embodiments. Advantageously, using a molded expanded material, the fins can be made as a unitary piece with the body. In embodiments, however, it is also contemplated that the fins are attached to the body using and known methods, including heat sealing, adhesives, tapes, etc. Referring to FIG. 23, the rear fins can have a generally rounded shape or a half-cylindrical shape with the top of the fin having a rounded shape. Alternatively, referring to FIGS. 32A and 32B, the rear fin structures can have more linearly defined edges, with the top of the fin being flat.

In embodiments, the projectile 200 can include a stepped end and a nub 208, such that when the stepped end and nub are present at a projectile receiving opening with a corresponding step for allowing rearward stepped structure and nub portion of appropriate projectiles at the projectile receiving opening, such that detection checks are triggered. As used herein "nub" and "nub portion" refer to the same feature.

In embodiments, a toy projectile system can include a toy projectile having a stepped and nub and a toy projectile launch apparatus having a projectile receiving opening and improvised projectile checking housing assembly that can identify the toy projectile as compatible for the blasters.

Aspects

Aspect 1. A projectile, comprising:

a body extending between a first end and an oppositely disposed second end, wherein at least a portion of the body is formed from an expanded beaded material;

a tip attached to the body at the first end, the tip comprising an internal projection extending into an internal cavity, and one or more vent holes in fluid communication with the internal chamber, wherein a ratio of a density of the body to a density of the tip is about 20:1 to about 40:1.

Aspect 2. A projectile, comprising:

a body extending between a first end and an oppositely disposed second end, wherein at least a portion of the body is formed from an expanded beaded material, the body having an insert receiving opening extending into the body from the first end and extending less than an entirety of a length of the body;

a tip attached to the body at the first end, the tip having an internal cavity; and an insert having a first end extending into the internal cavity and a second end extending into the insert receiving opening, wherein a ratio of a density of the body to a density of the tip is about 20:1 to about 40:1.

Aspect 3. A projectile, comprising:

a body extending between a first end and an oppositely disposed second end, wherein at least a portion of the body is formed from an expanded beaded material, the body having an insert receiving opening extending into the body from the first end and extending less than an entirety of a length of the body; and a tip having an insert projection, the insert projection extending into the insert receiving opening of the body, wherein a ratio of a density of the body to a density of the tip is about 20:1 to about 40:1.

Aspect 4. The projectile any one of the preceding aspects, wherein the expanded beaded material is one or more of expanded beaded polyethylene, expanded beaded polypropylene, expanded beaded polystyrene, expanded beaded thermoplastic polyurethane, and expanded beaded polylactic acid.

Aspect 5. The projectile of any one of the preceding aspects, wherein the body further comprises one or more fins disposed at or adjacent to the second end of the body.

Aspect 6. The projectile of aspect 5, wherein the body comprises 4 fins.

Aspect 7. The projectile of aspect 5, wherein the body comprises 6 fins.

Aspect 8. The projectile of any one of the preceding aspects, wherein the body further comprises a nub extending outwardly from the second end, wherein the nub has a diameter that is less than a diameter of the body at a second end.

Aspect 9. The projectile of aspect 8, wherein the nub extends about 4 mm from the second end.

Aspect 10. The projectile of aspect 8 or 9, wherein a step is disposed between the second end and the nub.

Aspect 11. The projectile of aspect 10, comprising a taper wall connecting the step and the nub.

Aspect 12. The projectile of aspect 11, wherein the taper is about 100°.

Aspect 13. The projectile of aspect 12, comprising a non-tapered wall connecting the step and the nub.

Aspect 14. The projectile of any one of the preceding aspects, wherein the body is solid.

Aspect 15. The projectile of any one of aspects 1 to 13, wherein the body comprises a hollow portion and a solid core disposed in the hollow portion, wherein the solid core is formed from the expanded beaded material.

Aspect 16. The projectile of any one of aspects 1 to 13, wherein the body comprises a hollow portion extending into the body from the second end to the first end, the hollow portion extending less than an entirety of the length of the body.

Aspect 17. A toy projectile, comprising:

a body having a length extending between a first end to an oppositely disposed a second end, wherein the body has a substantially cylindrical shape;

a nub portion extending from the second end, the nub portion having a diameter smaller than a diameter of the body at the second end, such that a step is defined between the second end and the nub portion, wherein the nub portion has a length extending between a first nub end and a second nub end, the first nub end is continguous with the second body, and the second nub end terminates in a flat or substantially flat surface;

a tip attached to the body at the first end;

one or more fins attached to or integrally formed with the body at the second end upstream the nub portion.

Aspect 18. The toy projectile of aspect 17, wherein a ratio of the body length to the nub portion length is about 12:1 to about 20:1.

Aspect 19. A toy projectile, comprising a body extending from a first end to a second end, wherein the body has a boat tail structure, such that a diameter of the body tapers from a maximum body diameter towards the second end to define a nub portion having a nub diameter less than the maximum body diameter;

one or more fins disposed on the body adjacent the second end around a circumference of the body, wherein an outer circumference is defined by the outer surface of the one or more fins and a diameter of the outer circumference is substantially the same as the maximum body diameter;

wherein the one or more fins terminate at fin ends upstream the nub portion, such that the nub portion extends outwardly defining a reduced circumferential portion as compared to an outer circumference defined by the one or more fins and a step is defined between the fin ends and the nub portion.

Aspect 20. The toy projectile of aspect 19, wherein a ratio of the maximum body diameter to the nub diameter is about 10:1 to about 1.25:1.

Aspect 21. The toy projectile of aspect 3, wherein a difference between the maximum body diameter and the nub diameter is about 0.5 mm to about 3 mm.

Aspect 22. A toy projectile, comprising:

a body extending from a first end to a second end;

a plurality of fins attached to or integrally formed with the body at the second end, wherein the body including the fins has a first diameter, each fin being separated from adjacent fins by a space, wherein a portion of the body disposed in the space is tapered inwardly along a length of the fin towards the second end;

a nub portion extending from the second end, wherein nub portion has a second diameter that is less than the first diameter; and a tip attached to the body at the first end.

Aspect 23. The toy projectile of aspect 22, wherein a ratio of the first diameter to the second diameter is about 10:1 to about 1.25:1.

Aspect 24. The toy projectile of aspect 22, wherein a difference between the first diameter and the second diameter is about 0.5 mm to about 3 mm.

Aspect 25. The toy projectile of any one of the preceding aspects, comprising 6 fins spaced to surround a circumference of the body.

Aspect 26. The toy projectile of any one of the preceding aspects, wherein the nub portion has a thickness defined between the fin end and an oppositely disposed end of the nub portion of about 1 to 5 mm.

Aspect 27. The toy projectile of any one of the preceding aspects, wherein the nub portion comprises a circumferential wall joining a first nub end at the second end and an oppositely disposed second nub end, wherein the circumferential wall tapers inwardly from the first nub end to the second nub end.

Aspect 28. The toy projectile of aspect 22, wherein the circumferential wall has a taper of about 100°.

Aspect 29. The toy projectile of any one of the preceding aspects, wherein the nub portion comprises a circumferential wall joining a first nub end at the second end and an oppositely disposed second nub end, wherein the circumferential wall is a straight non-tapered wall.

Aspect 30. The toy projectile of any one of the preceding aspects, wherein the body has a length defined between the first and the second end of about 50 mm to about 100 mm.

Aspect 31. The toy projectile of any one of the preceding aspects, wherein the body has a reduced diameter portion at the first end and the tip is sized to fit over the reduced diameter portion.

Aspect 32. The toy projectile of any one of the preceding aspects, wherein the body is formed from an expanded beaded material.

Aspect 33. The toy projectile of aspect 16, wherein the expanded beaded material is one or more of expanded beaded polyethylene, expanded beaded polypropylene, expanded beaded polystyrene, expanded beaded thermoplastic polyurethane, and expanded beaded polylactic acid.

Aspect 34. The toy projectile of any one of the preceding aspects, wherein the length of the body is about 60 mm to about 70 mm, and the length of the nub portion is about 3 mm to about 5 mm.

Aspect 35. A toy launch apparatus with multiple improvised projectile checking and locking features, comprising:

a projectile retaining element on the toy launch apparatus;

a projectile barrel assembly extending rearward the projectile retaining element with an improvised projectile checking housing assembly of the projectile barrel assembly movable between checking and non-checking positions;

an elongated structure in the improvised projectile checking housing assembly to check the step structure;

a step structure of the projectile barrel assembly having a projectile receiving opening at the improvised projectile checking housing assembly thereof for allowing an appropriate size projectile with a corresponding step present at the projectile receiving opening of the improvised projectile checking housing assembly and preventing another projectile from the projectile receiving opening;

an improvised projectile button positioned at the end of the elongated structure; and an improvised projectile checking spring mounted to the improvised projectile button with the end of the elongated structure, the improvised projectile button of the elongated structure movable between checking and non-checking positions and preventing movement thereof unless the appropriate size projectile is present at the projectile receiving opening of the improvised projectile checking housing assembly.

Aspect 36. The toy launch apparatus of aspect 35, comprising:

a first sidewall to the improvised projectile checking housing having a first catch latch aperture rearward from the projectile receiving opening to the improvised projectile checking housing assembly; and a second sidewall to the improvised projectile checking housing having a second catch latch aperture rearward from the projectile receiving opening to the improvised projectile checking housing assembly, with the elongated structure between the first and second sidewalls thereof, the elongated structure having proximal and distal ends thereof and a catch latch recess therebetween proximal the projectile receiving opening of the improvised projectile checking housing assembly to check the step structure, and mounting the improvised projectile checking spring to the distal end of the elongated structure and inside the improvised projectile checking housing assembly, the improvised projectile button of the elongated structure movable between checking and non-checking positions.

Aspect 37. The toy launch apparatus of aspect 36, comprising:

a trigger assembly for movement of the improvised projectile checking housing with the improvised projectile button from the elongated structure proximal end with the improvised projectile checking spring towards the projectile receiving opening of the improvised projectile checking housing assembly; and a locking key structure positioned rearward from the projectile receiving opening to the improvised projectile checking housing assembly, intermediate the proximal and distal ends of the elongated structure, and opposing the first and second catch latch apertures of the first and second sidewalls for preventing further movement of the improvised projectile checking housing unless the appropriate size projectile is present at the projectile receiving opening of the improvised projectile checking housing assembly.

Aspect 38. The toy launch apparatus of aspect 35, further comprising:

an energy generating mechanism; and a motor driving rotation of the energy generating mechanism for motor driven projectile propelling flywheels.

Aspect 39. The toy launch apparatus of aspect 35, wherein: the elongated structure in the improvised projectile checking housing assembly further comprises an pneumatic air piston cylinder having an improvised projectile safety valve seat.

Aspect 40. The toy launch apparatus of aspect 39, wherein: the improvised projectile button further comprises a safety valve contact positioned at the end of the elongated structure, with the improvised projectile checking spring mounted to the safety valve contact with the end of the piston cylinder, the safety valve contact of the elongated structure movable between checking and non-checking positions and preventing movement thereof unless the appropriate size projectile is present at the projectile receiving opening of the improvised projectile checking housing assembly.

Aspect 41. The toy launch apparatus of aspect 35, wherein: the appropriate size projectile comprises a rearward step structure sized to correspond with step structure of the projectile barrel assembly.

Aspect 42. The toy launch apparatus of aspect 41, wherein: the appropriate size projectile is positioned at the projectile barrel assembly adjacent the projectile receiving opening at the improvised projectile checking housing assembly thereof.

Aspect 43. The toy launch apparatus of aspect 42, wherein: the improvised projectile checking housing assembly allows the appropriate size projectile with the corresponding step present at the projectile receiving opening of the improvised projectile checking housing assembly.

Aspect 44. The toy launch apparatus of aspect 41, wherein: the appropriate size projectile comprises a plurality of fins for positioning at the projectile barrel assembly adjacent the projectile receiving opening.

Aspect 45. The toy launch apparatus of aspect 41, wherein: the appropriate size projectile comprises a rearward nub for positioning in the opening at the improvised projectile checking housing assembly.

Aspect 46. A method for making a toy launch apparatus with multiple improvised projectile checking and locking features, comprising the steps of:

forming a projectile retaining element to the toy launch apparatus;

engaging a projectile barrel assembly extending rearward the projectile retaining element with an improvised projectile checking housing assembly of the projectile barrel assembly movable between checking and non-checking positions;

mounting an elongated structure in the improvised projectile checking housing assembly to check the step structure; and mounting a step structure with the projectile barrel assembly having a projectile receiving opening at the improvised projectile checking housing assembly thereof for allowing an appropriate size projectile with a corresponding step present at the projectile receiving opening of the improvised projectile checking housing assembly and preventing another projectile from the projectile receiving opening.

Aspect 47. The method of aspect 46, comprising the steps of: positioning an improvised projectile button with the end of the elongated structure; and mounting an improvised projectile checking spring to the improvised projectile button with the end of the elongated structure, the improvised projectile button of the elongated structure movable between checking and non-checking positions and preventing movement thereof unless the appropriate size projectile is present at the projectile receiving opening of the improvised projectile checking housing assembly.

Aspect 48. The method of aspect 46, comprising the steps of: providing a first sidewall to the improvised projectile checking housing having a first catch latch aperture rearward from the projectile receiving opening to the improvised projectile checking housing assembly.

Aspect 49. The method of aspect 48, comprising the steps of:

providing a second sidewall to the improvised projectile checking housing having a second catch latch aperture rearward from the projectile receiving opening to the improvised projectile checking housing assembly, with the elongated structure between the first and second sidewalls thereof, the elongated structure having proximal and distal ends thereof and a catch latch recess therebetween proximal the projectile receiving opening of the improvised projectile checking housing assembly to check the step structure;

mounting the improvised projectile checking spring to the distal end of the elongated structure and inside the improvised projectile checking housing assembly, the improvised projectile button of the elongated structure movable between checking and non-checking positions;

mounting a trigger assembly for movement of the improvised projectile checking housing with the improvised projectile button from the elongated structure proximal end with the improvised projectile checking spring towards the projectile receiving opening of the improvised projectile checking housing assembly; and positioning a locking key structure rearward from the projectile receiving opening to the improvised projectile checking housing assembly, intermediate the proximal and distal ends of the elongated structure, and opposing the first and second catch latch apertures of the first and second sidewalls for preventing further movement of the improvised projectile checking housing unless the appropriate size projectile is present at the projectile receiving opening of the improvised projectile checking housing assembly.

Aspect 50. The method of aspect 46, comprising the steps of:

the appropriate size projectile is positioned at the projectile barrel assembly adjacent the projectile receiving opening at the improvised projectile checking housing assembly thereof; and the improvised projectile checking housing assembly allows the appropriate size projectile with the corresponding step present at the projectile receiving opening of the improvised projectile checking housing assembly and preventing another projectile from the projectile receiving opening.

Aspect 51. A toy launch apparatus with multiple improvised projectile checking and locking features, comprising:

a projectile retaining element having a front side and a backside on the toy launch apparatus for receiving projectiles therein at the backside of the projectile retaining element;

a projectile propelling mechanism forward the projectile retaining element for propelling the received projectiles from the front side of the projectile retaining element;

an improvised projectile checking lock gauge supported with the toy launch apparatus rearward the projectile retaining element where said gauge is disposed to translate alongside the projectiles received at the backside of the projectile retaining element for checking the outer diameter of received projectiles;

a follower housing configured to reciprocate adjacent and rearward the backside of the projectile retaining element and towards the front side thereof;

a linkage in the toy launch apparatus for moving the follower housing;

a pusher coupled to the follower housing for advancing projectiles received at the backside of the projectile retaining element; and a catch at said gauge preventing advancing of the projectile forward in the projectile retaining element.

Aspect 52. The toy launch apparatus of aspect 51, comprising: a pathway at the pusher cooperatively positioned in relation to the catch at said gauge where said gauge having translated alongside the projectile to confirm the outer diameter of a verified projectile allows the pathway of the pusher to pass the catch of said gauge and advance the projectile forward in the projectile retaining element; and at least one latch at the pusher positioned to lock in relation to the catch of said gauge with said gauge improperly translated rearward the projectile retaining element in the absence of a verified projectile preventing the pathway of the pusher to pass the catch of said gauge and preventing advancing of the projectile forward in the projectile retaining element.

Aspect 53. The toy launch apparatus of aspect 51, comprising: a cam surface to translate said gauge with said follower housing configured to reciprocate with the linkage moving the follower housing where the catch at said gauge locks the pusher in relation to alignment having the pathway at the pusher cooperatively positioned in relation to the catch at said gauge with said gauge having translated.

Aspect 54. The toy launch apparatus of aspect 51, comprising:

a cam surface to translate said gauge with said follower housing configured to reciprocate with the linkage moving the follower housing;

a pathway at the pusher cooperatively positioned in relation to the catch at said gauge where said gauge having translated alongside the projectile to confirm the outer diameter of a verified projectile allows the pathway of the pusher to pass the catch of said gauge and advance the projectile forward in the projectile retaining element; and at least one latch at the pusher positioned to lock in relation to the catch of said gauge with said gauge improperly translated rearward the projectile retaining element in the absence of a verified projectile preventing the pathway of the pusher to pass the catch of said gauge and preventing advancing of the projectile forward in the projectile retaining element.

Aspect 55. A toy projectile system, comprising:

a toy projectile comprising a body having first and second ends and a nub extending outwardly from the second end, the nub being sized to interact with an improvised projectile checking housing assembly of a toy projectile launching apparatus; and the toy projectile launch apparatus with improvised projectile checking and locking features, comprising:

a projectile retaining element;

a projectile barrel assembly extending rearward the projectile retaining element with the improvised projectile checking housing assembly of the projectile barrel assembly movable between checking and non-checking positions, the projectile barrel assembly comprising a step structure having a projectile receiving opening at the improvised projectile checking housing assembly thereof for allowing the toy projectile the nub present at the projectile receiving opening and preventing another projectile from the projectile receiving opening;

an elongated structure in the improvised projectile checking housing assembly to check the nub;

an improvised projectile button positioned at the end of the elongated structure; and an improvised projectile checking spring mounted to the improvised projectile button with the end of the elongated structure, the improvised projectile button of the elongated structure movable between checking and non-checking positions and preventing movement thereof unless the toy projectile having the nub is present at the projectile receiving opening of the improvised projectile checking housing assembly.

Aspect 56. A toy projectile system, comprising:

a toy projectile comprising a body having first and second ends and a nub extending outwardly from the second end, the nub being sized to interact with an improvised projectile checking housing assembly of a toy projectile launching apparatus; and the toy projectile launch apparatus with improvised projectile checking and locking features a projectile retaining element having a front side and a backside on the toy launch apparatus for receiving projectiles therein at the backside of the projectile retaining element;

a projectile propelling mechanism forward the projectile retaining element for propelling the received projectiles from the front side of the projectile retaining element;

an improvised projectile checking lock gauge supported with the toy launch apparatus rearward the projectile retaining element where said gauge is disposed to translate alongside the projectiles received at the backside of the projectile retaining element for checking the outer diameter of received projectiles;

a catch at said gauge preventing advancing of the projectile forward in the projectile retaining element.

Aspect 57. The system of aspect 56, wherein the projectile launch apparatus further comprises a follower housing configured to reciprocate adjacent and rearward the backside of the projectile retaining element and towards the front side thereof; a linkage in the toy launch apparatus for moving the follower housing; and a pusher coupled to the follower housing for advancing projectiles received at the backside of the projectile retaining element.

Aspect 58. The system of any one of aspects 55 to 57, wherein the nub portion has a diameter smaller than a diameter of the body at the second end, such that a step is defined between the second end and the nub portion.

Aspect 59. The system of any one of aspects 55-58, wherein the body has a boat tail structure at the second end, the boat tail structure tapering into the nub portion, and a plurality of fins surrounding a circumference of the body at the boat tail structure and extending outwardly such that a step is defined between the plurality of fins and the nub portion.

Aspect 60. The system of any one of aspects 55-59, wherein the toy projectile further comprises a plurality of fins attached to or integrally formed with the body at the second end, wherein the body including the fins has a generally cylindrical shaped with a first diameter, each fin being separated from adjacent fins by a space, wherein a portion of the body disposed in the space is tapered inwardly along a length of the fin towards the second end.

Aspect 61. The system of aspect 60, comprising 6 fins spaced to surround a circumference of the body and disposed upstream of the nub portion.

Aspect 62. The system of aspect 60 or 61, wherein an outer circumference of the toy projectile is defined by the outer surface of the one or more fins and a diameter of the outer circumference is substantially the same as the maximum body diameter Aspect 63. The system of any one of aspects 55-62, wherein the nub portion has a length defined between the second end and an oppositely disposed end of the nub portion of about 1 to 5 mm.

Aspect 64. The system of any one of aspects 55-63, wherein the nub portion comprises a circumferential wall joining a first nub end at the second end and an oppositely disposed second nub end, wherein the circumferential wall tapers inwardly from the first nub end to the second nub end.

Aspect 65. The system of aspect 64, wherein the circumferential wall has a taper of about 100°.

Aspect 66. The system of any one of aspects 55-65, wherein the nub portion comprises a circumferential wall joining a first nub end at the second end and an oppositely disposed second nub end, wherein the circumferential wall is a straight non-tapered wall.

Aspect 67. The system of any one of aspects 55-66, wherein the body has a length defined between the first and the second end of about 50 mm to about 100 mm.

Aspect 68. The system of any one of aspects 55-67, wherein the body has a reduced diameter portion at the first end and the tip is sized to fit over the reduced diameter portion.

Aspect 69. The system of any one of aspects 55-68, wherein the body is formed from an expanded beaded material.

Aspect 70. The system of aspect 69, wherein the expanded beaded material is one or more of expanded beaded polyethylene, expanded beaded polypropylene, expanded beaded polystyrene, expanded beaded thermoplastic polyurethane, and expanded beaded polylactic acid.

Aspect 71. The system of any one of aspects 55-70, wherein the toy projectile has a ratio of the body length to the nub length of about 12:1 to about 20:1.

Aspect 72. The system of any one of aspects 55-71, wherein the toy projectile has a body length of about 60 mm to about 70 mm, and the length of the nub is about 3 mm to about 5 mm.

Aspect 73. The toy projectile system of any one of aspects 55-72, wherein a difference between a maximum body diameter of the toy projectile and a diameter of the nub is about 0.5 mm to about 3 mm.

It is noted that throughout the disclosure, words such as "forward," "rearward," "upper," "lower," "top," "bottom," "front," "rear," "above," and "below," as well as like terms, refer to portions of the projectile as they are viewed in the drawings relative to other portions or in relationship to the positions of the projectile as it will be typically used, loaded into and launched from a launching apparatus.

While particular embodiments of the present invention have been shown and described in detail, it will be obvious to those skilled in the art that changes and modifications may be made without departing the from the invention in its broader aspects. Therefore, the aim is to cover all such changes and modifications as fall within the true spirit and scope of the invention. The matters set forth in the foregoing description and accompanying drawings are offered by way of illustration only and not as limitations. The actual scope of the invention is to be defined by the subsequent claims when viewed in their proper perspective based on the prior art.

What is claimed:

1. A toy projectile system, comprising:

a toy projectile comprising a body having first and second ends and a nub extending outwardly from the second end, the nub being sized to interact with an improvised projectile checking housing assembly of a toy projectile launching apparatus; and the toy projectile launch apparatus with improvised projectile checking and locking features, comprising:

a projectile retaining element;

a projectile barrel assembly extending rearward the projectile retaining element with the improvised projectile checking housing assembly of the projectile barrel assembly movable between checking and non-checking positions, the projectile barrel assembly comprising a step structure having a projectile receiving opening at the improvised projectile checking housing assembly thereof for allowing the toy projectile the nub present at the projectile receiving opening and preventing another projectile from the projectile receiving opening;

an elongated structure in the improvised projectile checking housing assembly to check the nub;

an improvised projectile button positioned at the end of the elongated structure; and an improvised projectile checking spring mounted to the improvised projectile button with the end of the elongated structure, the improvised projectile button of the elongated structure movable between checking and non-checking positions and preventing movement thereof unless the toy projectile having the nub is present at the projectile receiving opening of the improvised projectile checking housing assembly.

2. The system of claim 1, wherein the nub has a diameter smaller than a diameter of the body at the second end, such that a step is defined between the second end and the nub.

3. The system of claim 1, wherein the body has a boat tail structure at the second end, the boat tail structure tapering into the nub, and a plurality of fins surrounding a circumference of the body at the boat tail structure and extending outwardly such that a step is defined between the plurality of fins and the nub.

4. The system of claim 1, wherein the toy projectile further comprises a plurality of fins attached to or integrally formed with the body at the second end, each fin being separated from adjacent fins by a space, wherein a portion of the body disposed in the space is tapered inwardly along a length of the fin towards the second end.

5. The system of claim 1, comprising 6 fins spaced to surround a circumference of the body and disposed upstream of the nub.

6. The system of claim 1, wherein the body has a maximum body diameter measured upstream of the one or more fins, and an outer circumference of the body around an outer surface of the one or more fins has substantially the same diameter as the maximum body diameter.

7. The system of claim 1, wherein the nub has a length defined between the second end and an oppositely disposed end of the nub of about 1 to 5 mm.

8. The system of claim 1, wherein the nub comprises a circumferential wall joining a first nub end at the second end and an oppositely disposed second nub end, wherein the circumferential wall tapers inwardly from the first nub end to the second nub end.

9. The system of claim 8, wherein the circumferential wall has a taper of about 100°.

10. The system of claim 1, wherein the nub comprises a circumferential wall joining a first nub end at the second end and an oppositely disposed second nub end, wherein the circumferential wall is a straight non-tapered wall.

11. The system of claim 1, wherein the body has a length defined between the first end and the second end of about 50 mm to about 100 mm.

12. The system of claim 1, wherein the body has a reduced diameter portion at the first end and the tip is sized to fit over the reduced diameter portion.

13. The system of claim 1, wherein the body is formed from an expanded beaded material.

14. The system of claim 13, wherein the expanded beaded material is one or more of expanded beaded polyethylene, expanded beaded polypropylene, expanded beaded polystyrene, expanded beaded thermoplastic polyurethane, and expanded beaded polylactic acid.

15. The system of claim 1, wherein the toy projectile has a ratio of the body length to the nub length of about 12:1 to about 20:1.

16. The system of claim 1, wherein the body has a length defined between the first end and the second end of about 60 mm to about 70 mm, and the nub has a length defined between the second end and an opposed end of the nub of about 3 mm to about 5 mm.

17. The toy projectile system of claim 1, wherein a difference between a maximum body diameter of the toy projectile and a diameter of the nub is about 0.5 mm to about 3 mm.

18. A toy projectile system, comprising:

a toy projectile comprising a body having first and second ends and a nub extending outwardly from the second end, the nub being sized to interact with an improvised projectile checking housing assembly of a toy projectile launching apparatus; and the toy projectile launch apparatus with improvised projectile checking and locking features, comprising:

a projectile retaining element having a front side and a backside on the toy launch apparatus for receiving projectiles therein at the backside of the projectile retaining element;

a projectile propelling mechanism forward the projectile retaining element for propelling the received projectiles from the front side of the projectile retaining element;

an improvised projectile checking lock gauge supported with the toy launch apparatus rearward the projectile retaining element where said gauge is disposed to translate alongside the projectiles received at the backside of the projectile retaining element for checking the outer diameter of received projectiles; and a catch at said gauge preventing advancing of the projectile forward in the projectile retaining element.

19. The system of claim 18, wherein the projectile launch apparatus further comprises a follower housing configured to reciprocate adjacent and rearward the backside of the projectile retaining element and towards the front side thereof; a linkage in the toy launch apparatus for moving the follower housing; and a pusher coupled to the follower housing for advancing projectiles received at the backside of the projectile retaining element.

20. The system of claim 18, wherein the toy projectile has a ratio of the body length to the nub length of about 12:1 to about 20:1.

21. The system of claim 18, wherein the body has a length defined between the first end and the second end of about 60 mm to about 70 mm, and the nub has a length defined between the second end and an opposed end of the nub of about 3 mm to about 5 mm.

22. The toy projectile system of claim 18, wherein a difference between a maximum body diameter of the toy projectile and a diameter of the nub is about 0.5 mm to about 3 mm.

23. The system of claim 18, comprising 6 fins spaced to surround a circumference of the body and disposed upstream of the nub.

24. The system of claim 18, wherein the body has a maximum body diameter measured upstream of the one or more fins, and an outer circumference of the body around an outer surface of the one or more fins has substantially the same diameter as the maximum body diameter.

25. The system of claim 18, wherein the nub has a length defined between the second end and an oppositely disposed end of the nub of about 1 to 5 mm.

26. The system of claim 18, wherein the nub has a diameter smaller than a diameter of the body at the second end, such that a step is defined between the second end and the nub.

27. The system of claim 18, wherein the body has a boat tail structure at the second end, the boat tail structure tapering into the nub, and a plurality of fins surrounding a circumference of the body at the boat tail structure and extending outwardly such that a step is defined between the plurality of fins and the nub.

28. The system of claim 18, wherein the toy projectile further comprises a plurality of fins attached to or integrally formed with the body at the second end, each fin being separated from adjacent fins by a space, wherein a portion of the body disposed in the space is tapered inwardly along a length of the fin towards the second end.

* * * * *